US012773016B2

(12) United States Patent
Aoyama et al.

(10) Patent No.: US 12,773,016 B2
(45) Date of Patent: Oct. 27, 2026

(54) POWER SUPPLY UNIT FOR AEROSOL GENERATION DEVICE

(71) Applicant: Japan Tobacco Inc., Tokyo (JP)

(72) Inventors: Tatsunari Aoyama, Tokyo (JP); Hiroshi Kawanago, Tokyo (JP); Toru Nagahama, Tokyo (JP); Takashi Fujiki, Tokyo (JP); Ryo Yoshida, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 320 days.

(21) Appl. No.: 18/502,030

(22) Filed: Nov. 5, 2023

(65) Prior Publication Data

US 2024/0057682 A1 Feb. 22, 2024

Related U.S. Application Data

(63) Continuation of application No. PCT/JP2022/014087, filed on Mar. 24, 2022.

(30) Foreign Application Priority Data

May 10, 2021 (JP) ..... 2021-079741

(51) Int. Cl.
*A24F 40/53* (2020.01)
*A24F 40/465* (2020.01)
(Continued)

(52) U.S. Cl.
CPC ..... *A24F 40/53* (2020.01); *A24F 40/60* (2020.01); *A24F 40/95* (2020.01); *A24F 40/465* (2020.01);
(Continued)

(58) Field of Classification Search
CPC ..... A24F 40/53; A24F 40/60; A24F 40/95; A24F 40/465; A24F 40/51; A24F 40/57;
(Continued)

(56) References Cited

U.S. PATENT DOCUMENTS 5,444,378 A * 8/1995 Rogers ..... G01R 31/3832 320/136
5,694,360 A 12/1997 Iizuka et al.
(Continued)

FOREIGN PATENT DOCUMENTS

CN 104412500 A 3/2015
EP 3618169 A1 * 3/2020 ..... H01M 10/46
(Continued)

OTHER PUBLICATIONS

Extended European Search Report issued May 13, 2025 in corresponding European Patent Application No. 22807218.7, 7 pages.
(Continued)

*Primary Examiner* — Sreeya Sreevatsa
(74) *Attorney, Agent, or Firm* — XSENSUS LLP

(57) ABSTRACT

A power supply unit for an aerosol generation device, includes a control unit configured to control supply of power to a heater configured to heat an aerosol source using the power supplied from a power supply and a charge of the power supply, and a measurement circuit configured to measure a state of the power supply, wherein the measurement circuit includes a detection circuit configured to detect that the state of the power supply is an abnormal state, and an output unit configured to output an abnormality notification in response to the detection by the detection circuit.

20 Claims, 48 Drawing Sheets

(51) Int. Cl.

| | |
|---|---|
| ***A24F 40/51*** | (2020.01) |
| ***A24F 40/57*** | (2020.01) |
| ***A24F 40/60*** | (2020.01) |
| ***A24F 40/65*** | (2020.01) |
| ***A24F 40/95*** | (2020.01) |

(52) U.S. Cl.
CPC ..... *A24F 40/51* (2020.01); *A24F 40/57* (2020.01); *A24F 40/65* (2020.01)

(58) Field of Classification Search
CPC ..... A24F 40/65; A24F 40/20; A24F 40/90; A24F 40/46; A24F 40/50; H02J 7/80; H02J 7/61; H02J 7/62; H02J 7/64; H02J 7/65; H02J 7/663; H02J 7/855; H02J 7/40; Y02E 60/10
USPC ..... 361/93.2
See application file for complete search history.

(56) References Cited

U.S. PATENT DOCUMENTS

| | | | | |
|---|---|---|---|---|
| 9,935,451 | B2 * | 4/2018 | Ikeuchi | H01M 10/44 |
| 10,931,130 | B2 | 2/2021 | Akao | |
| 11,039,504 | B2 | 6/2021 | Kondo | |
| 11,185,110 | B2 | 11/2021 | Fraser et al. | |
| 11,223,077 | B2 | 1/2022 | Akao et al. | |
| 11,322,962 | B2 | 5/2022 | Akao | |
| 11,330,845 | B2 | 5/2022 | Aradachi | |
| 11,337,460 | B2 | 5/2022 | Ono et al. | |
| 11,430,535 | B2 | 8/2022 | Kawashima | |
| 11,432,590 | B2 | 9/2022 | Yamada et al. | |
| 2012/0021255 | A1 * | 1/2012 | Kim | H01M 10/441 429/7 |
| 2015/0128967 | A1 * | 5/2015 | Robinson | A24F 40/50 131/328 |
| 2015/0272223 | A1 | 10/2015 | Weigensberg et al. | |
| 2020/0212516 | A1 * | 7/2020 | Akao | A24B 15/167 |
| 2020/0297028 | A1 * | 9/2020 | Chau | A24F 13/06 |
| 2021/0007396 | A1 | 1/2021 | Bellusci et al. | |
| 2022/0071303 | A1 | 3/2022 | Aradachi | |
| 2022/0079230 | A1 | 3/2022 | Fraser et al. | |

FOREIGN PATENT DOCUMENTS

| | | | | |
|---|---|---|---|---|
| EP | 3704964 | A2 | 9/2020 | |
| JP | H08-203288 | A | 8/1996 | |
| JP | 2013-120214 | A | 6/2013 | |
| JP | 2016-181168 | A | 10/2016 | |
| JP | 6574890 | B1 | 9/2019 | |
| JP | 2020-036592 | A | 3/2020 | |
| JP | 2020-061361 | A | 4/2020 | |
| JP | 2020068762 | A | 5/2020 | |
| JP | 2020-114198 | A | 7/2020 | |
| JP | 2020-114200 | A | 7/2020 | |
| JP | 2020-531015 | A | 11/2020 | |
| JP | 2021-002638 | A | 1/2021 | |
| JP | 2021019498 | A * | 2/2021 | |
| JP | 6864769 | B1 | 4/2021 | |
| JP | 6865879 | B | 3/2022 | |
| KR | 20110118766 | A | 11/2011 | |
| WO | 2010/082608 | A1 | 7/2010 | |
| WO | WO-2016115689 | A1 * | 7/2016 | G05D 23/19 |
| WO | 2017/001820 | A1 | 1/2017 | |
| WO | 2019037110 | A1 | 2/2019 | |
| WO | 2019/082250 | A1 | 5/2019 | |
| WO | 2020255233 | A1 | 12/2020 | |

OTHER PUBLICATIONS

International Search Report and Written Opinion mailed on May 17, 2022, received for PCT Application PCT/JP2022/014087, filed on Mar. 24, 2022, 9 pages including English Translation.
Japanese Office Action issued Mar. 1, 2024 in Japanese Patent Application No. 2023-520892, 4 pages.
Japanese Office Action issued Mar. 1, 2024 in Japanese Patent Application No. 2023-520893, 10 pages.

* cited by examiner

FIG. 22

| MONITORING CONTENT | | | MEASUREMENT CIRCUIT | | | CHARGING CIRCUIT | PROTECTION CIRCUIT |
|---|---|---|---|---|---|---|---|
| TARGET | EVENT | PERIOD | I2C | nGAUGE_INT1 | nGAUGE_INT2 | I2C | — |
| CURRENT | OVERCURRENT | DISCHARGE | — | ≥10A | ≥9.75A | — | ≥12.67A |
| | | CHARGING | ≥SET VALUE＊1.1 | ≥3.0A | ≥2.75A | — | — |
| POWER SUPPLY TEMPERATURE | SUPERHEATING | DISCHARGE | ≥55°C | ≥60°C, 2 SECONDS | ≥85°C, 2 MINUTES | — | — |
| | | CHARGING | ≥ 51°C (RESTORE AT 45°C ≤) | — | ≥85°C, 2 MINUTES | — | — |
| | LOW TEMPERATURE | DISCHARGE | — | — | ≤ -5°C, 5 SECONDS | — | — |
| | | CHARGING | ≤0°C | — | — | — | — |
| VOLTAGE | OVERCHARGE | CONSTANT | — | — | ≥4.235V | ≥4.343V | ≥4.28V |
| | OVER DISCHARGE | CONSTANT | — | — | ≤2.8V | — | ≤2.5V |
| | DEEP DISCHARGE | CONSTANT | INTERNAL ALGORITHM | — | — | — | — |

POWER SUPPLY UNIT FOR AEROSOL GENERATION DEVICE

CROSS-REFERENCE TO RELATED APPLICATIONS

This application is a continuation of International Patent Application No. PCT/JP2022/014087 filed on Mar. 24, 2022, which claims priority to and the benefit of Japanese Patent Application No. 2021-079741 filed on May 10, 2021. This application also relates to PCT/JP2022/014086 filed on Mar. 24, 2022; and PCT/JP2022/014089 filed on Mar. 24, 2022. The entire disclosures of each are incorporated herein by reference.

BACKGROUND OF THE INVENTION

Field of the Invention

The present invention relates to a power supply unit for an aerosol generation device.

Description of the Related Art

In an aerosol generation device for generating aerosol, it is important to manage the state of a power supply that supplies power to a heater configured to heat an aerosol source and various kinds of electronic components. Japanese Patent Laid-Open No. 2020-61361 discloses a system including a fuel gauge circuit. The fuel gauge circuit can be configured to receive various inputs and monitor and/or measure various battery characteristics such as a voltage, a current, a battery capacity, an operation mode of a battery, and the degree of degradation (SOH). The fuel gauge circuit can also generate various kinds of control signals in accordance with received input signals and/or battery characteristics, such as a control signal for controlling charge and discharge.

SUMMARY OF INVENTION

The first to third aspects of the disclosure provide a technique advantageous in managing the state of a power supply at high accuracy.

According to the first aspect, there is provided a power supply unit for an aerosol generation device including a plurality of boards including a first board, wherein the power supply unit comprises a control unit configured to control supply of power to a heater configured to heat an aerosol source using the power supplied from a power supply, a resistor arranged in a path to which a current output from the power supply flows, and a measurement circuit configured to measure a state of the power supply using the resistor, and the resistor and the measurement circuit are arranged on the first board.

In the first aspect, the resistor and the measurement circuit may be arranged on the same surface of the first board.

In the first aspect, the power supply unit may further comprise a first power supply connector connected to a positive electrode of the power supply, and a second power supply connector connected to a negative electrode of the power supply, the path may include a first conductive path connected to the first power supply connector, and a second conductive path connected to the second power supply connector, the second power supply connector may be arranged on the first board, and the resistor may be arranged on the second conductive path.

In the first aspect, the power supply unit may further comprise a first heater connector to which a positive-side terminal of the heater is connected, and a second heater connector to which a negative-side terminal of the heater is connected, and the second heater connector may be arranged on the first board.

In the first aspect, the first heater connector may be arranged on the first board, and the first heater connector and the second heater connector may be arranged on the same surface of the first board.

In the first aspect, the resistor and the second heater connector may be arranged on surfaces of the first board, which are opposite to each other.

In the first aspect, in an orthographic projection to one of two surfaces of the first board, at least a part of the resistor may overlap at least a part of the second heater connector.

In the first aspect, the power supply unit may further comprise a switch arranged between the resistor in the second conductive path and the second heater connector.

In the first aspect, the switch and the second heater connector may be arranged on the same surface of the first board.

In the first aspect, the switch may be an element closest to the second heater connector among electronic components arranged on the same surface.

In the first aspect, the electronic component may be an active element.

In the first aspect, the power supply unit may further comprise a switch unit arranged in the second conductive path to be connected in series with the resistor.

In the first aspect, the resistor and the switch unit may be arranged on the same surface of the first board, and in the orthographic projection, at least a part of the switch unit may overlap at least a part of the second heater connector.

In the first aspect, the power supply unit may further comprise a protection circuit configured to control the switch unit to protect the power supply in accordance with at least one of a current flowing to the second conductive path and an output voltage of the power supply.

In the first aspect, the switch unit may be arranged between the resistor in the second conductive path and the negative electrode of the power supply.

In the first aspect, the power supply unit may further comprise a second resistor arranged in the second conductive path to be connected in series with the resistor, the protection circuit may detect the current flowing to the second conductive path using the second resistor, and the resistor and the second resistor may be arranged on the same surface of the first board.

In the first aspect, a shortest distance between the resistor and the second resistor may be smaller than at least one of a maximum size of the resistor and a maximum size of the second resistor.

In the first aspect, the plurality of boards may include a second board, and the control unit may be arranged on the second board.

In the first aspect, the power supply unit may further comprise a first transformation circuit configured to transform a voltage supplied from the power supply and supply the voltage to a power supply terminal of the measurement circuit, and the first transformation circuit may be arranged on the second board.

In the first aspect, the power supply unit may further comprise a second transformation circuit configured to transform a voltage supplied from the power supply to generate a voltage to be supplied to the heater, and the second transformation circuit may be arranged on the first board.

In the first aspect, the power supply unit may further comprise a second switch arranged in a path that connects an output of the second transformation circuit and the heater and controlled by the control unit, and the second switch may be arranged on the first board.

In the first aspect, the power supply unit may further comprise a detection circuit configured to detect a temperature of the heater, and the detection circuit may be arranged on the first board.

Alternatively, according to the first aspect, there is provided a power supply unit for an aerosol generation device including a plurality of element arrangement surfaces including a first element arrangement surface, wherein the power supply unit comprises a control unit configured to control supply of power to a heater configured to heat an aerosol source using the power supplied from a power supply, a resistor arranged in a path to which a current output from the power supply flows, and a measurement circuit configured to measure a state of the power supply using the resistor, and the resistor and the measurement circuit are arranged on the first element arrangement surface.

According to the second aspect, there is provided a power supply unit for an aerosol generation device, wherein the power supply unit comprises a first conductive path connected to a positive electrode of a power supply, a second conductive path connected to a negative electrode of the power supply, a control unit configured to control heat generation of a heater configured to heat an aerosol source using power supplied from the power supply, a measurement circuit configured to measure a state of the power supply using a resistor arranged in the second conductive path, a switch unit arranged between the resistor in the second conductive path and the negative electrode to cut off a current flowing to the second conductive path, and a protection circuit configured to control the switch unit to protect the power supply in accordance with the current flowing to the second conductive path.

In the second aspect, the protection circuit may turn off the switch unit, thereby stopping supply of a voltage to the control unit and the measurement circuit.

In the second aspect, the power supply unit may further comprise a voltage supply unit configured to supply the voltage to the control unit and the measurement circuit based on a voltage supplied from the power supply, the protection circuit may turn off the switch unit to stop the supply of the voltage from the power supply to the voltage supply unit, and the supply of the voltage from the voltage supply unit to the control unit and the measurement circuit may thus be stopped.

In the second aspect, the voltage may be supplied from the power supply to the voltage supply unit via the first conductive path and the second conductive path.

In the second aspect, the voltage may be supplied from an external device to the voltage supply unit, thereby resuming the supply of the voltage from the voltage supply unit to the control unit and the measurement circuit.

In the second aspect, the power supply unit may further comprise a charge circuit configured to receive the supply of the voltage from the external device and charge the power supply, and the charge of the power supply by the charge circuit may be controlled by the control unit.

In the second aspect, the control unit may control the charge circuit such that the charge circuit receives the supply of the voltage from the external device and starts the charge of the power supply in a state in which the switch unit is off.

In the second aspect, the control unit may control the charge circuit to start the charge of the power supply if it is judged, based on an output voltage of the power supply, that the power supply can be charged.

In the second aspect, if a residual capacity of the power supply exceeds a predetermined value by charge by the charge circuit, the protection circuit may turn on the switch unit.

In the second aspect, the power supply unit may further comprise a second resistor arranged between the resistor in the second conductive path and the negative electrode, and the protection circuit may control the switch unit to protect the power supply in accordance with a current flowing to the second resistor.

In the second aspect, the second resistor may be arranged between the switch unit in the second conductive path and the negative electrode.

In the second aspect, the switch unit may include a transistor arranged to cut off the current flowing to the second conductive path, and a rectifying element connected in parallel with the transistor, and the transistor may be controlled by the protection circuit.

In the second aspect, the rectifying element may be a body diode accompanying the transistor.

In the second aspect, a forward direction of the rectifying element is a direction in which the current for charging the power supply flows, and even in the state in which the switch unit is off, the charge of the power supply may be possible if the current flows via the rectifying element.

In the second aspect, the power supply unit may further comprise a cutoff switch arranged in the second conductive path to cut off the current flowing to the heater and the second conductive path, and the control unit may control the cutoff switch to cut off the current flowing to the heater and the second conductive path based on a measurement result by the measurement circuit.

In the second aspect, the switch unit may be arranged between the cutoff switch in the second conductive path and the negative electrode.

According to the third aspect, there is provided a power supply unit for an aerosol generation device, wherein the power supply unit comprises a control unit configured to control supply of power to a heater configured to heat an aerosol source using power supplied from a power supply, a first resistor and a second resistor, which are connected in series with a path to which a current output from the power supply flows, a switch unit arranged in the path, a measurement circuit configured to measure a state of the power supply using the first resistor, and a protection circuit configured to control the switch unit to cut off the path based on the current that flows to the path and is detected using the second resistor, and a shortest distance between the first resistor and the measurement circuit is smaller than a shortest distance between the second resistor and the protection circuit.

In the third aspect, the first resistor and the measurement circuit may be arranged on the same plane of the same board, and the second resistor and the protection circuit may be arranged on the same plane of the same board.

In the third aspect, the first resistor, the second resistor, the measurement circuit, and the protection circuit may be arranged on the same plane of the same board.

In the third aspect, the first resistor, the second resistor, the measurement circuit, and the protection circuit may be arranged on the same board, the board may include an end portion on a side where the heater is arranged, and a shortest distance between the first resistor and the end portion may be smaller than a shortest distance between the measurement circuit and the end portion.

In the third aspect, a shortest distance between the second resistor and the end portion may be smaller than a shortest distance between the protection circuit and the end portion.

In the third aspect, the shortest distance between the measurement circuit and the end portion may be smaller than the shortest distance between the protection circuit and the end portion.

In the third aspect, a first heater connector to which a positive-side terminal of the heater is connected and a second heater connector to which a negative-side terminal of the heater is connected may be arranged on the board, and a shortest distance between the first heater connector and the end portion and a shortest distance between the second heater connector and the end portion may be smaller than the shortest distance between the measurement circuit and the end portion.

In the third aspect, the first resistor and the second resistor may be arranged on a first surface of the board, and the first heater connector and the second heater connector may be arranged on a second surface of the board.

In the third aspect, in an orthographic projection to the first surface, at least a part of the second heater connector may overlap at least a part of at least one of the first resistor and the second resistor.

In the third aspect, the switch unit may be arranged on the first surface.

In the third aspect, the power supply unit may further comprise a cutoff switch arranged in a path that connects the second heater connector and the first resistor.

In the third aspect, a shortest distance between the cutoff switch and the end portion may be smaller than the shortest distance between the measurement circuit and the end portion.

In the third aspect, the cutoff switch may be arranged on the second surface.

In the third aspect, the power supply unit may further comprise a transformation circuit configured to transform the voltage supplied from the power supply to generate a voltage to be supplied to the heater, and a heater switch arranged in a path that connects an output of the transformation circuit and the first heater connector, and a shortest distance between the heater switch and the end portion may be smaller than the shortest distance between the measurement circuit and the end portion.

In the third aspect, the heater switch may be arranged on the first surface.

In the third aspect, in the orthographic projection to the first surface, at least a part of the heater switch may overlap at least a part of the first heater connector.

In the third aspect, a shortest distance between the first resistor and the second resistor may be smaller than at least one of a maximum size of the first resistor and a maximum size of the second resistor.

According to the fourth aspect, there is provided a power supply unit for an aerosol generation device, wherein the power supply unit comprises a control unit configured to control supply of power to a heater configured to heat an aerosol source using the power supplied from a power supply, a resistor arranged in a path to which a current output from the power supply flows, a thermistor configured to measure a temperature of the power supply, two thermistor connectors to which the thermistor is connected, a measurement circuit configured to measure a state of the power supply using the resistor and measure the temperature of the power supply using the thermistor, and a board on which the resistor, the two thermistor connectors, and the measurement circuit are arranged, and a shortest distance between the two thermistor connectors and the measurement circuit is smaller than a shortest distance between the resistor and the measurement circuit.

In the fourth aspect, the measurement circuit may include a first function of providing information representing the temperature of the power supply to the control unit, and a second function of notifying the control unit of an abnormality of the temperature of the power supply.

In the fourth aspect, the control unit may stop at least one of discharge of the power supply and charge of the power supply in response to a notification from the measurement circuit by the second function.

In the fourth aspect, the measurement circuit may calculate a residual quantity of the power supply based on information obtained using the resistor and information obtained using the thermistor.

In the fourth aspect, two terminals of the thermistor may directly be connected to the two thermistor connectors, respectively.

In the fourth aspect, the thermistor may be arranged to at least partially surround a periphery of the power supply.

In the fourth aspect, the power supply may have a columnar shape, and the thermistor may include an arc-shaped portion along the columnar shape of the power supply.

In the fourth aspect, the measurement circuit and the resistor may be arranged on the same surface of the board.

In the fourth aspect, a distance between a geometric center of a figure formed by an outer edge of the board and a geometric center of the measurement circuit may be smaller than a shortest distance between the geometric center of the figure and the resistor.

In the fourth aspect, the distance between the geometric center of the figure formed by the outer edge of the board and the geometric center of the measurement circuit may be smaller than a shortest distance between the geometric center of the figure and the two thermistor connectors.

In the fourth aspect, the distance between the geometric center of the figure formed by the outer edge of the board and the geometric center of the measurement circuit may be smaller than a shortest distance between the geometric center of the figure and the resistor and smaller than the shortest distance between the geometric center of the figure and the two thermistor connectors.

In the fourth aspect, the power supply unit may further comprise two power supply connectors to which the power supply is connected, the two power supply connectors may be arranged on the board, and a shortest distance between the geometric center of the figure formed by the outer edge of the board and the geometric center of the measurement circuit may be smaller than a shortest distance between the geometric center of the figure and the two power supply connectors.

In the fourth aspect, the control unit may be arranged on a board different from the board on which the resistor, the two thermistor connectors, and the measurement circuit are arranged.

The fifth to seventh aspects of the disclosure provide a technique advantageous in protecting the power supply.

According to the fifth aspect, there is provided a power supply unit for an aerosol generation device, wherein the power supply unit comprises a control unit configured to control supply of power to a heater configured to heat an aerosol source using the power supplied from a power supply and a charge of the power supply, and a measurement circuit configured to measure a state of the power supply, wherein the measurement circuit includes a detection circuit configured to detect that the state of the power supply is an abnormal state, and an output unit configured to output an abnormality notification in response to the detection by the detection circuit.

In the fifth aspect, the measurement circuit may further include an interface configured to provide state information about the state of the power supply to the control unit in response to a request from the control unit.

In the fifth aspect, the control unit may execute a protection operation of protecting the power supply in accordance with the abnormality notification and the state information.

In the fifth aspect, the protection operation may include inhibiting charge of the power supply and inhibiting discharge from the power supply to the heater.

In the fifth aspect, the power supply unit may further comprise a notification unit configured to notify that the power supply is abnormal.

In the fifth aspect, the power supply unit may further comprise a reset unit configured to reset the control unit, wherein the protection operation is canceled by resetting the control unit by the reset unit.

In the fifth aspect, the output unit may output the abnormality notification in accordance with at least one of a charge current of the power supply exceeding a first reference value and a discharge current from the power supply exceeding a second reference value.

In the fifth aspect, the control unit may acquire the state information from the measurement circuit via the interface in response to the output of the abnormality notification from the output unit, and the state information acquired from the measurement circuit may include at least one of information used to judge whether the power supply has permanently failed and information representing that the power supply has permanently failed.

In the fifth aspect, the abnormal state may include a state in which a temperature of the power supply exceeds a reference temperature.

In the fifth aspect, the power supply unit may further comprise a protection unit configured to protect the power supply irrespective of control by the control unit in response to the abnormality notification.

In the fifth aspect, after the protection unit protects the power supply in response to the abnormality notification, if the state information acquired via the interface indicates that the power supply is not in the abnormal state, the control unit may enable the supply of the power to the heater.

In the fifth aspect, protection of the power supply by the protection unit can be canceled.

In the fifth aspect, the control unit may acquire first information concerning the state of the power supply from the measurement circuit via the interface by periodical polling, and may acquire second information concerning the state of the power supply from the measurement circuit via the interface in response to the abnormality notification, the control unit may execute an operation of protecting the power supply if the first information indicates that the power supply is in a first state, and the measurement circuit may output the abnormality notification if the power supply is set in a second state worse than the first state.

In the fifth aspect, the first information and the second information may be information representing a temperature of the power supply.

In the fifth aspect, the control unit may acquire first information concerning the state of the power supply from the measurement circuit via the interface by periodical polling, and may acquire second information concerning the state of the power supply from the measurement circuit via the interface in response to the abnormality notification, the control unit may execute an operation of protecting the power supply if the first information indicates that at the time of the charge of the power supply, the state of the power supply satisfies one of conditions included in a first condition group, and may execute the operation of protecting the power supply if the first information indicates that at the time of discharge of the power supply, the state of the power supply may satisfy one of conditions included in a second condition group, and the number of conditions included in the first condition group may be larger than the number of conditions included in the second condition group.

In the fifth aspect, the control unit may acquire first information concerning the state of the power supply from the measurement circuit via the interface by periodical polling, and may acquire second information concerning the state of the power supply from the measurement circuit via the interface in response to the abnormality notification, the control unit may execute an operation of protecting the power supply if the second information indicates that at the time of the charge of the power supply, the state of the power supply satisfies one of conditions included in a third condition group, and executes the operation of protecting the power supply if the second information indicates that at the time of discharge of the power supply, the state of the power supply satisfies one of conditions included in a fourth condition group, and the number of conditions included in the third condition group may be smaller than the number of conditions included in the fourth condition group.

In the fifth aspect, the abnormality notification may include a notification by a first abnormality signal and a notification by a second abnormality signal, the first abnormality signal may be provided to the control unit, and the second abnormality signal is provided to the control unit, and the first abnormality signal may be output from the output unit if the state of the power supply is a first abnormal state, and the second abnormality signal may be output from the output unit if the state of the power supply is a second abnormal state different from the first abnormal state.

In the fifth aspect, the first abnormality signal may be provided to the control unit via an information holding circuit configured to hold the first abnormality signal.

According to the sixth aspect, there is provided a power supply unit for an aerosol generation device, wherein the power supply unit comprises a connector to which a heater configured to heat an aerosol source using power supplied from a power supply is connected, a control unit including a terminal to which a potential according to a potential of a positive electrode of the power supply is supplied, and configured to control supply of the power to the heater and charge of the power supply, a switch arranged in a path to which a current output from the power supply flows to cut off discharge of the power supply, and a protection circuit configured to open the switch to cut off the discharge of the power supply if the potential of the positive electrode falls below a first level, and if the potential of the positive electrode detected based on the potential supplied to the terminal exceeds a second level larger than the first level by the charge of the power supply, the control unit increases a charge current of the power supply.

In the sixth aspect, the power supply unit may further comprise a rectifying element connected in parallel with the switch to supply the charge current to the power supply.

In the sixth aspect, the rectifying element may be a body diode accompanying the switch.

In the sixth aspect, an output voltage of the power supply may be supplied to the protection circuit irrespective of a state of the switch.

In the sixth aspect, the supply of the power to the control unit may be cut off by opening the switch.

In the sixth aspect, a difference of the second level to the first level may be larger than a forward voltage of the rectifying element.

In the sixth aspect, a potential obtained by dividing the potential of the positive electrode of the power supply may be supplied to the terminal.

In the sixth aspect, the path may include a first conductive path connected to the positive electrode of the power supply, and a second conductive path connected to a negative electrode of the power supply, and the switch may be arranged in the second conductive path.

In the sixth aspect, the power supply unit may further comprise a voltage supply circuit configured to, using a voltage supplied from an external device, supply a first voltage for charging the power supply to between the first conductive path and the second conductive path and generate a second voltage for operating the control unit, and the control unit may control the charge of the power supply by controlling the voltage supply circuit.

In the sixth aspect, the voltage supply circuit may include a charge circuit configured to generate, in addition to the first voltage, a third voltage using the voltage supplied from the external device, and a transformation circuit configured to transform the third voltage output from the charge circuit into the second voltage.

In the sixth aspect, the control unit may execute error processing if the voltage supply circuit ends the charge before the potential of the positive electrode detected based on the potential supplied to the terminal exceeds the second level.

In the sixth aspect, if a time required by the voltage supply circuit to charge the power supply is shorter than a reference time, the control unit may inhibit the charge of the power supply and the supply of the power to the heater as the error processing.

In the sixth aspect, a state in which the charge of the power supply and the supply of the power to the heater are inhibited as the error processing may be uncancelable.

In the sixth aspect, if the time required by the voltage supply circuit to charge the power supply is not shorter than the reference time, the control unit may cancel the state in which the charge of the power supply and the supply of the power to the heater are inhibited as the error processing by reactivating the control unit.

In the sixth aspect, the protection circuit may close the switch if the potential of the positive electrode exceeds a third level larger than the first level.

In the sixth aspect, the power supply unit may further comprise a measurement circuit configured to measure the voltage of the power supply, and the control unit may increase the charge current of the power supply if the potential of the positive electrode measured by the measurement circuit exceeds a fourth level smaller than the second level after the protection circuit closes the switch.

According to the seventh aspect, there is provided a power supply unit for an aerosol generation device, wherein the power supply unit comprises a connector to which a heater configured to heat an aerosol source using power supplied from a power supply is connected, a control unit configured to control supply of the power to the heater and a charge operation of the power supply, and a measurement circuit configured to measure a state of the power supply, the control unit includes a first terminal configured to receive information having correlation with the state of the power supply and acquires a first index according to the information supplied to the first terminal, the measurement circuit includes a second terminal configured to receive information having correlation with the state of the power supply and generates a second index according to the information supplied to the second terminal and provides the second index to the control unit, and the control unit controls the charge operation of the power supply in accordance with the first index and the second index.

In the seventh aspect, the power supply unit can further comprise a charge circuit capable of operating in a first mode in which the power supply is charged with a first current value smaller than a predetermined current value and in a second mode in which the power supply is charged with a second current value larger than the predetermined current value, and if at least one of the first index and the second index indicates that the power supply is in an overdischarge state, the control unit may control the charge operation such that the power supply is charged in the first mode.

In the seventh aspect, the power supply unit may further comprise a charger circuit capable of operating in a first mode in which the power supply is charged with a first current value smaller than a predetermined current value and in a second mode in which the power supply is charged with a second current value larger than the predetermined current value, and if at least one of the first index and the second index indicates that an overdischarge state of the power supply is eliminated, the control unit may control the charge operation such that the power supply is charged in the second mode.

In the seventh aspect, the power supply unit may further comprise a charge circuit capable of operating in a first mode in which the power supply is charged with a first current value smaller than a predetermined current value and in a second mode in which the power supply is charged with a second current value larger than the predetermined current value, if at least one of the first index and the second index indicates that the power supply is in an overdischarge state, the control unit may control the charge operation such that the power supply is charged in the first mode, and if at least one of the first index and the second index indicates that the overdischarge state is eliminated, the control unit may control the charge operation such that the power supply is charged in the second mode.

In the seventh aspect, the first index and the second index may be indices comparable on the same scale.

In the seventh aspect, the first index and the second index may be the output voltage of the power supply.

In the seventh aspect, the power supply unit may further comprise a notification unit configured to notify information about a residual quantity of the power supply, and the control unit may acquire, as the state of the power supply, a third index indicating the residual quantity of the power supply from the measurement circuit and cause the notification unit to notify information according to the third index.

In the seventh aspect, the third index may be an SOC.

In the seventh aspect, the power supply unit may further comprise a switch arranged in a path to which a current output from the power supply flows to cut off discharge of the power supply, a protection circuit configured to open the switch to cut off the discharge of the power supply if the potential of the positive electrode of the power supply falls below a first level, and close the switch if the potential of the positive electrode exceeds a second level larger than the first level, and a rectifying element connected in parallel with the switch to supply a charge current to the power supply.

In the seventh aspect, the control unit may control the charge operation based on the first index in a state in which the switch is open, and control the charge operation based on the second index in a state in which the switch is closed.

In the seventh aspect, the power supply unit may further comprise a rectifying element connected in parallel with the switch to supply a charge current to the power supply.

In the seventh aspect, the rectifying element may be a body diode accompanying the switch.

In the seventh aspect, an output voltage of the power supply may be supplied to the protection circuit irrespective of the state of the switch.

In the seventh aspect, a potential obtained by dividing the potential of the positive electrode of the power supply may be supplied to the first terminal.

In the seventh aspect, the path may include a first conductive path connected to the positive electrode of the power supply, and a second conductive path connected to a negative electrode of the power supply, and the switch may be arranged in the second conductive path.

In the seventh aspect, the power supply unit may further comprise a voltage supply circuit configured to, using a voltage supplied from an external device, supply a first voltage for charging the power supply to between the first conductive path and the second conductive path and generate a second voltage for operating the control unit, and the control unit may control the charge of the power supply by controlling the voltage supply circuit.

In the seventh aspect, the voltage supply circuit may include a charge circuit configured to generate, in addition to the first voltage, a third voltage using the voltage supplied from the external device, and a transformation circuit configured to transform the third voltage output from the charge circuit into the second voltage.

The eighth aspect of the disclosure provides a technique advantageous in simplifying operations.

According to the eighth aspect, there is provided a power supply unit for an aerosol generation device, wherein the power supply unit comprises a switch, an insertion hole capable of storing an aerosol source, a slider capable of operating to provide a closed state in which the insertion hole is closed and an open state in which an aerosol source can be inserted into the insertion hole, a first detection unit configured to detect a state of the slider, and a circuit block configured to perform an operation according to a detection result by the first detection unit if the switch is operated.

In the eighth aspect, the power supply unit may further comprise an outer case including a detachable panel, and a second detection unit configured to detect presence/absence of the panel, and if the switch is operated in a state in which the absence of the panel is detected by the second detection unit, the circuit block performs an operation according to a detection result by the second detection unit irrespective of the detection result by the first detection unit.

In the eighth aspect, the circuit block may include a control unit that can be reactivated, if the switch is operated in a state in which the presence of the panel is detected by the second detection unit and in a state in which the open state of the slider is detected by the first detection unit, the circuit block may execute first processing associated with generation of aerosol, if the switch is operated in the state in which the presence of the panel is detected by the second detection unit and in a state in which the closed state of the slider is detected by the first detection unit, the circuit block may execute second processing not associated with generation of aerosol, and if the switch is operated in the state in which the absence of the panel is detected by the second detection unit, the circuit block may reactivate the control unit irrespective of the detection result by the first detection unit.

In the eighth aspect, the second processing may include processing associated with communication with an external device.

BRIEF DESCRIPTION OF DRAWINGS

FIG. 22 is a view for exemplarily explaining functions associated with protection of the power supply;

FIG. 24 is a view showing an example of connection of the measurement circuit, a control unit, a transformation circuit, a charge circuit, information holding circuits, OP amplifiers, and the like;

DESCRIPTION OF EMBODIMENTS

Figure 1A:
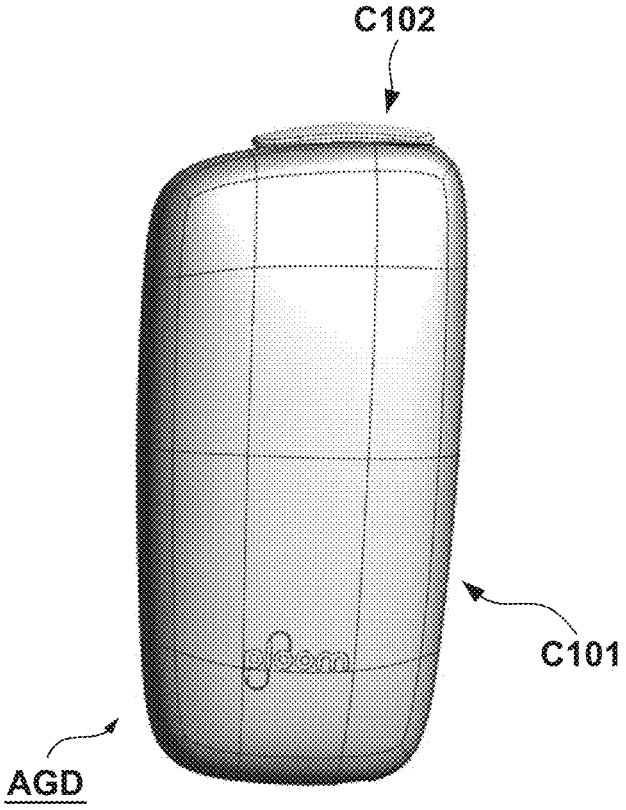
FIG. 1A is a view exemplifying the outer appearance of an aerosol generation device.
Figure 1B:
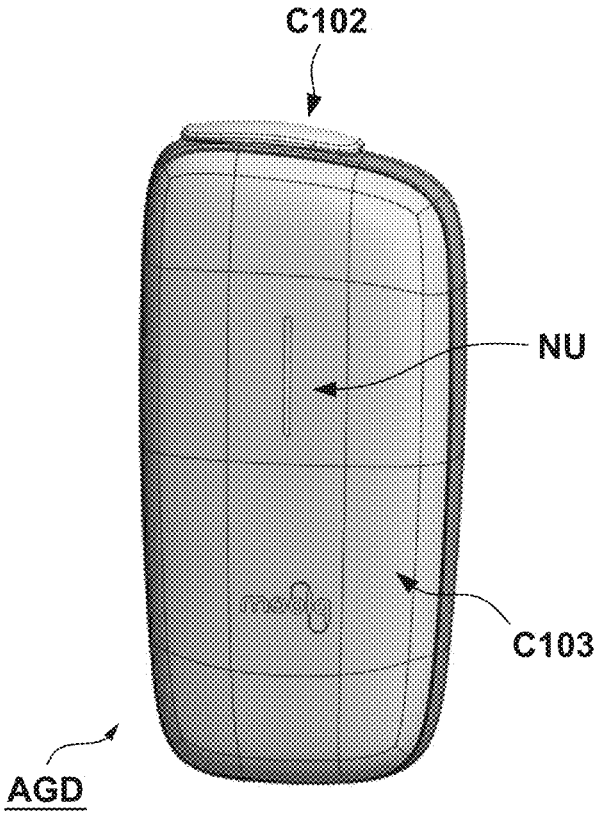
FIG. 1B is a view exemplifying the outer appearance of the aerosol generation device.
Figure 1C:
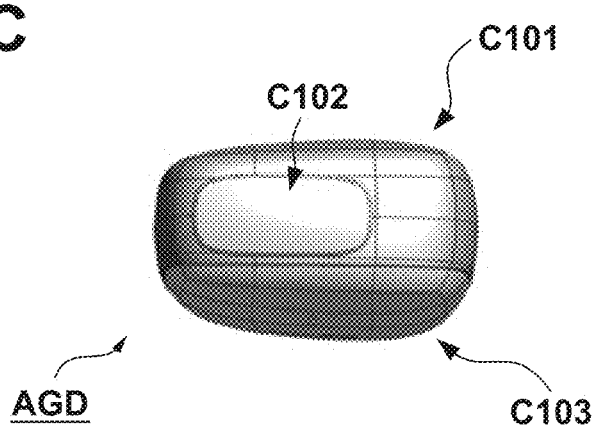
FIG. 1C is a view exemplifying the outer appearance of the aerosol generation device.
Figure 1D:
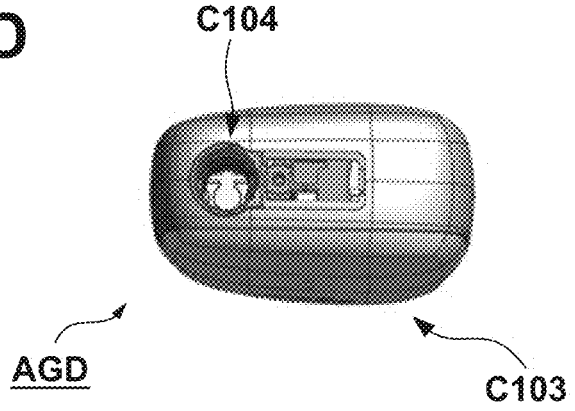
FIG. 1D is a view exemplifying the outer appearance of the aerosol generation device.
Figure 1E:
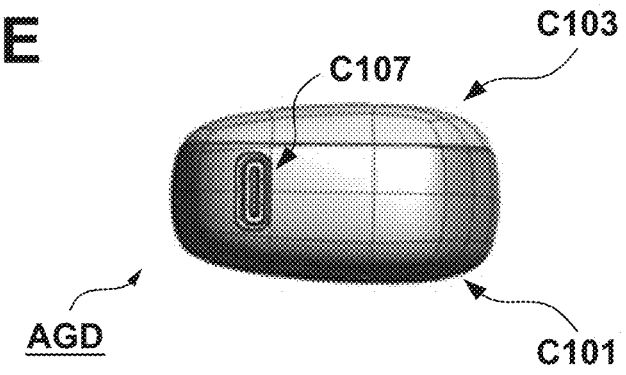
FIG. 1E is a view exemplifying the outer appearance of the aerosol generation device.

Hereinafter, embodiments will be described in detail with reference to the accompanying drawings. It should be noted that the following embodiments are not intended to limit the scope of the appended claims, and that not all the combinations of features described in the embodiments are necessarily essential to the present invention. Of a plurality of features described in the embodiments, two or more features may arbitrarily be combined. In addition, the same reference numerals denote the same or similar parts, and a repetitive description will be omitted.

FIGS. 1A to 1E show the configuration of an aerosol generation device AGD according to an embodiment. Here, FIGS. 1A to 1E are a back view, a front view, top views, and a bottom view of the aerosol generation device AGD, respectively. FIG. D is a top view showing a state in which a constituent component (slider C102) of the aerosol generation device AGD is removed.

The aerosol generation device AGD can be configured to, for example, provide, to a user, aerosol with flavor, or a gas containing aerosol and a flavor material, or aerosol, or aerosol containing a flavor material in accordance with an operation (to be also referred to as an "atomization request" hereinafter) of requesting aerosol generation, like an inhalation operation by the user (inhaler). The aerosol source may be a solid, a liquid, or a mixture of a solid and a liquid. The liquid aerosol source can contain, for example, a liquid such as a polyhydric alcohol such as glycerin or propylene glycol. As a detailed example, the aerosol source can contain a solution mixture of glycerin and propylene glycol. The aerosol source may contain a drug. A vapor source such as water may be used in place of or together with the aerosol source. The flavor material can be, for example, a formed body obtained by forming a tobacco material. Alternatively, the flavor material may be formed by a plant (for example, mint, a herb, a Chinese herb, coffee beans, or the like) other than tobacco. A flavoring agent such as menthol may be added to the flavor material. The flavor material may be added to the aerosol source.

The aerosol generation device AGD can include, for example, an outer case C101, and the slider C102 attached to the outer case C101. The outer case C101 can include an insertion hole C104 capable of receiving or storing an insertion object including at least one of an aerosol source and a flavor material. The slider C102 can provide a closed state in which the insertion hole C104 is closed or covered and an open state in which the insertion hole C104 is exposed to the outer space, and an insertion object can be inserted into the insertion hole C104. The slider C102 may be, for example, a slide mechanism along a straight line or a curved line, or a pivoting mechanism. The slider C102 may be replaced with a shutter. The insertion object may be, for example, a stick or a capsule. A heater configured to heat the insertion object can be arranged in the insertion hole C104. The heater can be, for example, a resistance element. The heater formed by a resistance element or the like may be arranged in the insertion object. In this case, the insertion object can be provided with an electric connector configured to energize the heater, and the insertion hole C104 can be provided with an electric connector electrically connected to the electric connector provided on the insertion object. The heater can be, for example, an induction heating type heater. The induction heating type heater can include a coil, and a susceptor that generates heat using induction heating by an electromagnetic wave from the coil. The susceptor can be arranged in the insertion object.

The whole or a part of the outer case C101 may be formed by a component such as an easily detachable panel. In another expression, the whole or a part of the outer case C101 may be formed by a component such as a panel whose detachment by the user is not inhibited. In an example, the outer case C101 includes an outer panel C103 that can easily be detached. The outer panel C103 can be connected to the remaining portion (main body portion) of the outer case C101 by a magnet or a latch mechanism. Note that the outer case C101 can be understood as the first portion of the exterior component of the aerosol generation device AGD, and the outer panel C103 can be understood as the second portion of the exterior component.

The aerosol generation device AGD can include a notification unit NU. The notification unit NU can provide, to the user, information in a form perceptible to the user. The notification unit NU can include, for example, at least one of a display device, a speaker, a vibration device, and an aroma generation device. The display device can include, for example, at least one of a light emitting device such as an LED and a two-dimensional display device such as a liquid crystal display device.

Figure 2A:
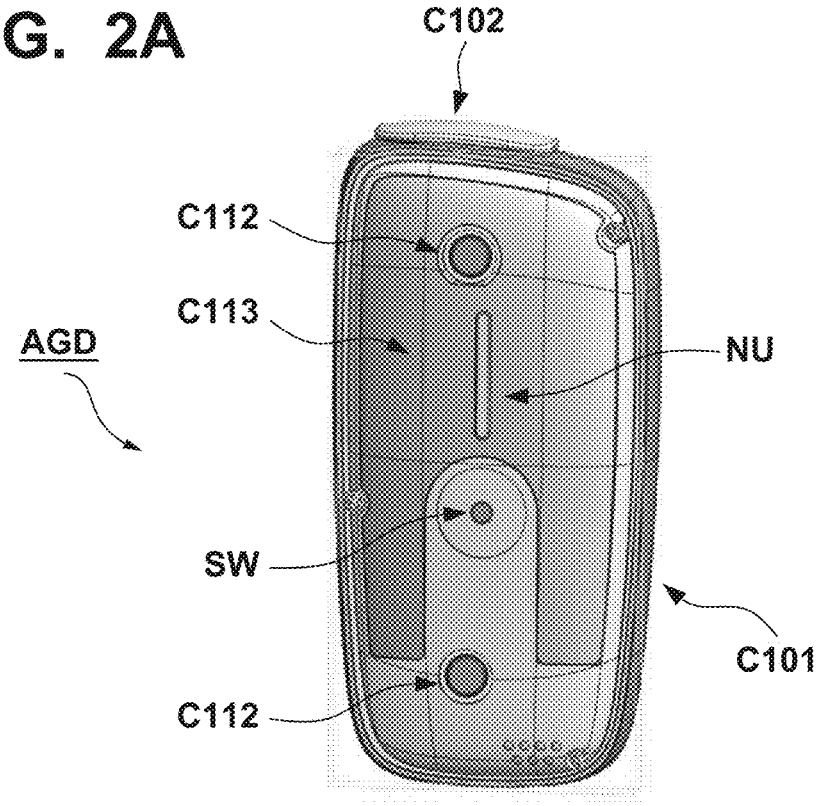
FIG. 2A is a view exemplifying the configuration of the aerosol generation device.

FIG. 2A exemplifies the aerosol generation device AGD in a state in which the outer panel C103 is detached. The aerosol generation device AGD can include one or a plurality of magnets (holding units) C112 configured to hold the outer panel C103 by a magnetic force. The aerosol generation device AGD can include a switch SW that can be operated by the user. The outer panel C103 is configured to be easily deformed by an operation of the user, and the switch SW may be operated by a pressing force by the user for the outer panel C103. Alternatively, the switch SW may be arranged to be exposed to the outside of the aerosol generation device AGD. The aerosol generation device AGD can include an inner panel C113 inside the outer panel C103. The inner panel C113 can have a plurality of opening portions configured to expose the magnets C112, the notification unit NU, and the switch SW. The inner panel C113 can be fastened to the internal structure of the aerosol generation device AGD by, for example, fastening components such as screws.

Figure 2B:
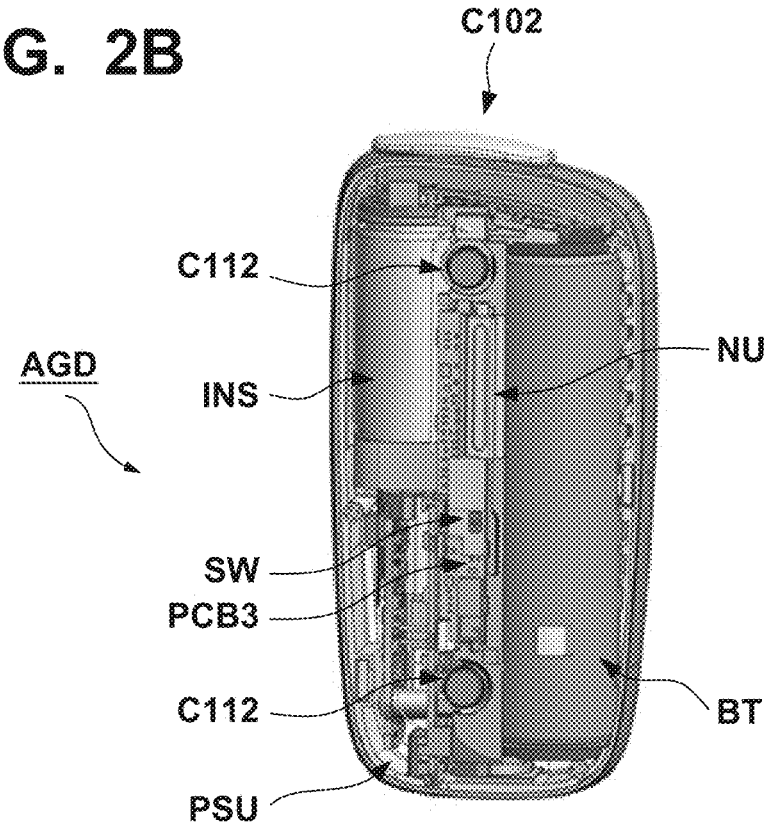
FIG. 2B is a view exemplifying the configuration of the aerosol generation device.

FIG. 2B exemplifies the aerosol generation device AGD in a state in which the inner panel C113 is further detached from the internal structure. The aerosol generation device AGD includes a power supply unit PSU. The power supply unit PSU can include a power supply BT. As the power supply BT, for example, lithium-ion secondary battery may be used, a lithium-ion capacitor may be used, a combination thereof may be used, or a power supply element of another type may be used.

Figure 3A:
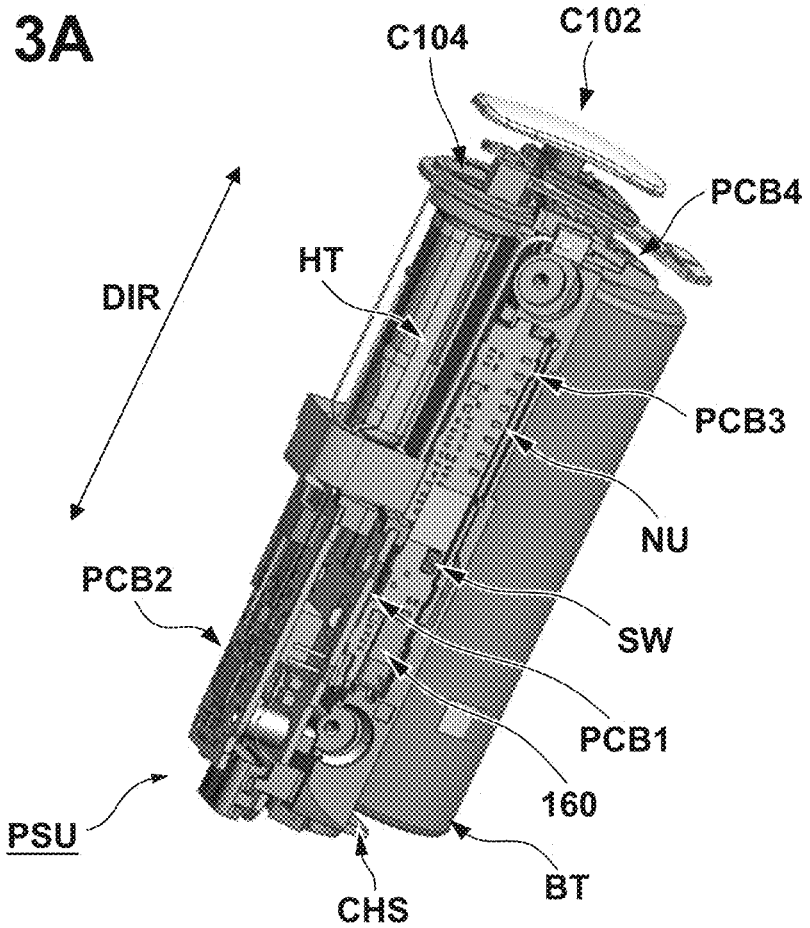
FIG. 3A is a view exemplifying the configuration of the aerosol generation device.
Figure 3B:
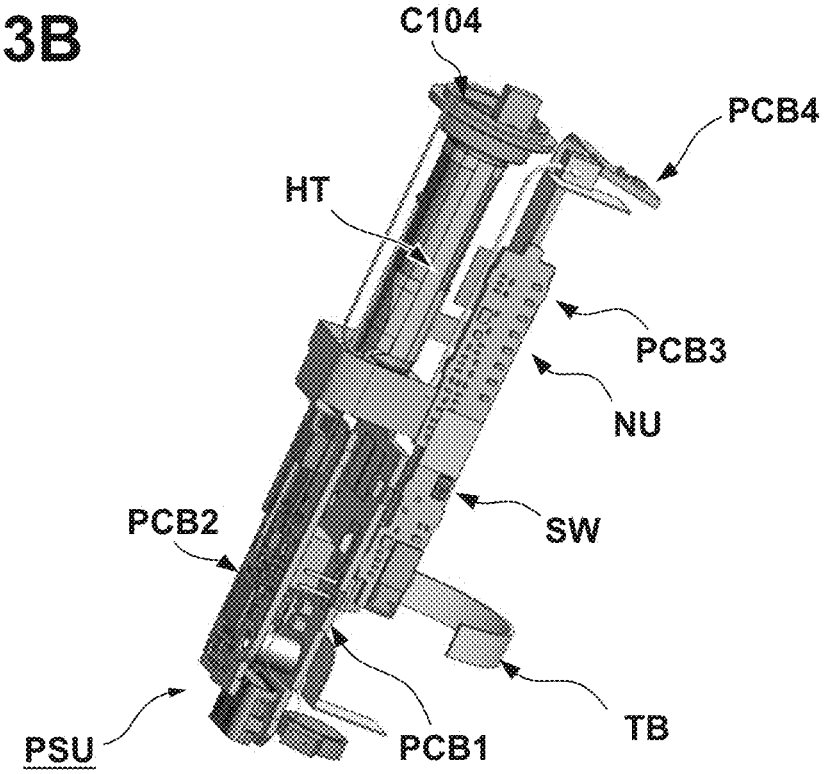
FIG. 3B is a view exemplifying the configuration of the aerosol generation device.

FIG. 3A exemplifies the aerosol generation device AGD in a state in which the outer case C101 is wholly detached. FIG. 3B exemplifies the aerosol generation device AGD in a state in which a chassis CHS and the power supply BT are further detached. The aerosol generation device AGD can include a heater HT that heats the insertion object inserted into the insertion hole C104. The heater HT can be arranged in a heat insulating tube INS exemplified in FIG. 2B. The power supply unit PSU can include a plurality of boards (for example, printed wiring boards (PCB)) PCB1, PCB2, PCB3, and PCB4.

The power supply BT can have a pillar shape such as a columnar shape whose axial direction is a direction parallel to an insertion/removal direction DIR of the insertion object to the insertion hole C104. In other words, the insertion/removal direction DIR of the insertion object to the insertion hole C104 and the axial direction of the power supply BT can be parallel to each other. A part of the side surface of the power supply BT can be arranged to face the heater HT or the insertion hole C104 via at least the heat insulating tube INS. Another part of the side surface of the power supply BT can be arranged to face the first board PCB1 directly or via another component. The second board PCB2 can be arranged in parallel to the first board PCB1. The third board PCB3 can be arranged at a right angle with respect to the first board PCB1 and the second board PCB2. The third board PCB3 can be arranged between the first board PCB1 and the power supply BT in the widthwise direction of the power supply unit PSU (in a direction in which the size of the aerosol generation device AGD is largest in directions orthogonal to the insertion/removal direction DIR). The third board PCB3 can be arranged to have portions facing a part of the side surface of the power supply BT and a part of the heat insulating tube INS. The third board PCB3 can have a shape long in the direction parallel to the insertion/removal direction DIR. As shown in FIG. 2B, the third board PCB3 can be arranged between the two magnets C112.

Figure 4:
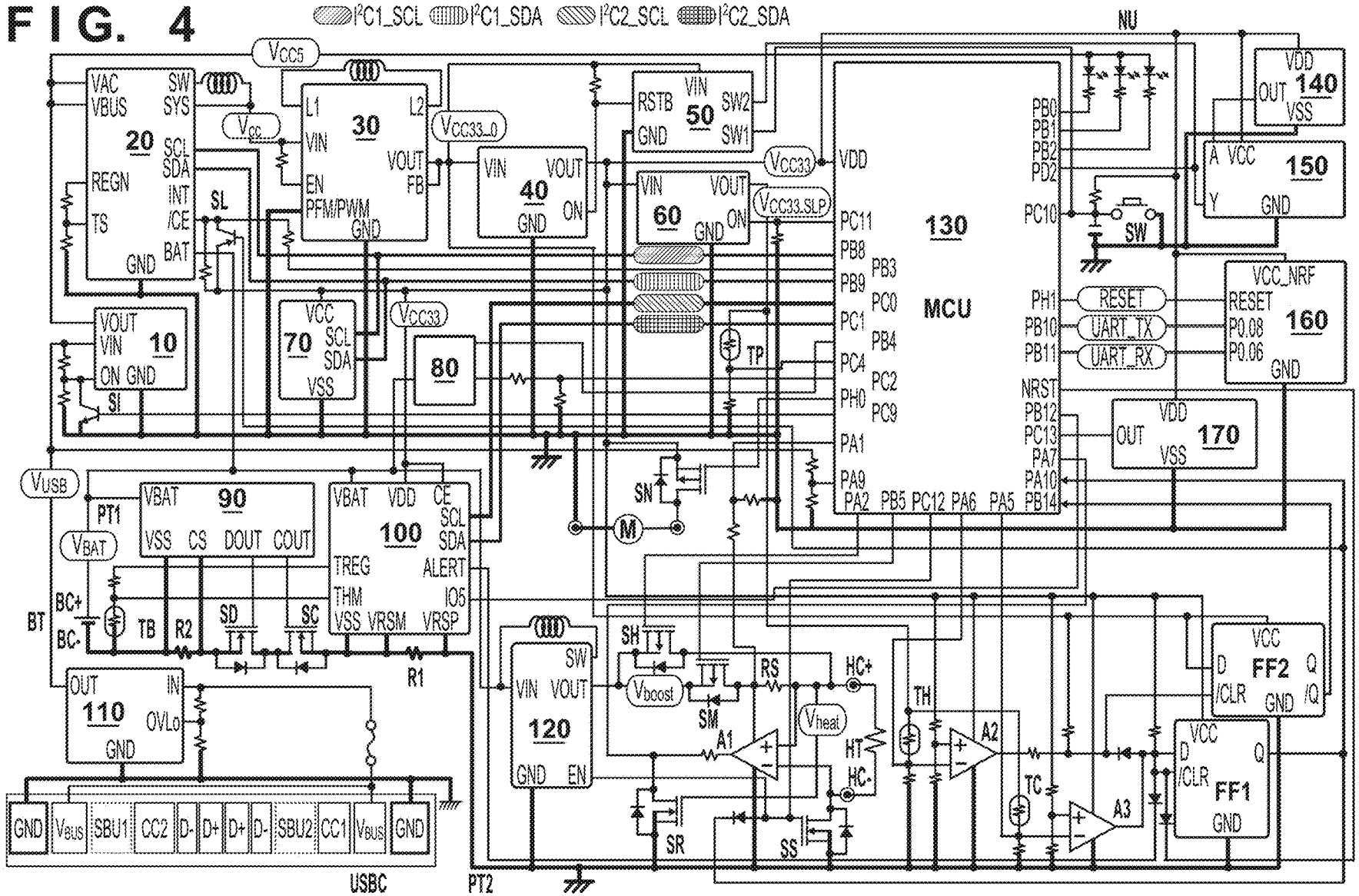
FIG. 4 is a view exemplifying the circuit configuration of a power supply unit.

FIG. 4 exemplarily shows the circuit configuration of the power supply unit PSU. The power supply unit PSU can include the power supply BT, a protection circuit 90, a measurement circuit 100, an overvoltage protection circuit 110, a transformation circuit 120, an OP amplifier (amplification circuit) A1, switches SH, SM, SR, and SS, and a thermistor (for example, an NTC thermistor or a PTC thermistor) TB. The power supply BT, the protection circuit 90, the measurement circuit 100, the overvoltage protection circuit 110, the transformation circuit 120, the OP amplifier A1, and the switches SH, SM, SR, and SS can be arranged on, for example, the first board PCB1.

The power supply unit PSU can also include a load switch 10, a charge circuit 20, a transformation circuit 30, a load switch 40, a power switch driver 50, a load switch 60, a nonvolatile memory (for example, ROM) 70, and a switch circuit 80. The load switch 10, the charge circuit 20, the transformation circuit 30, the load switch 40, the power switch driver 50, the load switch 60, the nonvolatile memory 70, and the switch circuit 80 can be arranged on, for example, the second board PCB2. The power supply unit PSU can also include a control unit (MCU) 130, a thermistor TP (for example, an NTC thermistor or a PTC thermistor), a thermistor (for example, an NTC thermistor or a PTC thermistor) TH, an OP amplifier (amplification circuit) A2, a thermistor (for example, an NTC thermistor or a PTC thermistor) TC, an OP amplifier (amplification circuit) A3, and information holding circuits FF1 and FF2. The control unit 130, the OP amplifier A2, the OP amplifier A3, and the information holding circuits FF1 and FF2 can be arranged on the second board PCB2.

The power supply unit PSU can also include a detection unit 140, a Schmitt trigger circuit 150, a communication device 160, a detection unit 170, the switch SW, and the notification unit NU. The detection unit 140, the Schmitt trigger circuit 150, the communication device 160, the switch SW, and the notification unit NU can be arranged no the third board PCB3. The power supply unit PSU can also include the detection unit 170, and the detection unit 170 can be arranged no the fourth board PCB4.

The operations of components that form the power supply unit PSU will be described below. The positive electrode of the power supply BT is electrically connected to a first power supply connector BC+, and the negative electrode of the power supply BT is electrically connected to a second power supply connector BC−. The potential of the positive electrode of the power supply BT can be supplied to the VBAT terminal of the protection circuit 90, the VBAT terminal of the measurement circuit 100, the VIN terminal of the transformation circuit 120, the BAT terminal of the charge circuit 20, and the potential input terminal of the switch circuit 80.

Using a resistor R2 arranged in a path to which a current output from the power supply BT flows, more specifically, a second conductive path PT2 electrically connected to the second power supply connector BC−, the protection circuit 90 can measure the current flowing to the second conductive path PT2 and control a switch unit arranged in the second conductive path PT2 to protect the power supply BT in accordance with the current. The switch unit can include a first transistor (first switch) SD and a second transistor (first switch) SC, which are connected in series. Here, if opened (turned off), the first transistor SD functions as a switch configured to cut off the second conductive path PT2 to stop discharge of the power supply BT. If opened (turned off), the second transistor SC functions as a switch configured to cut off the second conductive path PT2 to stop charge of the power supply BT. The first transistor SD may be arranged in a first conductive path PT1 electrically connected to the first power supply connector BC+, and the second transistor SC may also be arranged in the first conductive path PT1. The resistor R2 may also be arranged in the first conductive path PT1. As a detailed example, if the current flowing to the second conductive path PT2, which is measured during charge of the power supply BT, is excessive, the protection circuit 90 opens (turns off) the second transistor SC. Also, if the current flowing to the second conductive path PT2, which is measured during non-charge of the power supply BT, is excessive, the protection circuit 90 opens (turns off) the first transistor SD. The protection circuit 90 can be formed by, for example, an integrated circuit (IC).

The protection circuit 90 can measure the output voltage of the power supply BT based on the potential of the positive electrode of the power supply BT supplied to the VBAT terminal and control the switch unit arranged in the second conductive path PT2 to protect the power supply BT in accordance with the output voltage. As a detailed example, if the voltage of the power supply BT indicates an overcharge state of the power supply BT, the protection circuit 90 opens (turns off) the second transistor SC. Also, if the output voltage of the power supply BT indicates an overdischarge state of the power supply BT, the protection circuit 90 opens (turns off) the first transistor SD. It can be understood that the overcharge state of the power supply BT indicates a state in which the output voltage of the power supply BT is higher than predetermined full charge voltage. It can be understood that the overdischarge state of the power supply BT indicates a state in which the output voltage of the power supply BT is lower than a predetermined discharge end voltage. Also, it can be understood that a deep discharge state of the power supply BT indicates a state in which the discharge of the power supply BT in the overdischarge state further progresses, and an irreversible change occurs in the internal structure of the power supply BT.

As exemplified in FIG. 4, a first rectifying element connected in parallel to the first transistor SD may be provided, and the first rectifying element may be formed as the body diode of the first transistor SD. The forward direction of the first rectifying element is a direction in which the current for charging the power supply BT flows. Also, as exemplified in FIG. 4, a second rectifying element connected in parallel to the second transistor SC may be provided, and the second rectifying element may be formed as the body diode of the second transistor SC. The forward direction of the second rectifying element is a direction in which the current discharged from the power supply BT flows.

Using VBAT terminal and a resistor R1 arranged in a path to which the current output from the power supply BT flows, more specifically, the second conductive path PT2 electrically connected to the second power supply connector BC−, the measurement circuit 100 can measure the state of the power supply BT. The resistor R1 may be arranged in the first conductive path PT1. The measurement circuit 100 can be arranged to measure the temperature of the power supply BT by measuring the resistance value of the thermistor (for example, an NTC thermistor or a PTC thermistor) TB arranged to measure the temperature of the power supply BT. As exemplified in FIGS. 3A and 3B, the power supply BT can have a columnar shape. In this case, the thermistor TB can include an arc-shaped portion along the columnar shape of the power supply BT. The thermistor TB can surround the power supply BT with a central angle of 180° or more, 200° or more, 220° or more, 240° or more, or 260° or more by a band shape, for example, along the columnar shape of the power supply BT. The measurement circuit 100 can be formed by, for example, an integrated circuit.

The overvoltage protection circuit 110 receives a voltage $V_{BUS}$ supplied from a USB connector USBC serving as a power feeder connector and outputs a voltage $V_{USB}$ to a $V_{USB}$ line. The voltage value of the voltage $V_{USB}$ is, for example, 5.0 V. The $V_{USB}$ line is connected to the VOUT terminal and the ON terminal of the load switch 10 to be described later and the PA9 terminal of the control unit 130. The overvoltage protection circuit 110 can function as a protection circuit which, even if the voltage $V_{BUS}$ supplied from the USB connector USBC is a voltage larger than a prescribed voltage value, lowers to the voltage $V_{BUS}$ to the prescribed voltage value and supplies it to the output side of the overvoltage protection circuit 110. The prescribed voltage value may be set based on a voltage value input to the OVLo terminal. The overvoltage protection circuit 110 is formed by, for example, an integrated circuit.

The transformation circuit 120 transforms a power supply voltage VBAT supplied from the power supply BT and generates a heater voltage VBOOST used to drive the heater HT. The transformation circuit 120 can be a step-up circuit, a step-up/down circuit, or a step-down circuit. The heater HT is arranged to heat the aerosol source. The positive-side terminal of the heater HT can electrically be connected to a first heater connector HC+, and the negative-side terminal of the heater HT can electrically be connected to a second heater connector HC−. The heater HT may be attached to the power supply unit PSU or the aerosol generation device AGD in a form in which the heater can be detached only when destroyed (for example, soldering) or in a form in which the heater can be detached without destruction. Note that in this specification, electrical connection using "connector" will be described as any of a form in which elements can be separated from each other only when destroyed and a form in which elements can be separated from each other without destruction, unless otherwise specified. The transformation circuit 120 can be formed by, for example, an integrated circuit.

When causing the heater HT to generate heat, the control unit 130 turns off the switch SM and turns on the switch SH and the switch SS, and the heater voltage VBOOST can be supplied to the heater HT via the switch SH. When measuring the temperature or resistance of the heater HT, the control unit 130 turns off the switch SH and turns on the switch SM and the switch SS, and the heater voltage VBOOST can be supplied to the heater HT via the switch SM. When measuring the temperature or resistance value of the heater HT, the OP amplifier A1 supplies an output according to the voltage between the positive-side terminal and the negative-side terminal of the heater HT, in other words, the voltage between the first heater connector HC+ and the second heater connector HC− to the PA7 terminal of the control unit 130. The OP amplifier A1 may be understood as a temperature measurement circuit that measures the resistance value or temperature of the heater HT. A shunt resistor RS can be arranged in a path that electrically connects the switch SM and the first heater connector HC+. The resistance value of the shunt resistor RS can be decided such that a switch SR is ON in a period in which the heater HT is heated, and the switch SR is OFF in a period in which the temperature or resistance value of the heater HT is measured.

If the switch SR is formed by an n-channel MOSFET, the drain terminal of the switch SR is connected to the output terminal of the operational amplifier A1, the gate terminal of the switch SR is connected between the shunt resistor RS and the first heater connector HC+, and the source terminal of the switch SR is connected to a ground line. A value obtained by dividing the heater voltage VBOosT mainly by the shunt resistor RS and the heater HT is input to the gate terminal of the switch SR. The resistance value of the shunt resistor RS can be decided such that the value obtained by the voltage division is equal to or larger than the threshold voltage of the switch SR. In addition, a current flowing to the heater HT when the switch SH is turned off by the shunt resistor RS, and the switch SM and the switch SS are turned on is smaller than a current flowing to the heater HT when the switch SH and the switch SS are turned on, and the switch SM is turned off. Hence, when measuring the temperature or resistance of the heater HT, the temperature of the heater HT is hardly changed by the current flowing to the heater HT.

The load switch 10 electrically disconnects the VIN terminal from the VOUT terminal when low level is input to the ON terminal. When high level is input to the ON terminal, the load switch 10 electrically connects the VIN terminal and the VOUT terminal and outputs a voltage $V_{CC5}$ from the VOUT terminal to a $V_{CC5}$ line. The voltage value of the voltage $V_{CC5}$ is, for example, 5.0 V. The ON terminal of the load switch 10 is electrically connected to the ground line via a switch SI. The switch SI is formed by a transistor. The switch SI is turned on when high level is supplied to its base or gate, and turned off when low level is supplied. If the voltage V BUS is supplied via the USB connector USBC and the V USB line, the control unit 130 detects it based on the voltage input to the PA9 terminal and supplies low level to the base or the gate of the transistor that forms the switch SI. If the switch SI is turned off, a value obtained by dividing the voltage $V_{USB}$ is supplied to the ON terminal of the load switch 10. Thus, high level is supplied to the ON terminal of the load switch 10. In other words, the two resistors connected to the ON terminal of the load switch 10 have such electrical resistance values that a value obtained by dividing the voltage $V_{USB}$ is at high level for the ON terminal f the load switch 10. On the other hand, in a period in which the voltage $V_{BUS}$ is not supplied via the USB connector USBC, the control unit 130 supplies high level to the base or the gate of the transistor that forms the switch SI based on the voltage input to the PA9 terminal. If the switch SI is turned on, the ON terminal of the load switch 10 is connected to the ground line. Thus, low level if supplied to the ON terminal of the load switch 10. The $V_{CC5}$ line is electrically connected to the VAC terminal and the VBUS terminal of the charge circuit 20 and the notification unit NU. The switch SI may be formed by a transistor that is turned on when low level is supplied to its base or gate, and turned off when high level is supplied. In this case, if the voltage $V_{BUS}$ is supplied via the USB connector USBC and the $V_{USB}$ line, the control unit 130 supplies high level to the base or the gate of the transistor that forms the switch SI. In a period in which the voltage $V_{BUS}$ is not supplied via the USB connector USBC, the control unit 130 supplies low level to the base or the gate of the transistor that forms the switch SI. The load switch 10 can be formed by, for example, an integrated circuit.

The charge circuit 20 has a charge mode. In the charge mode, the charge circuit 20 can supply a voltage $V_{CC}$ from the SW terminal to the $V_{CC}$ line using the voltage $V_{CC5}$ supplied via the $V_{CC5}$ line, and electrically connect the SYS terminal and the BAT terminal and supply a charge voltage from the BAT terminal to the power supply BT via the first conductive path PT1. The $V_{CC}$ line is connected to the VIN terminal and the EN terminal of the transformation circuit 30 to be described later. The charge mode can be enabled or activated by supplying low level to the /CE terminal. The charge circuit 20 can be formed by, for example, an integrated circuit.

The charge circuit 20 can have a first power-pass mode. In the first power-pass mode, the charge circuit 20 electrically connects the $V_{BUS}$ terminal and the SW terminal and supplies the voltage $V_{CC}$ to the $V_{CC}$ line using the voltage $V_{CC5}$ supplied via the $V_{CC5}$ line, but electrically disconnects the SYS terminal from the BAT terminal. The first power-pass mode is used mainly in the overdischarge or deep discharge state of the power supply BT. Also, the charge circuit 20 can have a second power-pass mode. In the second power-pass mode, the charge circuit 20 electrically connects the SYS terminal and the BAT terminal, and also performs pulse width control of a switching element that electrically connects the $V_{BUS}$ terminal and the SW terminal to combine the power supply voltage VBAT supplied from the power supply BT and the voltage $V_{CC5}$ supplied via the $V_{CC5}$ line and supply the voltage $V_{CC}$ to the $V_{CC}$ line. The second power-pass mode is used when the voltage $V_{BUS}$ is supplied via the USB connector USBC and the $V_{USB}$ line, and the charge of the power supply BT is completed. Also, the charge circuit 20 can have a third power-pass mode. In the third power-pass mode, the charge circuit 20 electrically disconnects the $V_{BUS}$ terminal from the SW terminal, electrically connects the SYS terminal and the BAT terminal, and supplies the power supply voltage supplied from the power supply BT as the voltage $V_{CC}$ to the $V_{CC}$ line. The third power-pass mode is used when the voltage $V_{BUS}$ is not supplied via the USB connector USBC.

The charge circuit 20 can have an OTG mode. In the OTG mode, the charge circuit 20 receives the power supply voltage VBAT supplied from the power supply BT to the BAT terminal via the first conductive path PT1 and supplies the voltage $V_{CC}$ from the SYS terminal to the $V_{CC}$ line, and also supplies the voltage $V_{CC5}$ from the $V_{BUS}$ terminal to the $V_{CC5}$ line. In this case, the charge circuit 20 can receive the power supply voltage VBAT, generate a voltage higher than the power supply voltage V BAT as the voltage $V_{CC5}$, and supply it from the $V_{BUS}$ terminal to the $V_{CC5}$ line. If high level is supplied to the /CE terminal, the charge circuit 20 can operate in an operation mode set by default in the first, second, and third power-pass modes and the OTG mode, or in an operation mode set by the control unit 130. The control unit 130 can set the charge circuit 20 in an operation mode of the first, second, and third power-pass modes and the OTG mode by $I^2C$ communication. Note that in this specification, $I^2C$ communication will be described as an example of a communication standard. This is not intended to limit the communication standard or communication method, and $I^2C$ communication and an $I^2C$ interface to be described below can be replaced with communication and interface of another communication method.

The transformation circuit 30 is enabled by supplying the voltage $V_{CC}$ to the $V_{CC}$ line connected to the EN terminal that is an enable terminal, and supplies a voltage $V_{CC33_0}$ from the VOUT terminal to a $V_{CC33_0}$ line. The voltage value of the voltage $V_{CC33_0}$ is, for example, 3.3 V. The $V_{CC33_0}$ line is connected to the VIN terminal of the load switch 40 to be described later, the VIN terminal and the RSTB terminal of the power switch driver 50 to be described later, and the $V_{CC}$ terminal and the D terminal of the information holding circuit FF2 to be described later. The transformation circuit 30 can be a step-up circuit, a step-up/down circuit, or a step-down circuit. The transformation circuit 30 can be formed by, for example, an integrated circuit. The load switch 40 electrically disconnects the VIN terminal from the VOUT terminal when low level is input to the ON terminal. When high level is input to the ON terminal, the load switch 40 electrically connects the VIN terminal and the VOUT terminal and outputs a voltage $V_{CC33}$ from the VOUT terminal to a $V_{CC33}$ line. The voltage value of the voltage $V_{CC33}$ is, for example, 3.3 V. The $V_{CC33}$ line is connected to the VIN terminal of the load switch 60, the VCC terminal of the nonvolatile memory 70, the VDD terminal and the CE terminal of the measurement circuit 100, the VDD terminal of the control unit 130, the VDD terminal of the detection unit 140, the VCC terminal of the Schmitt trigger circuit 150, the VCC_NRF terminal of the communication device 160, the VDD terminal of the detection unit 170, the $V_{CC}$ terminal and the D terminal of the information holding circuit FF1, the power supply terminal of the OP amplifier A1, and the power supply terminal of the OP amplifier A2. The VIN terminal of the load switch 40 is electrically connected to the VOUT terminal of the transformation circuit 30, and the voltage $V_{CC33_0}$ is supplied from the transformation circuit 30. The ON terminal of the load switch 40 is also electrically connected to the VOUT terminal of the transformation circuit 30 via a resistor, and the voltage $V_{CC33_0}$ is supplied from the transformation circuit 30. That is, if the voltage $V_{CC33_0}$ is supplied from the transformation circuit 40, the load switch 40 can output the voltage $V_{CC33}$ from the VOUT terminal to the $V_{CC33}$ line. The load switch 50 can be formed by, for example, an integrated circuit.

The power switch driver 50 outputs low level from the RSTB terminal when low level is supplied to the SW1 terminal and the SW2 terminal for a predetermined time. The RSTB terminal is electrically connected to the ON terminal of the load switch 40. Hence, when low level is supplied to the SW1 terminal and the SW2 terminal of the power switch driver 50 for a predetermined time, the load switch 40 stops outputting the voltage $V_{CC33}$ from the VOUT terminal. If the output of the voltage $V_{CC33}$ from the VOUT terminal of the load switch 40 stops, supply of the voltage $V_{CC33}$ to the VDD terminal (power supply terminal) of the control unit 130 is shut off, and therefore, the control unit 130 stops the operation. The power switch driver 50 can be formed by, for example, an integrated circuit.

Here, if the outer panel C103 is detached from the aerosol generation device AGD or the power supply unit PSU, low level is supplied from the detection unit 140 to the SW2 terminal of the power switch driver 50 via the Schmitt trigger circuit 150. When the switch SW is pressed, low level is supplied to the SW1 terminal of the power switch driver 50. Hence, if the switch SW is pressed in a state in which the outer panel C103 is detached from the aerosol generation device AGD or the power supply unit PSU (the state shown in FIG. 2A), low level is supplied to the SW1 terminal and the SW2 terminal of the power switch driver 50. If low level is supplied to the SW1 terminal and the SW2 terminal continuously for a predetermined time (for example, several sec), the power switch driver 50 recognizes that a reset or reactivation instruction is input to the aerosol generation device AGD or the power supply unit PSU. The power switch driver 50 can be configured to, after low level is output from the RSTB terminal, stop the output of low level from the RSTB terminal. With this configuration, since the voltage $V_{CC33_0}$ is supplied to the ON terminal of the load switch 40 again after the supply of low level, the load switch 40 can output the voltage $V_{CC33}$ from the VOUT terminal to the $V_{CC33}$ line again. Since the voltage $V_{CC33}$ is input to the VDD terminal of the control unit 130, the control unit 130 can be reactivated. In other words, when the power switch driver 50 stops the output of low level from the RSTB terminal after low level is output from the RSTB terminal, the aerosol generation device AGD or the power supply unit PSU is reset or reactivated.

The load switch 60 electrically disconnects the VIN terminal from the VOUT terminal when low level is input to the ON terminal. When high level is input to the ON terminal, the load switch 60 electrically connects the VIN terminal and the VOUT terminal and outputs a voltage $V_{CC33_SLP}$ from the VOUT terminal to a $V_{CC33_SLP}$ line. The voltage value of the voltage $V_{CC33_SLP}$ is, for example, 3.3 V. The $V_{CC33_SLP}$ line is connected to the thermistor TP to be described later, the thermistor TH to be described later, and the thermistor TC to be described later. The ON terminal of the load switch 60 is electrically connected to the PC11 terminal of the control unit 130. The control unit 130 changes the logic level of the PC11 terminal from high level to low level when shifting to a sleep mode, and changes the logic level of the PC11 terminal from low level to high level when shifting from the sleep state to an active state. That is, the voltage $V_{CC33_SLP}$ cannot be used in the sleep state, and can be used when shifting from the sleep state to the active state. The load switch 60 can be formed by, for example, an integrated circuit.

The switch circuit 80 is a switch controlled by the control unit 130. In an ON state, a potential according to the potential of the first conductive path PT1, that is, the potential of the positive electrode of the power supply BT is supplied to the PC2 terminal of the control unit 130 via the switch circuit 80. The potential according to the potential of the positive electrode of the power supply BT is a potential obtained by, for example, dividing the potential of the positive electrode. The control unit 130 includes an A/D converter or a voltage detector electrically connected to the PC2 terminal. The control unit 130 can detect the potential of the positive electrode of the power supply BT, that is, the output voltage of the power supply BT by turning on the switch circuit 80.

The power supply unit PCU can include the thermistor (for example, an NTC thermistor or a PTC thermistor) TP that forms a puff sensor configured to detect a puff operation. The thermistor TP can be arranged to detect, for example, a temperature change in an air channel caused by puff. The power supply unit PSU may include a vibrator M. The vibrator M can be activated by turning on, for example, a switch SN. The switch SN can be formed by a transistor, and a control signal can be supplied from the PHO terminal of the control unit 130 to the base or the gate of the transistor. Note that in place of the switch SN, a driver for the vibrator M may be used.

The power supply unit PSU can include the thermistor (for example, an NTC thermistor or a PTC thermistor) TH configured to detect the temperature of the heater HT. The temperature of the heater HT may be detected indirectly by detecting the temperature near the heater HT. The OP amplifier A2 can output a voltage according to the resistance value of the thermistor TH, in other words, a voltage according to the temperature of the heater HT.

The power supply unit PSU can include the thermistor (for example, an NTC thermistor or a PTC thermistor) TC configured to detect the temperature of the outer case C101. The temperature of the outer case C101 may be detected indirectly by detecting the temperature near the outer case C101. The OP amplifier A3 outputs a voltage according to the resistance value of the thermistor TC, in other words, a voltage according to the temperature of the outer case C101.

The information holding circuit FF1 can be configured to, if a voltage according to the output of the OP amplifier A2 deviates from a prescribed range, typically, if a temperature indicated by the output of the OP amplifier A2 exceeds the tolerance limit temperature of the heater HT, hold information representing this. The information holding circuit FF1 can operate upon receiving the supply of the voltage $V_{CC33}$ output from the load switch 40 to the $V_{CC33}$ line. In other words, the $V_{CC}$ terminal (power supply terminal) of the information holding circuit FF1 is connected to the $V_{CC33}$ line. If the output of the voltage $V_{CC33}$ from the load switch 40 is stopped, the control unit 130 stops the operation, and the information held in the information holding circuit FF1 may be lost. The information holding circuit FF1 can be formed by, for example, an integrated circuit.

The information holding circuit FF1 can also be configured to, if a voltage according to the output of the OP amplifier A3 deviates from a prescribed range, typically, if a temperature indicated by the output of the OP amplifier A3 exceeds the tolerance limit temperature of the outer case C101, hold information representing this. As is apparent from the above description, the information holding circuit FF1 can be configured to, if one of a condition that a temperature indicated by the output of the OP amplifier A2 exceeds the tolerance limit temperature of the heater HT and a condition that a temperature indicated by the output of the OP amplifier A3 exceeds the tolerance limit temperature of the outer case C101 is satisfied, hold information representing this.

The information holding circuit FF2 can be configured to, if a voltage according to the output of the OP amplifier A2 deviates from a prescribed range, typically, if a temperature indicated by the output of the OP amplifier A2 exceeds the tolerance limit temperature of the heater HT, hold information representing this. The information holding circuit FF2 can operate upon receiving the supply of the voltage $V_{CC33_0}$ output from the transformation circuit 30 to the $V_{CC33_0}$ line. In other words, the $V_{CC}$ terminal (power supply terminal) of the information holding circuit FF2 is connected to the $V_{CC33_0}$ line. If the output of the voltage $V_{CC33_0}$ from the transformation circuit 30 is stopped, the information held in the information holding circuit FF2 may be lost. However, even if low level is input to the SW1 terminal and the SW2 terminal, low level is thus output from the RSTB terminal of the power switch driver 50, and the output of the voltage $V_{CC33}$ from the load switch 40 is stopped, the output of the voltage $V_{CC33_0}$ from the transformation circuit 30 is not stopped, and the information held in the information holding circuit FF2 can be maintained. The information holding circuit FF2 may be formed by an EEPROM. In this case, one EEPROM may provide the functions of the information holding circuit FF2 and the nonvolatile memory 70. The information holding circuit FF2 can be formed by, for example, an integrated circuit.

The control unit 130 is formed by a processor such as an MCU, operates based on a program stored in the nonvolatile memory 70 or an internal memory, and can control or define the operation of the aerosol generation device AGD or the power supply unit PSU. The control unit 130 controls supply of power to the heater HT configured to heat the aerosol source using power supplied from the power supply BT. In another viewpoint, the control unit 130 controls heat generation of the heater HT configured to heat the aerosol source using power supplied from the power supply BT. In still another viewpoint, the control unit 130 controls supply of power to the heater HT and the charge operation of the power supply BT.

The detection unit 140 can be configured to detect that the outer panel C103 is detached from the aerosol generation device AGD or the power supply unit PSU. The detection unit 140 can be formed by, for example, an integrated circuit. The output of the detection unit 140 can be supplied to the SW2 terminal of the power switch driver 50 and the PD2 terminal of the control unit 130 via the Schmitt trigger circuit 150. The Schmitt trigger circuit 150 can be formed by, for example, an integrated circuit. One terminal of the switch SW can be connected to the SW1 terminal of the power switch driver 50 and the PC10 terminal of the control unit 130. One terminal of the switch SW is connected to the $V_{CC33}$ line as well, and the other terminal of the switch SW is connected to the ground line. Thus, if the switch SW is pressed, low level can be supplied to the SW1 terminal of the power switch driver 50 and the PC10 terminal of the control unit 130. If the switch SW is not pressed, high level can be supplied to the SW1 terminal of the power switch driver 50 and the PC10 terminal of the control unit 130. The detection unit 170 can be configured to detect opening/closing of the slider C102. The output of the detection unit 170 can be supplied to the PC13 terminal of the control unit 130. The detection unit 170 can be formed by, for example, an integrated circuit. The detection units 140 and 170 can each be formed by, for example, a Hall element. The communication device 160 provides, to the control unit 130, a function of communicating with an electronic device such as a smartphone, a portable telephone, or a personal computer. The communication device 160 is, for example, a communication device complying with a short range communication standard such as Bluetooth®. The communication device 160 can be formed by, for example, an integrated circuit.

Figure 5:
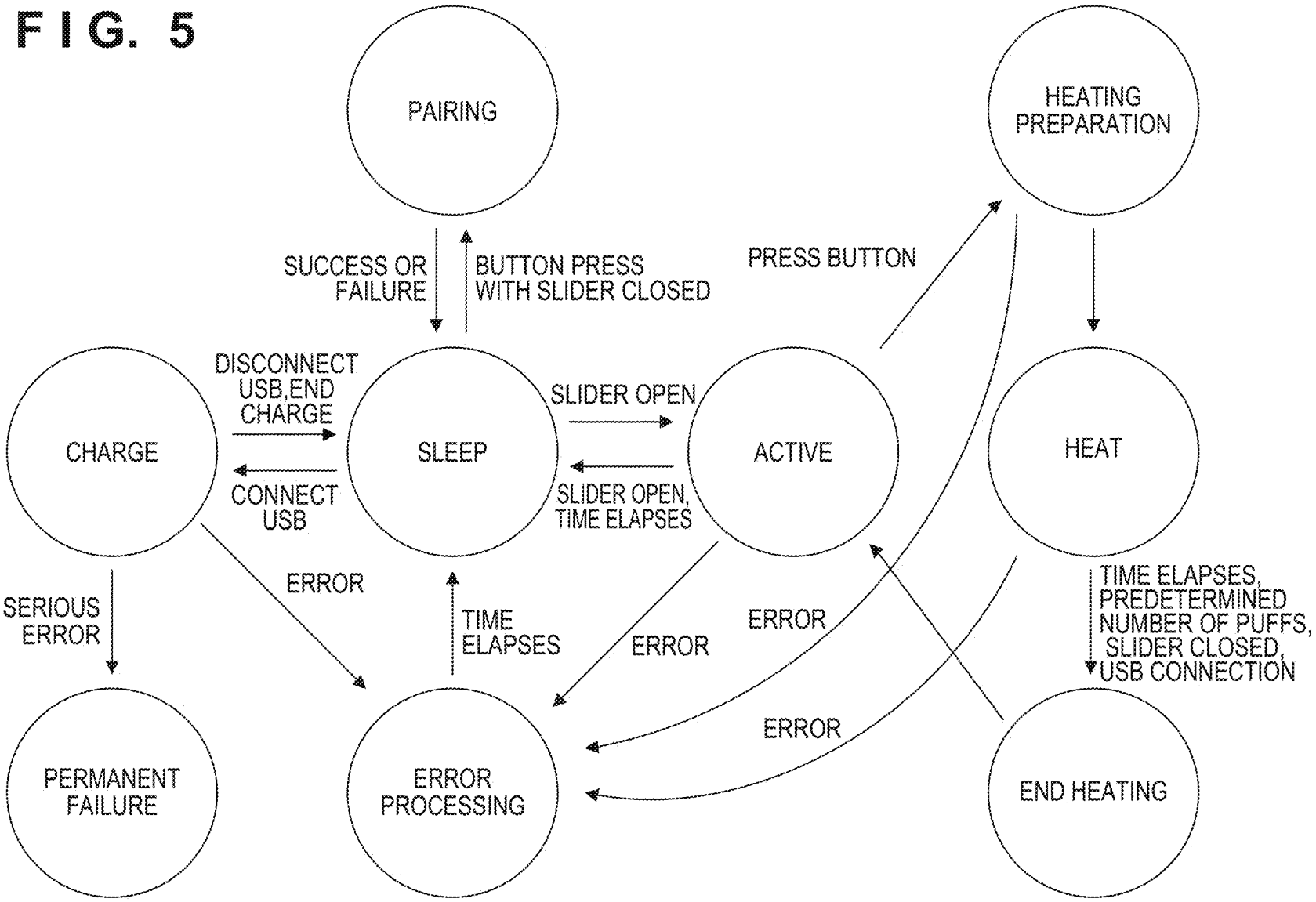
FIG. 5 is a state transition diagram of the aerosol generation device or the power supply unit.
Figure 6:
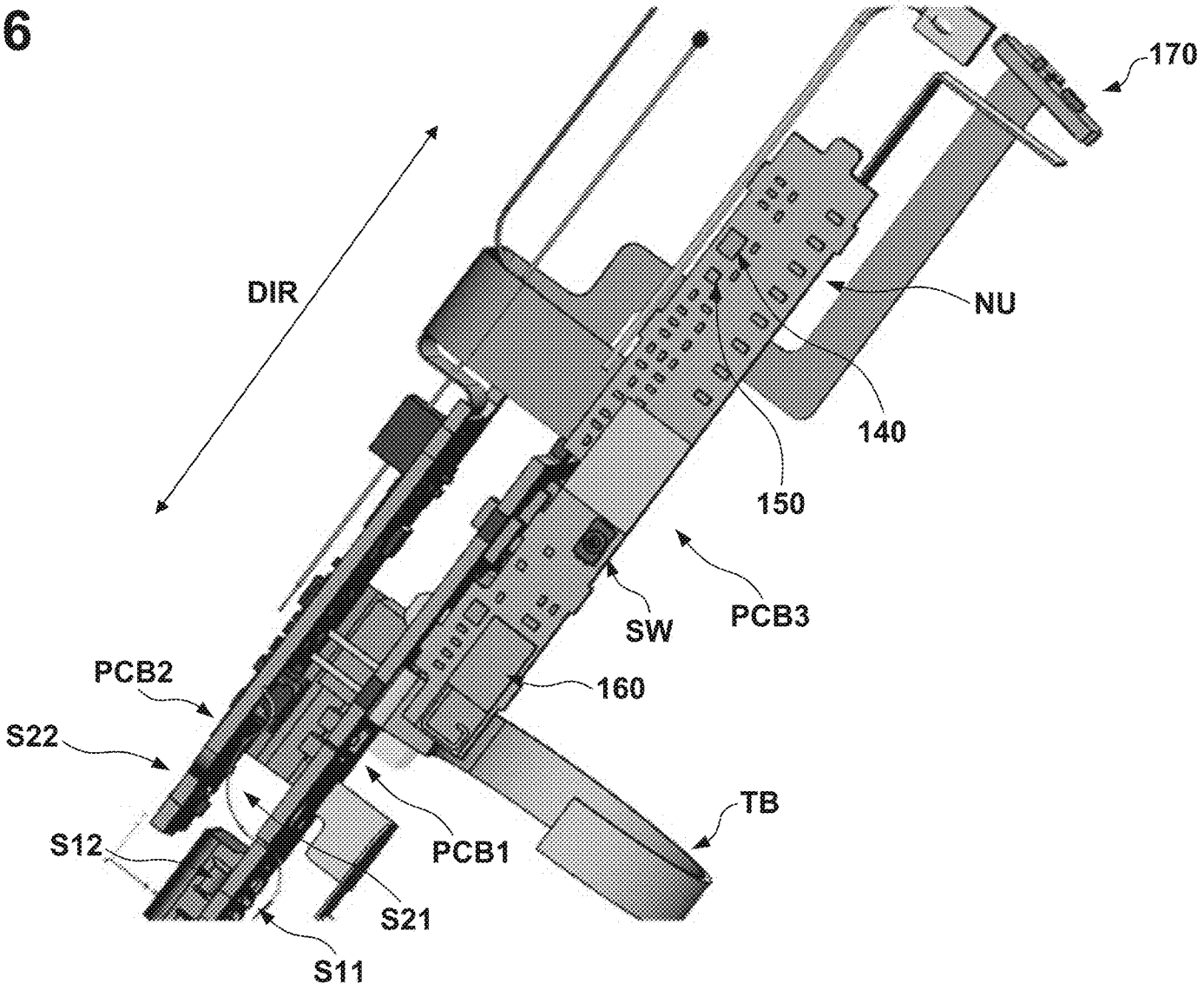
FIG. 6 is a view exemplifying the configuration of the aerosol generation device.

FIG. 5 shows a state transition diagram of the aerosol generation device AGD or the power supply unit PSU. In the sleep mode, the voltage $V_{CC33}$ is supplied from the VOUT terminal of the load switch 40 to the VDD terminal (power supply terminal) of the control unit 130 via the $V_{CC33}$ line. In the sleep mode, the slider C102 is set in the open state. If this is detected by the detection unit 170, the aerosol generation device AGD, the power supply unit PSU, or the control unit 130 can shift to the active mode. In the active mode, the voltage $V_{CC33_SLP}$ can be supplied from the VOUT terminal of the load switch 60 to the thermistors TP, TH, and TC. In the sleep mode, the control unit 130 can stop acquisition of information from the measurement circuit 100 via the FC interface to be described later.

In the active mode, if the switch SW (in an example, a button switch) is pressed, the aerosol generation device AGD, the power supply unit PSU, or the control unit 130 can shift to a heating preparation mode. In the heating preparation mode, the control unit 130 can output high level from the PC12 terminal, the transformation circuit 120 can be activated, and the transformation circuit 120 can output the voltage VBOOST from the VOUT terminal. Since the switch SS is also connected to the PC12 terminal of the control unit 130, if high level is output from the PC12 terminal, the switch SS is turned on, and the heater connector HC− and the ground line can be connected.

After the transformation circuit 120 is activated, the aerosol generation device AGD, the power supply unit PSU, or the control unit 130 can shift from the heating preparation mode to the heating mode. In the heating mode, a heating operation of heating the aerosol source by the heater HT and a measurement operation of measuring the resistance value of the heater HT, that is, the temperature of the heater HT can be repeated.

The heating mode ends in accordance with, for example, occurrence of a predetermined event such as the elapse of a predetermined time from a time count start timing, occurrence of a predetermined number of times of puff from a count start timing, the closing operation of the slider C102, or connection of a USB cable to the USB connector USBC, and the aerosol generation device AGD, the power supply unit PSU, or the control unit 130 shifts to a heating end mode. The time count start timing can be the timing of, for example, detection of pressing of the switch SW in the active mode, shift to the heating preparation mode, or shift to the heating mode. The count start timing can be the timing of, for example, shift from the heating preparation mode to the heating mode. In the heating end mode, heating of the aerosol source by the heater HT is ended, and after that, the aerosol generation device AGD, the power supply unit PSU, or the control unit 130 can shift to the active mode. If heating of the aerosol source is ended by connection of a USB cable to the USB connector USBC, the aerosol generation device AGD, the power supply unit PSU, or the control unit 130 can directly shift from the heating end mode to a charge mode.

In the active mode, if the slider C102 is set in a closed state, or the slider C102 and the switch SW are not operated for a predetermined time, the aerosol generation device AGD, the power supply unit PSU, or the control unit 130 can shift to the sleep mode. In the sleep mode, if the switch SW is pressed in the closed state of the slider C102, the aerosol generation device AGD, the power supply unit PSU, or the control unit 130 can shift to a pairing mode. In the pairing mode, pairing (key exchange) with an electronic device by the communication device 160 is performed. If the pairing succeeds, bonding (key saving) is performed, and the aerosol generation device AGD, the power supply unit PSU, or the control unit 130 can shift to the sleep mode. Information about bonding may be stored in the nonvolatile memory 70. Even if the pairing fails, the aerosol generation device AGD, the power supply unit PSU, or the control unit 130 can shift to the sleep mode.

In the sleep mode, if a USB cable is connected to the USB connector USBC, the aerosol generation device AGD, the power supply unit PSU, or the control unit 130 can shift to the charge mode. The control unit 130 can detect the connection of the USB cable to the USB connector USBC in accordance with a voltage or a potential supplied to the PA9 terminal, and output low level from the PC9 terminal accordingly to turn off the switch SI. Thus, high level is supplied to the ON terminal of the load switch 10, and the load switch 10 can supply the voltage $V_{USB}$ supplied to the $V_{USB}$ line via the USB cable to the charge circuit 20 via the VOUT terminal. Also, the control unit 130 outputs low level from the PB3 terminal. Thus, low level (enable level) is supplied to the /CE terminal of the charge circuit 20, and the charge circuit 20 can supply the charge voltage from the BAT terminal to the power supply BT.

In the charge mode, if a serious error occurs, the aerosol generation device AGD, the power supply unit PSU, or the control unit 130 can shift to a permanent failure mode. The aerosol generation device AGD, the power supply unit PSU, or the control unit 130 may shift from a mode other than the charge mode to the permanent failure mode. In the permanent failure mode, change to all other modes can be inhibited. If an error occurs in the charge mode, the active mode, the heating preparation mode, or the heating mode, the aerosol generation device AGD, the power supply unit PSU, or the control unit 130 can shift to an error processing mode.

In the error processing mode, the aerosol generation device AGD, the power supply unit PSU, or the control unit 130 can, for example, notify, using the notification unit NU, the occurrence of the error, the type of the error, or an operation request for elimination of the error. After that, if the type of the error that has occurred indicates an error of a first category, the aerosol generation device AGD, the power supply unit PSU, or the control unit 130 can shift to the sleep mode after waiting for the elapse of a predetermined time. On the other hand, if the type of the error that has occurred indicates an error of a second category, the aerosol generation device AGD, the power supply unit PSU, or the control unit 130 can continue the error processing. In this case, to return to the sleep mode, the control unit 130 needs to be reset or reactivated.

Figure 4A:
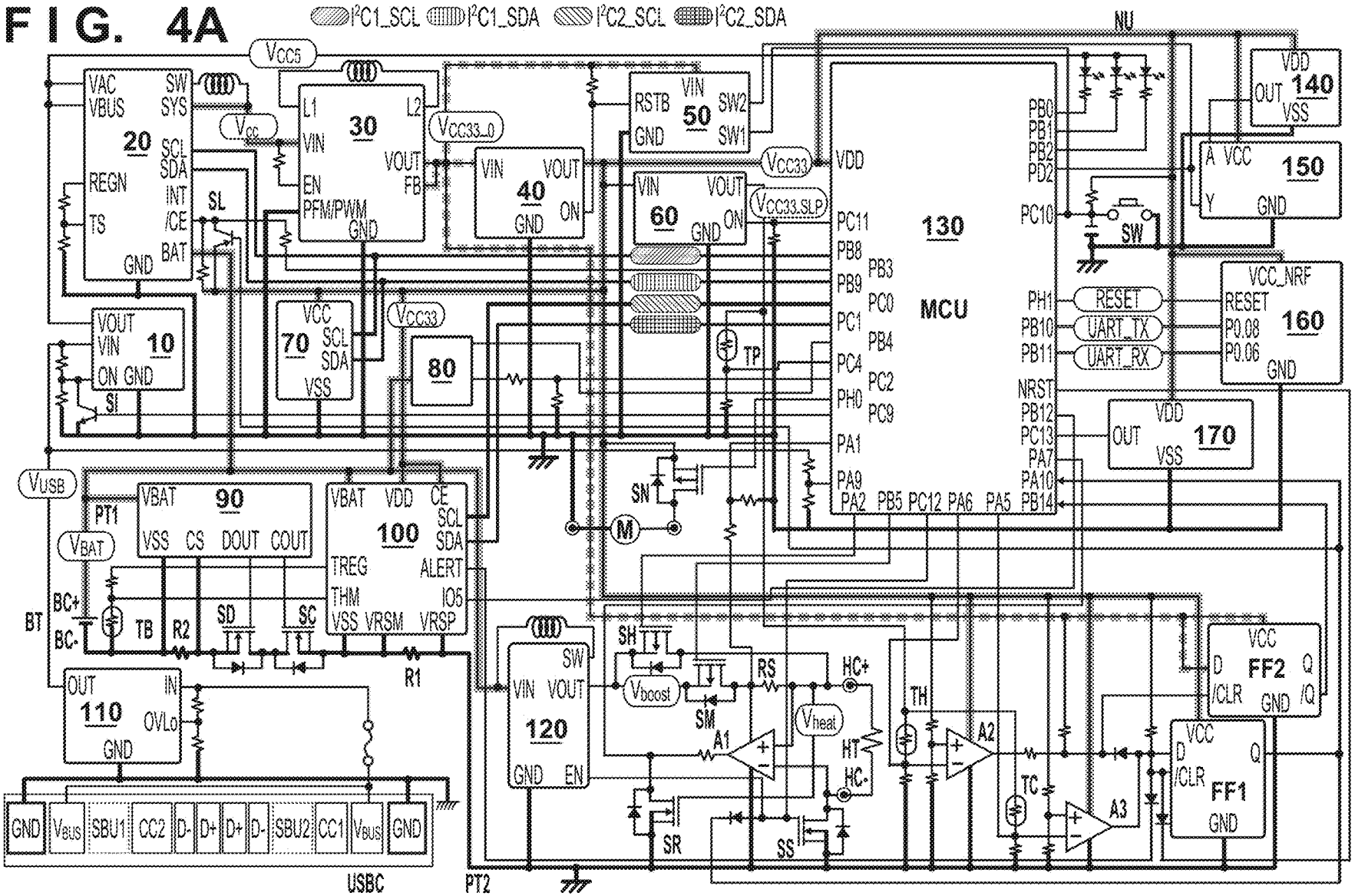
FIG. 4A is a view for explaining the operation of the power supply unit.

FIG. 4A exemplifies the operation of the power supply unit PSU in the sleep mode. Thick lines emphasize the supply paths of voltages. The power supply BT can supply the power supply voltage VBAT, via the first conductive path PT1, to the VBAT terminal of the protection circuit 90, the VBAT terminal of the measurement circuit 100, the BAT terminal of the charge circuit 20, the VIN terminal of the transformation circuit 120, and the switch circuit 80. The charge circuit 20 is set in the third power-pass mode by the control unit 130, and the charge circuit 20 can supply the power supply voltage VBAT supplied from the power supply BT as the voltage $V_{CC}$ to the $V_{CC}$ line.

The transformation circuit 30 is enabled when the voltage $V_{CC}$ is supplied to the $V_{CC}$ line, and can supply the voltage $V_{CC33_0}$ from the VOUT terminal to the $V_{CC33_0}$ line. The voltage $V_{CC33_0}$ can be supplied to the load switch 40, the power switch driver 50, and the information holding circuits FF1 and FF2 via the $V_{CC33_0}$ line.

Since the voltage $V_{CC33_0}$ is supplied from the $V_{CC33_0}$ line to the ON terminal of the load switch 40, the load switch 40 can electrically connect the VIN terminal and the VOUT terminal and output the voltage $V_{CC33}$ from the VOUT terminal to the $V_{CC33}$ line. The voltage $V_{CC33}$ can be supplied, via the $V_{CC33}$ line, to the VDD terminal (power supply terminal) of the control unit 130, the VDD terminals (power supply terminals) of the detection units 140 and 170, the VCC terminal (power supply terminal) of the Schmitt trigger circuit 150, the VCC_NRF terminal (power supply terminal) of the communication device 160, the $V_{CC}$ terminal (power supply terminal of the nonvolatile memory 70, the VDD terminal (power supply terminal) and the CE terminal of the measurement circuit 100, the power supply terminals of the OP amplifiers A2 and A3, and the VCC terminals (power supply terminals) of the information holding circuits FF1 and FF2.

If low level is input to the SW1 terminal and the SW2 terminal of the power switch driver 50 for a predetermined time, the power switch driver 50 supplies load from the RSTB terminal to the ON terminal of the load switch 40. Accordingly, the load switch 40 stops the output of the voltage $V_{CC33}$ from the VOUT terminal, and the control unit 130 stops the operation. After that, the power switch driver 50 stops the supply of low level from the RSTB terminal to the ON terminal of the load switch 40. Accordingly, since the supply of the voltage $V_{CC33_0}$ from the $V_{CC33_0}$ line to the ON terminal of the load switch 40 is resumed, the load switch 40 resumes the output of the voltage $V_{CC33}$ from the VOUT terminal, and the control unit 130 can be reset or reactivated.

Figure 4B:
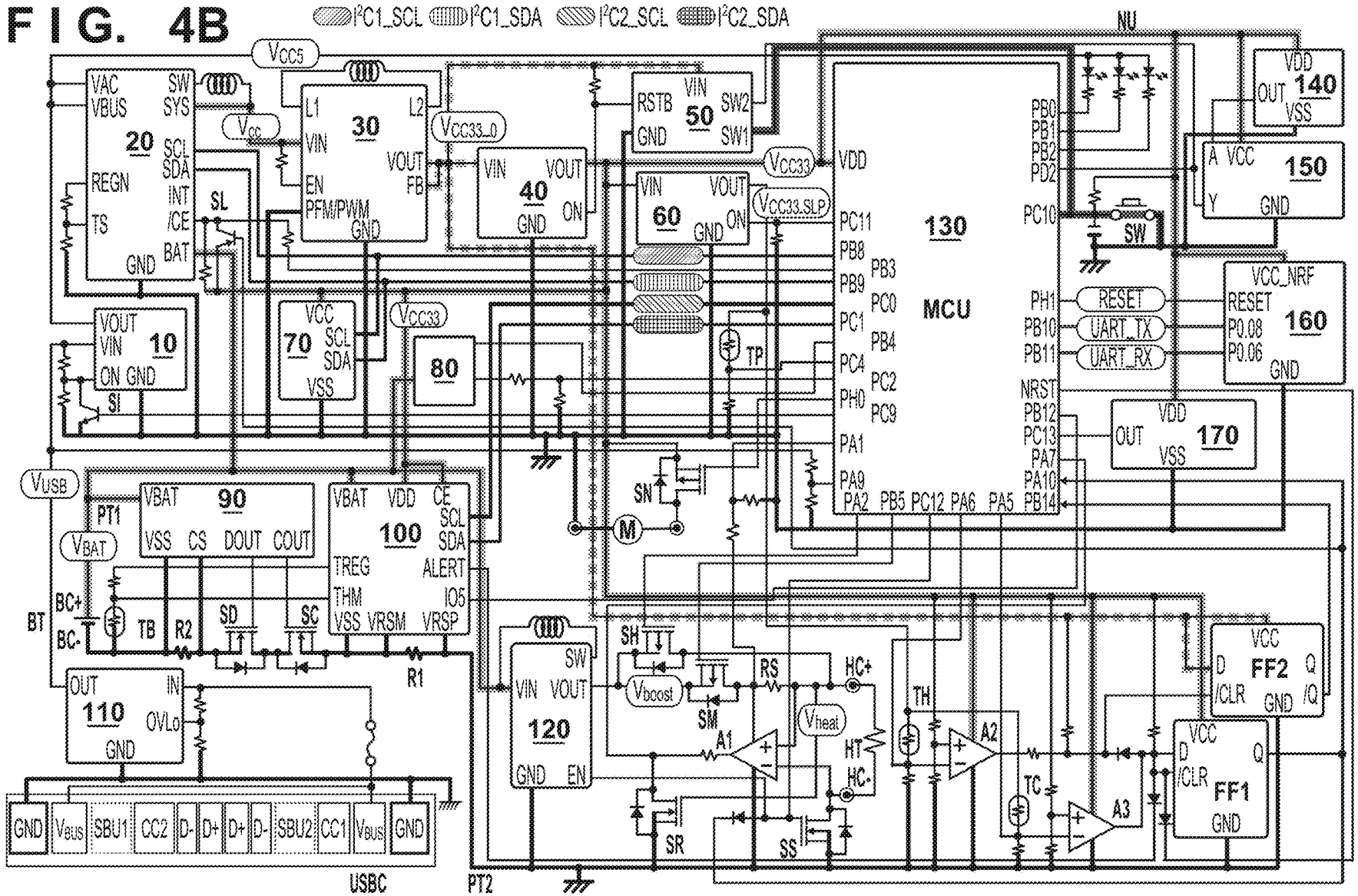
FIG. 4B is a view for explaining the operation of the power supply unit.

FIG. 4B shows the shift from the sleep mode to the pairing mode. Thick lines emphasize the supply paths of voltages and signals. In a state in which the outer panel C103 is attached to the aerosol generation device AGD or the power supply unit PSU, high level is supplied from the detection unit 140 to the PD2 terminal of the control unit 130 and the SW2 terminal of the power switch driver 50 via the Schmitt trigger circuit 150. If the slider C102 is in the closed state, high level is supplied from the detection unit 170 to the PC13 terminal of the control unit 130. If the switch SW is pressed in this state, low level is supplied to the PC10 terminal of the control unit 130. If low level is supplied to the PC10 terminal for a predetermined time in the state in which high level is supplied to the PC13 terminal, the control unit 130 can recognize this as a shift instruction to the pairing mode and shift from the sleep mode to the paring mode.

Figure 4C:
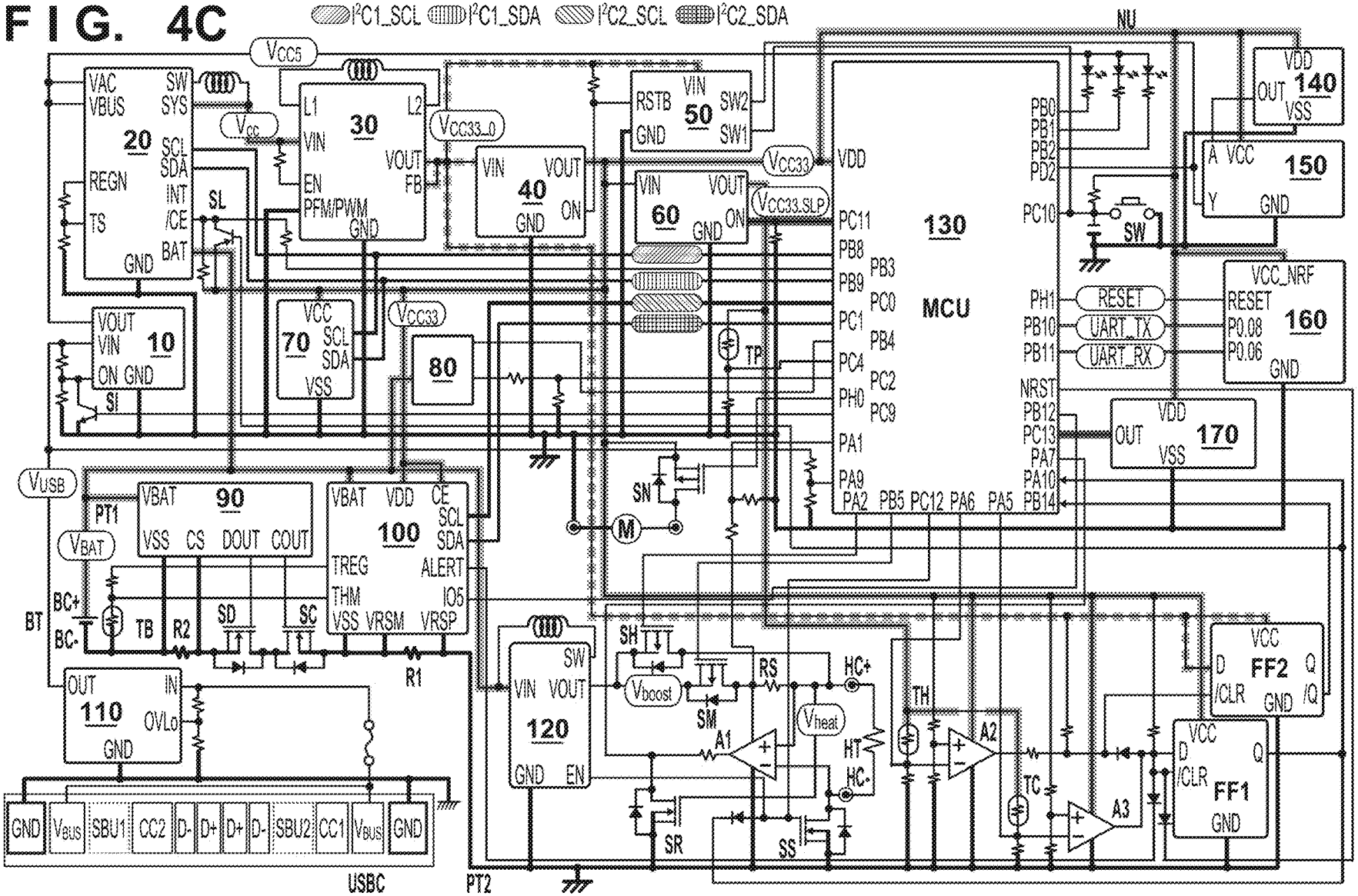
FIG. 4C is a view for explaining the operation of the power supply unit.

FIG. 4C shows the shift from the sleep mode to the active mode. Thick lines emphasize the supply paths of voltages and signals. In a state in which the outer panel C103 is attached to the aerosol generation device AGD or the power supply unit PSU, high level is supplied from the detection unit 140 to the PD2 terminal of the control unit 130 and the SW2 terminal of the power switch driver 50 via the Schmitt trigger circuit 150. If the slider C102 is set in the open state, low level is supplied from the detection unit 170 to the PC13 terminal of the control unit 130. The control unit 130 can recognize this as a shift instruction to the active mode and shift from the sleep mode to the active mode. More specifically, the control unit 130 supplies high level from the PC11 terminal to the ON terminal of the load switch 60, and accordingly, the load switch 60 can electrically connect the VIN terminal and the VOUT terminal and supply the voltage $V_{CC33_SLP}$ to the thermistors TP, TH, and TC.

Figure 4D:
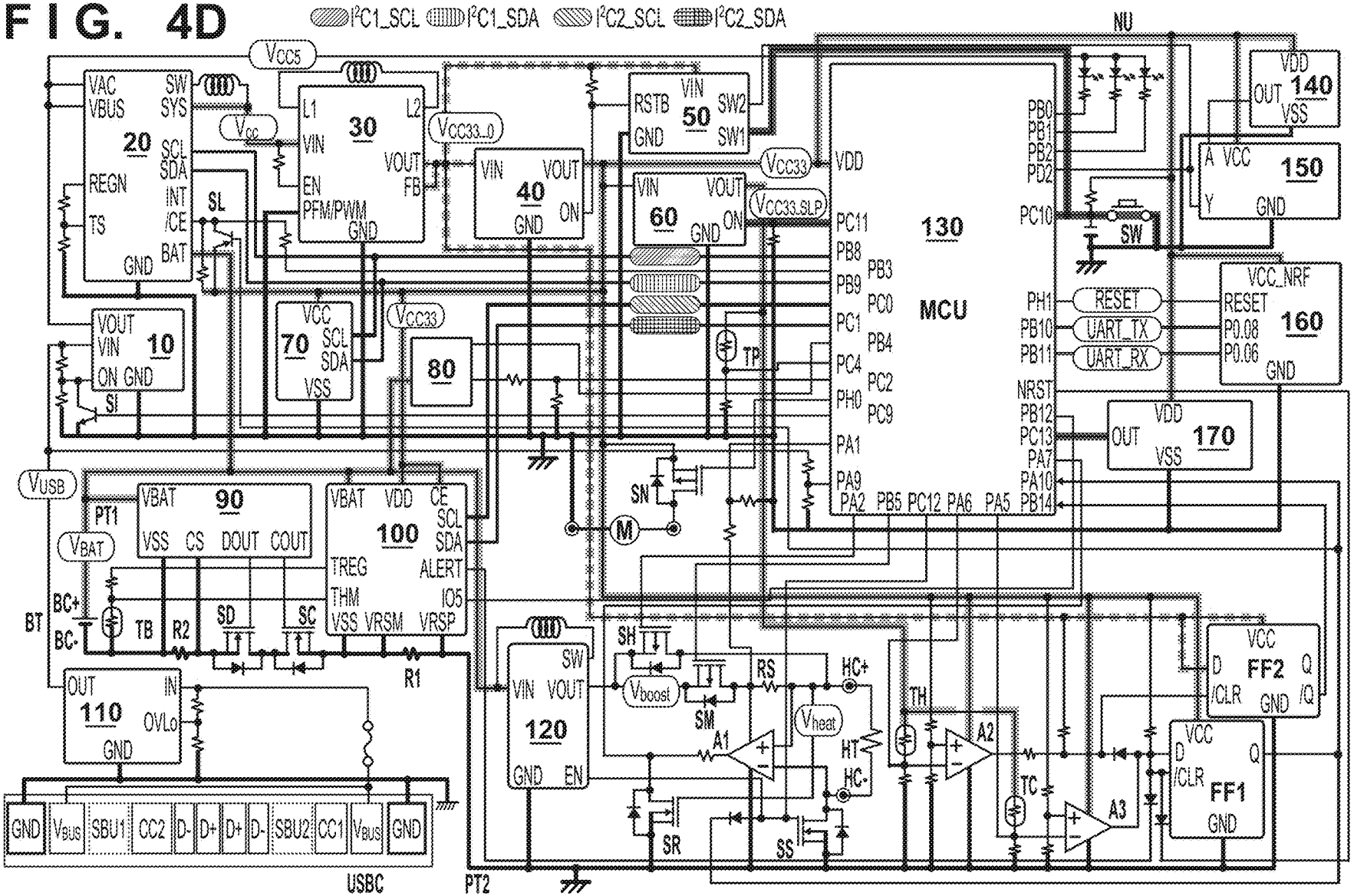
FIG. 4D is a view for explaining the operation of the power supply unit.
Figure 4E:
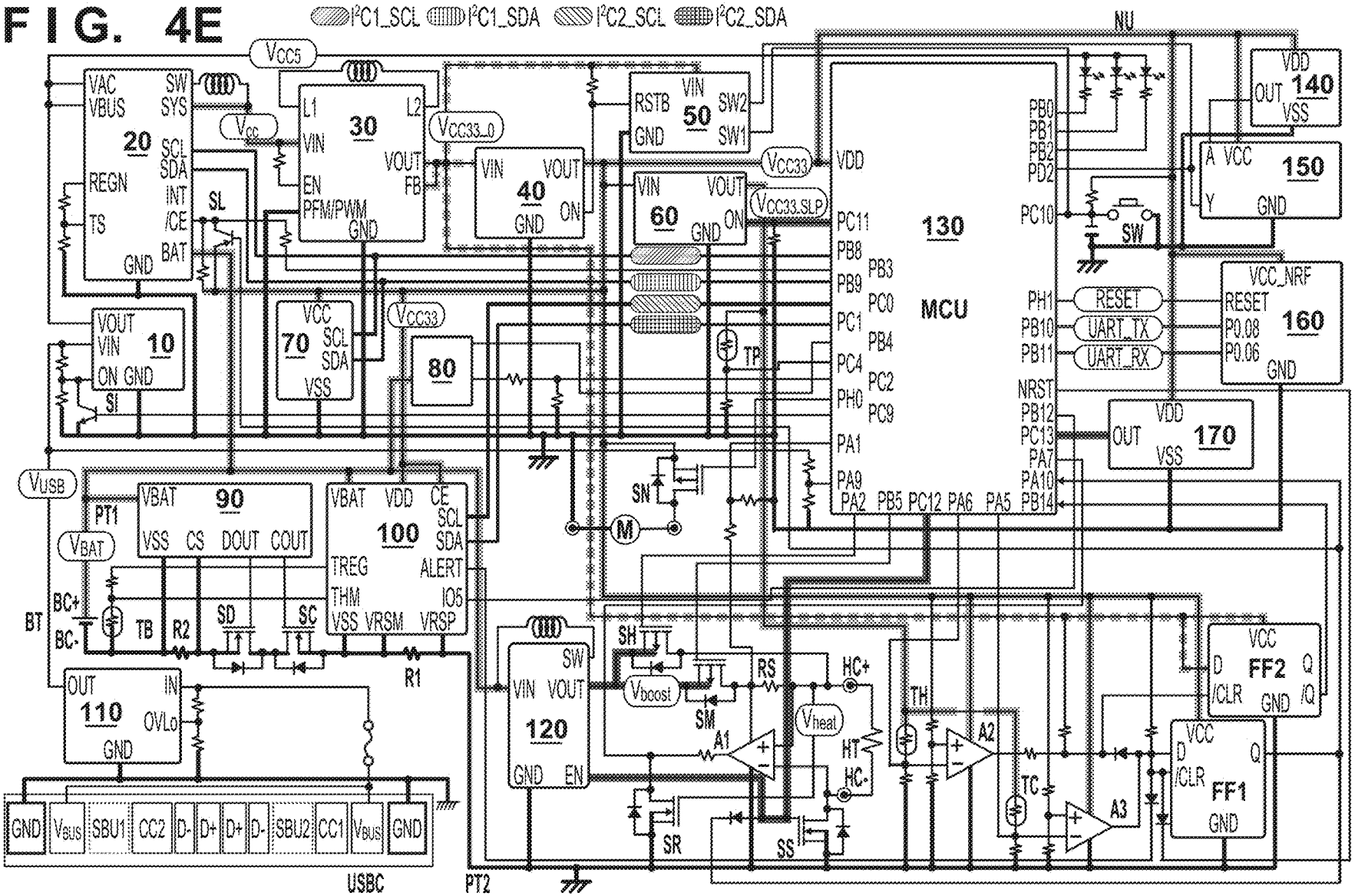
FIG. 4E is a view for explaining the operation of the power supply unit.

FIGS. 4D and 4E show the shift from the active mode to the heating preparation mode. Thick lines emphasize the supply paths of voltages and signals. In a state in which the outer panel C103 is attached to the aerosol generation device AGD or the power supply unit PSU, high level is supplied from the detection unit 140 to the PD2 terminal of the control unit 130 and the SW2 terminal of the power switch driver 50 via the Schmitt trigger circuit 150. If the slider C102 is in the open state, low level is supplied from the detection unit 170 to the PC13 terminal of the control unit 130. Furthermore, if the switch SW is pressed, low level is supplied to the PC10 terminal of the control unit 130. If low level is supplied to the PC10 terminal for a predetermined time in the state in which high level is supplied to the PD2 terminal, and low level is supplied to the PC13 terminal, the control unit 130 can recognize this as a shift instruction to the heating preparation mode and shift from the active mode to the heating preparation mode. More specifically, the control unit 130 supplies high level from the PC12 terminal to the EN terminal of the transformation circuit 120, and accordingly, the transformation circuit 120 outputs Vboost from the VOUT terminal to a Vboost line.

Figure 4F:
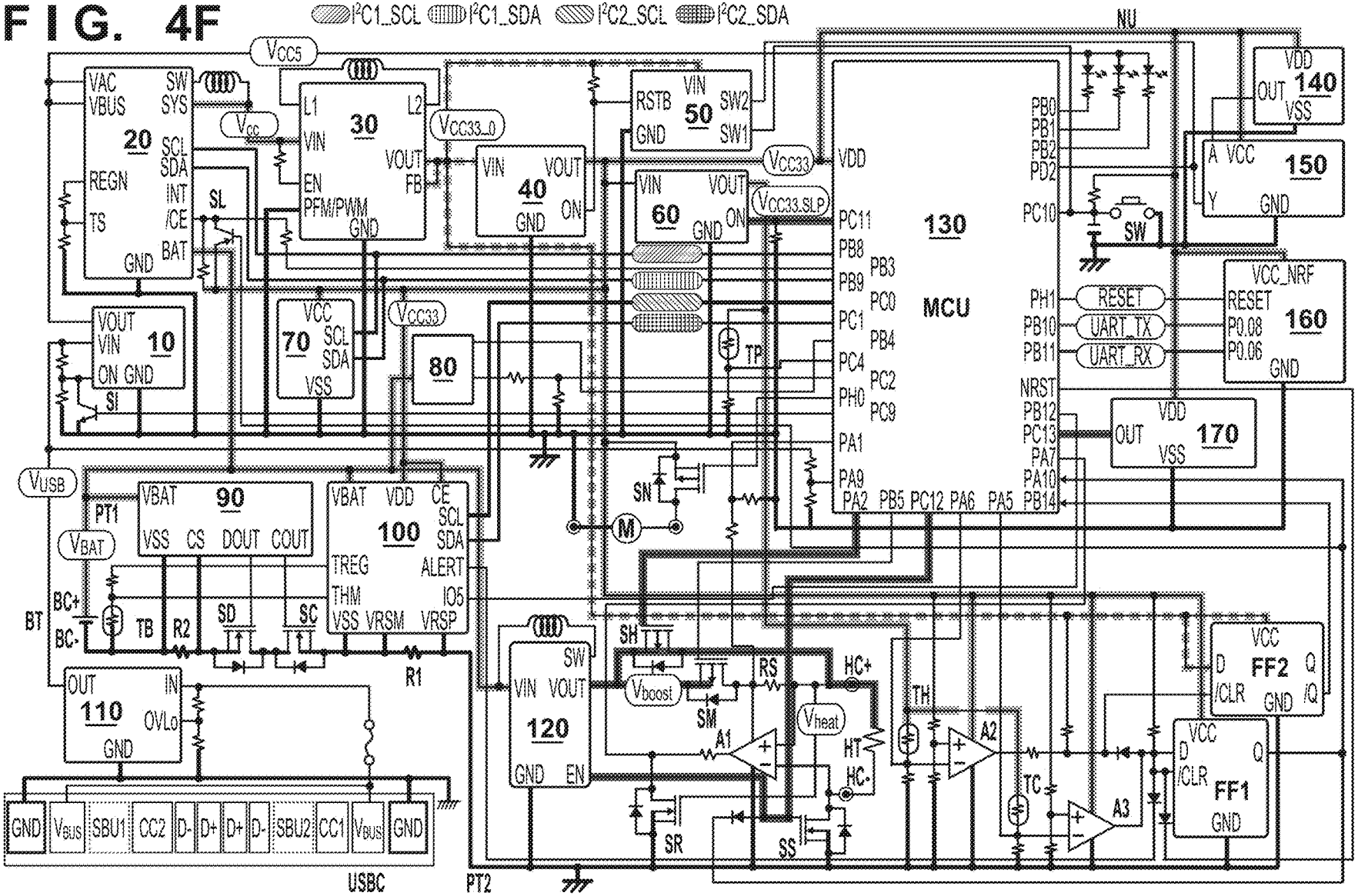
FIG. 4F is a view for explaining the operation of the power supply unit.

FIG. 4F shows the heating operation in the heating mode. Thick lines emphasize the supply paths of voltages and signals. The control unit 130 supplies high level from the PA2 terminal to the gate or the base of the transistor that forms the switch SH, thereby turning on the switch SH. Thus, the voltage Vboost output from the VOUT terminal of the transformation circuit 120 is supplied to the heater HT, and the heater HT heats the aerosol source. At this time, a voltage for turning on the switch SR is supplied to the gate or the base of the transistor that forms the switch SR. The voltage Vboost is supplied to the power supply terminal of the OP amplifier A2 via the shunt resistor RS.

Figure 4G:
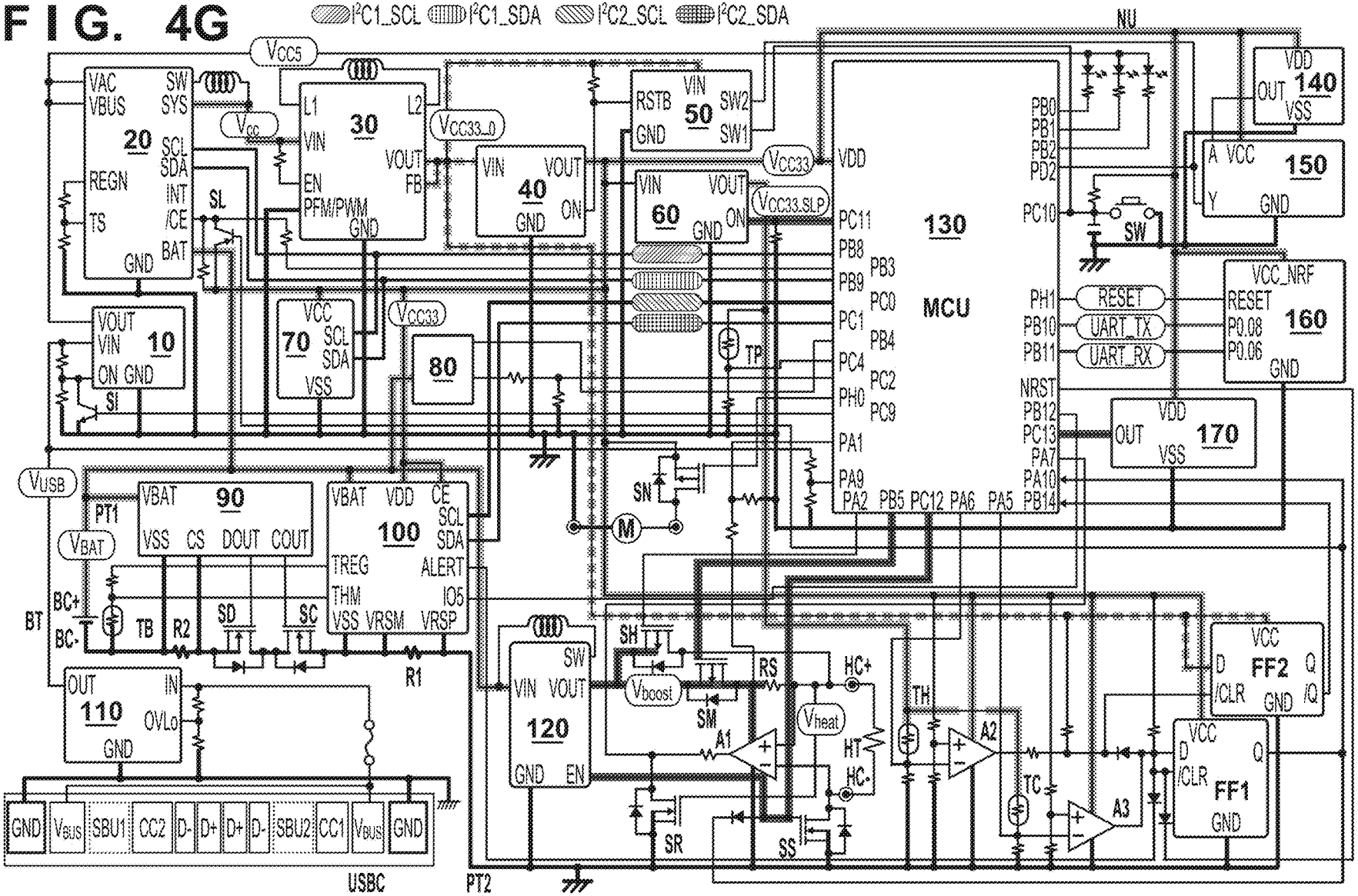
FIG. 4G is a view for explaining the operation of the power supply unit.

FIG. 4G shows the measurement operation in the heating mode. Thick lines emphasize the supply paths of voltages and signals. The control unit 130 supplies high level from the PB5 terminal to the gate or the base of the transistor that forms the switch SM, thereby turning on the switch SM. Thus, the voltage Vboost output from the VOUT terminal of the transformation circuit 120 is supplied to the heater HT via the shunt resistor RS. At this time, a voltage obtained by dividing the voltage Vboost is supplied to the gate or the base of the transistor that forms the switch SR. This is a voltage for turning off the switch SR. The OP amplifier A1 can be configured to supply a voltage having correlation with the resistance value of the heater HT to the PA7 terminal of the control unit 130. The control unit 130 can detect the temperature of the heater HT based on the voltage supplied from the OP amplifier A1. The control unit 130 can receive the voltage according to the voltage Vboost from the PA1 terminal and use this as a reference voltage for calculation of the temperature of the heater HT.

Note that in a period in which the heater HT is not energized, the control unit 130 may detect the temperature of the heater HT using the thermistor TH, that is, based on the output of the OP amplifier A2.

Figure 4H:
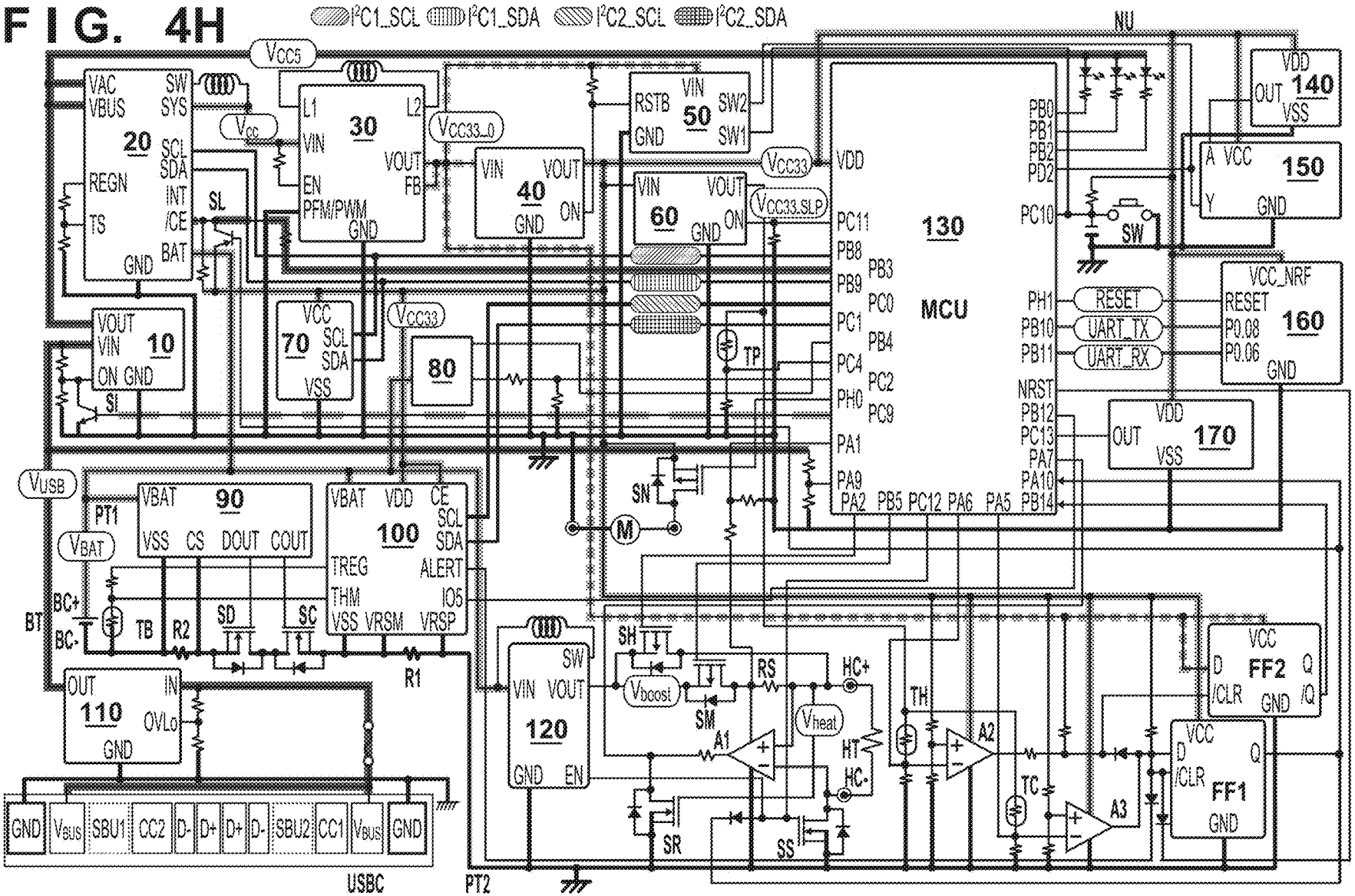
FIG. 4H is a view for explaining the operation of the power supply unit.

FIG. 4H shows the operation of the power supply unit PSU in the charge mode. Thick lines emphasize the supply paths of voltages and signals. The overvoltage protection circuit 110 receives the voltage $V_{BUS}$ supplied from the USB connector USBC and outputs the voltage $V_{USB}$ to the $V_{USB}$ line. The voltage $V_{USB}$ can be divided and supplied to the PA9 terminal of the control unit 130. Thus, the control unit 130 can recognize that the voltage $V_{USB}$ is supplied via the USB cable connected to the USB connector USBC, and change the level of the PC9 terminal from high level to low level. Thus, the switch SI is turned off, and high level is supplied to the ON terminal of the load switch 10. Accordingly, the load switch 10 can electrically connect the VIN terminal and the VOUT terminal and output the voltage $V_{CC5}$ for the VOUT terminal to the $V_{CC5}$ line.

The control unit 130 also supplies low level from the PB3 terminal to the /CE terminal of the charge circuit 20 to permit charge of the power supply BT by the charge circuit 20. The charge circuit 20 is set in the charge mode, and can supply the voltage $V_{CC}$ from the SW terminal to the $V_{CC}$ line using the voltage $V_{CC5}$ supplied via the $V_{CC5}$ line, electrically connect the SYS terminal and the BAT terminal, and supply the charge voltage from the BAT terminal to the power supply BT via the first conductive path PT1. The power supply BT is thus charged.

Figure 4I:
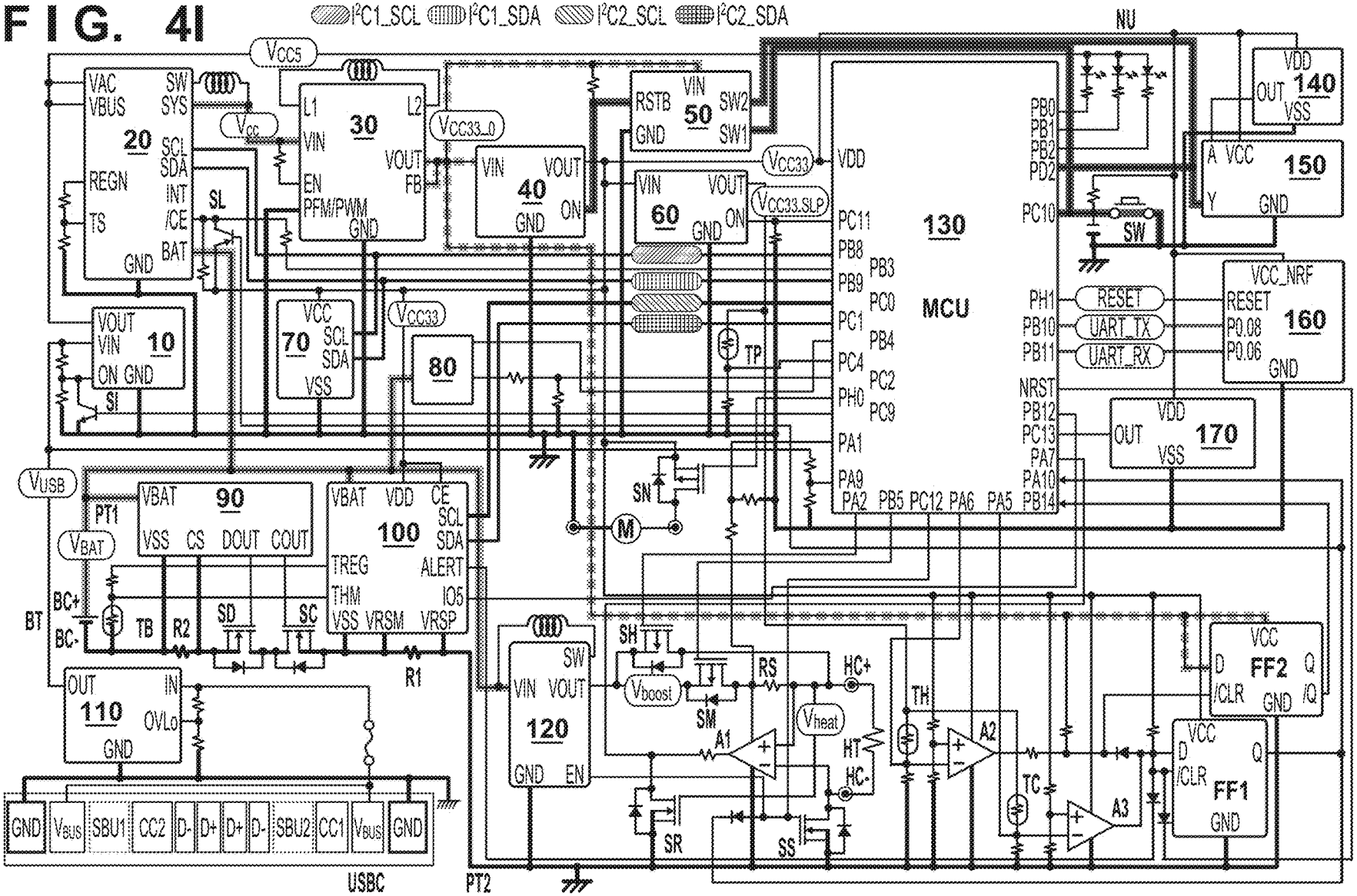
FIG. 4I is a view for explaining the operation of the power supply unit.

FIG. 4I shows the reset operation of the power supply unit PSU and the control unit 130. Thick lines emphasize the supply paths of voltages and signals. In a state in which the outer panel C103 is detached from the aerosol generation device AGD or the power supply unit PSU, low level is supplied from the detection unit 140 to the SW2 terminal of the power switch driver 50 via the Schmitt trigger circuit 150. If the switch SW is pressed in this state, low level is supplied to SW1 of the power switch driver 50.

In this way, if low level is supplied to the SW1 terminal and the SW2 terminal of the power switch driver 50 for a predetermined time, the power switch driver 50 can supply low level from the RSTB terminal to the ON terminal of the load switch 40. Accordingly, the load switch 40 stops the output of the voltage $V_{CC33}$ from the VOUT terminal, and the control unit 130 for which the supply of the voltage $V_{CC33}$ is cut off stops the operation. After that, the power switch driver 50 can stop the supply of low level from the RSTB terminal to the ON terminal of the load switch 40. Accordingly, since the supply of the voltage $V_{CC33_0}$ from the $V_{CC33_0}$ line to the ON terminal of the load switch 40 is resumed, the load switch 40 can resume the output of the voltage $V_{CC33}$ from the VOUT terminal, and the control unit 130 can be reactivated.

Here, the control unit 130, the power switch driver 50, and the load switch 40 can be understood to form a circuit block that executes, in accordance with the operation of the switch SW, an operation according to the detection result by the detection unit 140 configured to detect the presence/absence of the outer panel C103. Alternatively, the control unit 130, the power switch driver 50, and the load switch 40 can be understood to form a circuit block that executes, in accordance with the operation of the switch SW in a state in which the absence of the outer panel C103 is detected by the detection unit 140, an operation according to the detection result by the detection unit 140 irrespective of the detection result by the detection unit 170 configured to detect the state of the slider C102. Also, the control unit 130, the power switch driver 50, and the load switch 40 can be understood to form a circuit block that executes, in accordance with the operation of the switch SW, an operation according to the detection result by the detection unit 170 configured to detect the state of the slider C102.

If the switch SW is operated in a state in which the detection unit 140 detects that the outer panel C103 exists and in a state in which the detection unit 170 detects that the slider C102 is in the open state, the circuit block can execute first processing associated with generation of aerosol. If the switch SW is operated in a state in which the detection unit 140 detects that the outer panel C103 exists and in a state in which the detection unit 170 detects that the slider C102 is in the closed state, the circuit block can execute second processing that is not associated with generation of aerosol, for example, processing associated with communication with an external device. This corresponds to the above-described pairing mode. If the switch SW is operated in a state in which the detection unit 140 detects that the outer panel C103 does not exist, the circuit block can reactivate the control unit 130 irrespective of the detection result by the detection unit 170, that is, the state of the slider C102.

FIGS. 6, 7A, 7B, 8, 9A, and 9B show arrangement examples of various electronic components described above. Note that in these drawings, the electrical connections (wirings) of the thermistors TC, TP, and TH to thermistor connectors TC+ and TC−, thermistor connectors TP+ and TP−, and thermistor connectors THC+ and THC− are not correctly shown. Also, in these drawings, the electrical connections (wirings) of the heater HT to the first heater connector HC+ and the second heater connector HC− are omitted. As exemplified in FIG. 6, the communication device 160, the switch SW, the detection unit 140, the Schmitt trigger circuit 150, and the notification unit NU can be arranged, for example, on the same surface of the third board PCB3 (the same surface of the same board). As exemplified in FIG. 6, the communication device 160 and the switch SW can be arranged along the insertion/removal direction DIR of the insertion object to the insertion hole C104. As exemplified in FIG. 3A in addition to FIG. 6, the communication device 160 and the switch SW can be arranged at the center of the power supply unit PSU or the aerosol generation device AGD concerning the direction orthogonal to the insertion/removal direction DIR. As exemplified in FIG. 3A in addition to FIG. 6, the communication device 160 and the switch SW can be arranged between the first board PCB1 and the power supply BT concerning the direction orthogonal to the insertion/removal direction DIR. As exemplified in FIG. 6, the switch SW can be arranged between the communication device 160 and the notification unit NU. The switch SW can be arranged between the detection unit 140 and the communication device 160.

Figure 7A:
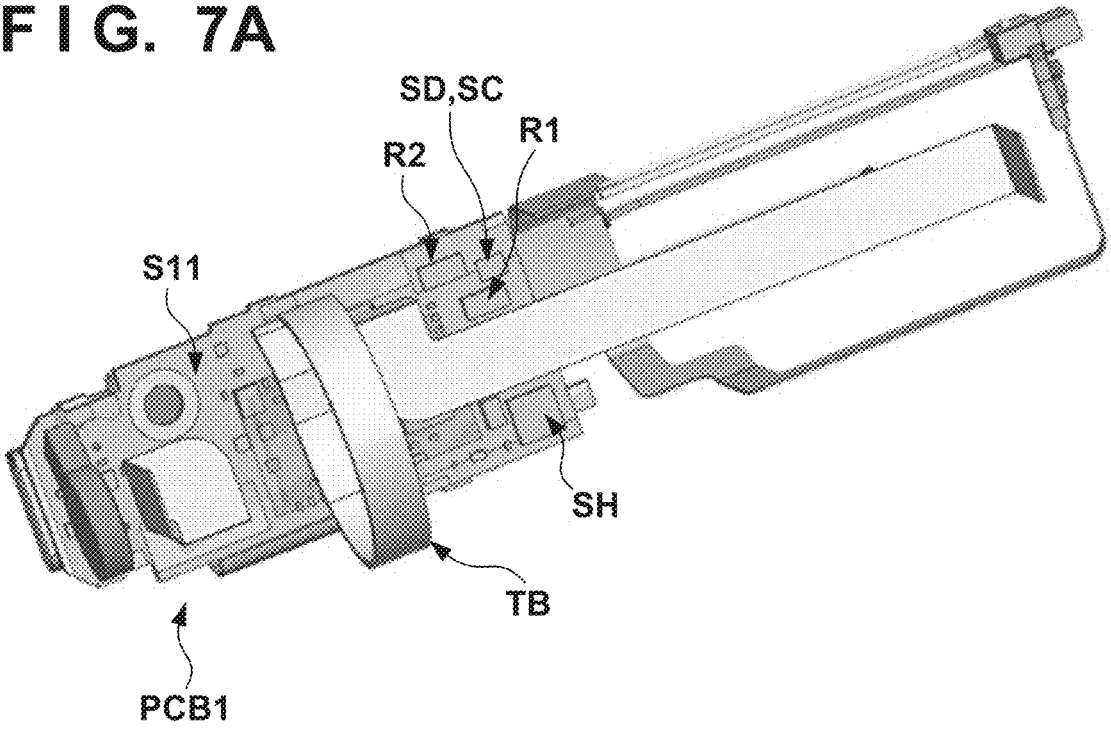
FIG. 7A is a view exemplifying the configuration of the aerosol generation device.
Figure 7B:
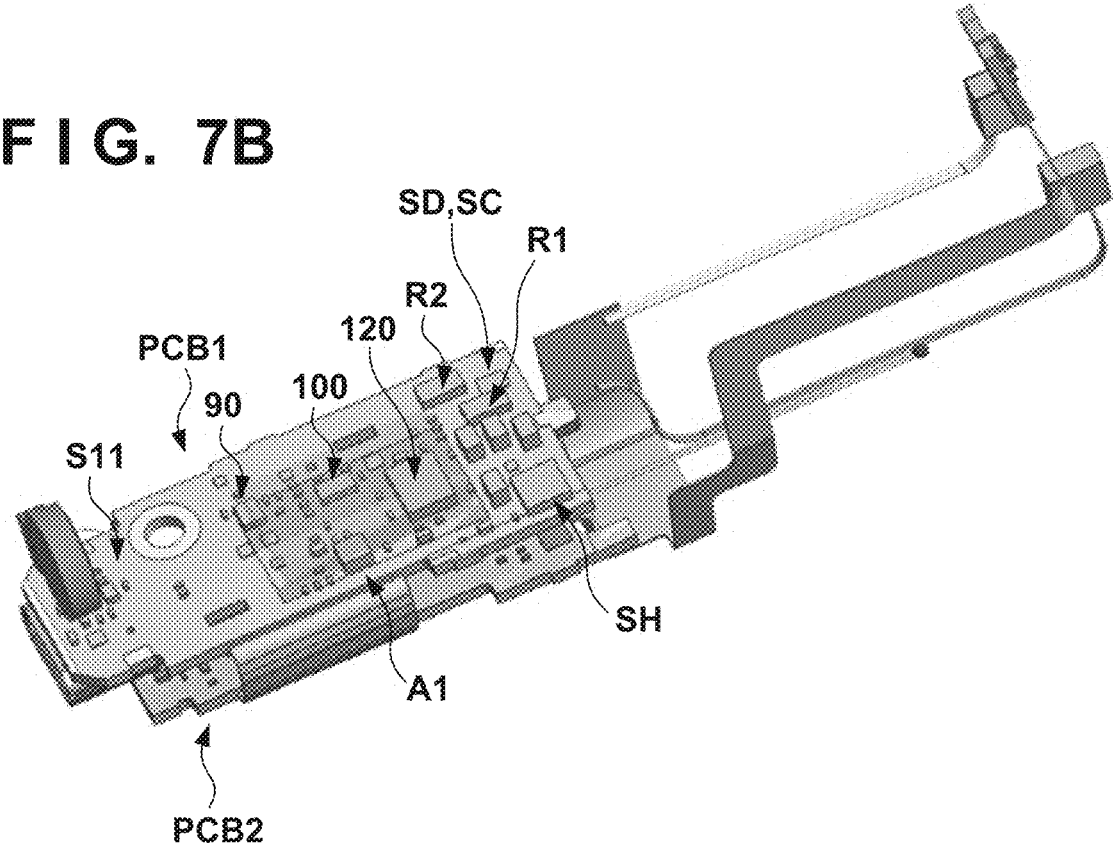
FIG. 7B is a view exemplifying the configuration of the aerosol generation device.

As exemplified in FIGS. 7A and 7B, at least one of the protection circuit 90 and the measurement circuit 100 can be arranged on, of the two surfaces of the first board PCB1, a first surface S11 facing the power supply BT. Alternatively, both the protection circuit 90 and the measurement circuit 100 can be arranged on the first surface S11 of the first board PCB1. The transformation circuit 120 can be arranged on the first surface S11 of the first board PCB1. As exemplified in FIGS. 7A and 7B, the transistors Sd and SC can be arranged on the first surface S11 of the first board PCB1. As exemplified in FIGS. 7A and 7B, the switch SH can be arranged on the first surface S11 of the first board PCB1. The first and second resistors R1 and R2 can be arranged on the first surface S11 of the first board PCB1. As exemplified in FIGS. 7A and 7B, the OP amplifier A1 can be arranged on the first surface S11 of the first board PCB1. Arranging the protection circuit 90, the measurement circuit 100, the first resistor R1, the second resistor R2, and the transistors SD and SC on the first surface S11 of the first board PCB1 is advantageous in reducing the parasitic resistance value of the second conductive path PT2.

Figure 8:
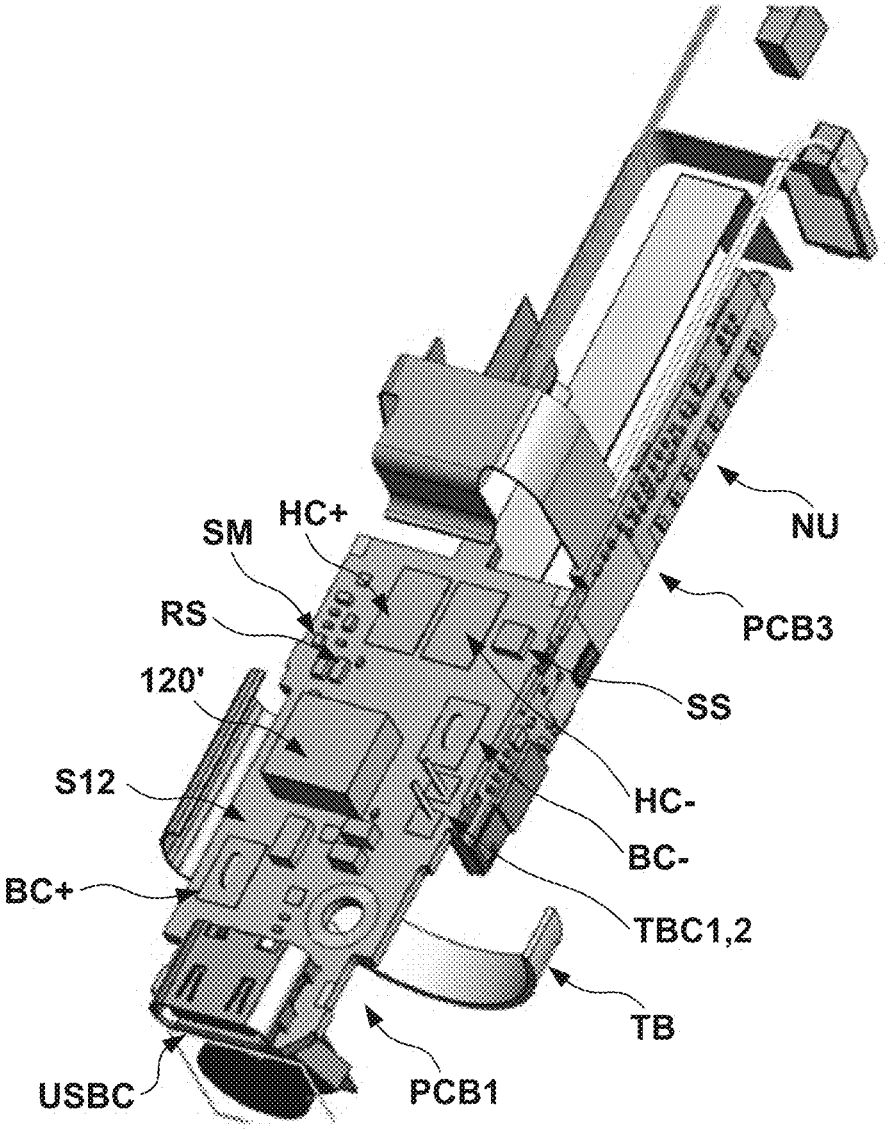
FIG. 8 is a view exemplifying the configuration of the aerosol generation device.

As exemplified in FIG. 8, the transformation circuit 120 can be accompanied by an inductor 120', and the transformation circuit 120 and the inductor 120' can be arranged on the surfaces of the first board PCB1, which are opposite to each other. Preferably, the transformation circuit 120 can be arranged on the first surface S11 of the first board PCB1, and the inductor 120' can be arranged on a second surface S12 on the opposite side. The USB connector USBC and the inductor 120' can be arranged on the second surface S12 of the first board PCB1. Since the USB connector USBC and the inductor 120' are electronic components each having a fairly large size or thickness, arranging these on the same surface of the first board PCB1 can contribute to size reduction of the aerosol generation device AGD or the power supply unit PSU.

As exemplified in FIG. 8, the heater connectors HC+ and HC−, the switches SM and SS, and the shunt resistor RS can be arranged on the second surface S12 of the first board PCB1 (that is, the same surface of the same board). This arrangement is advantageous in reducing the parasitic resistance value of the conductive path of the circuit configured to detect the resistance value or the temperature of the heater HT. The shortest distance between the second surface S12 of the first board PCB1 and the heater HT is preferably smaller than the shortest distance between the first surface S11 of the first board PCB1 and the heater HT. This arrangement is advantageous in shortening a lead line that connects the heater connectors HC+ and HC− and the heater HT.

Figure 9A:
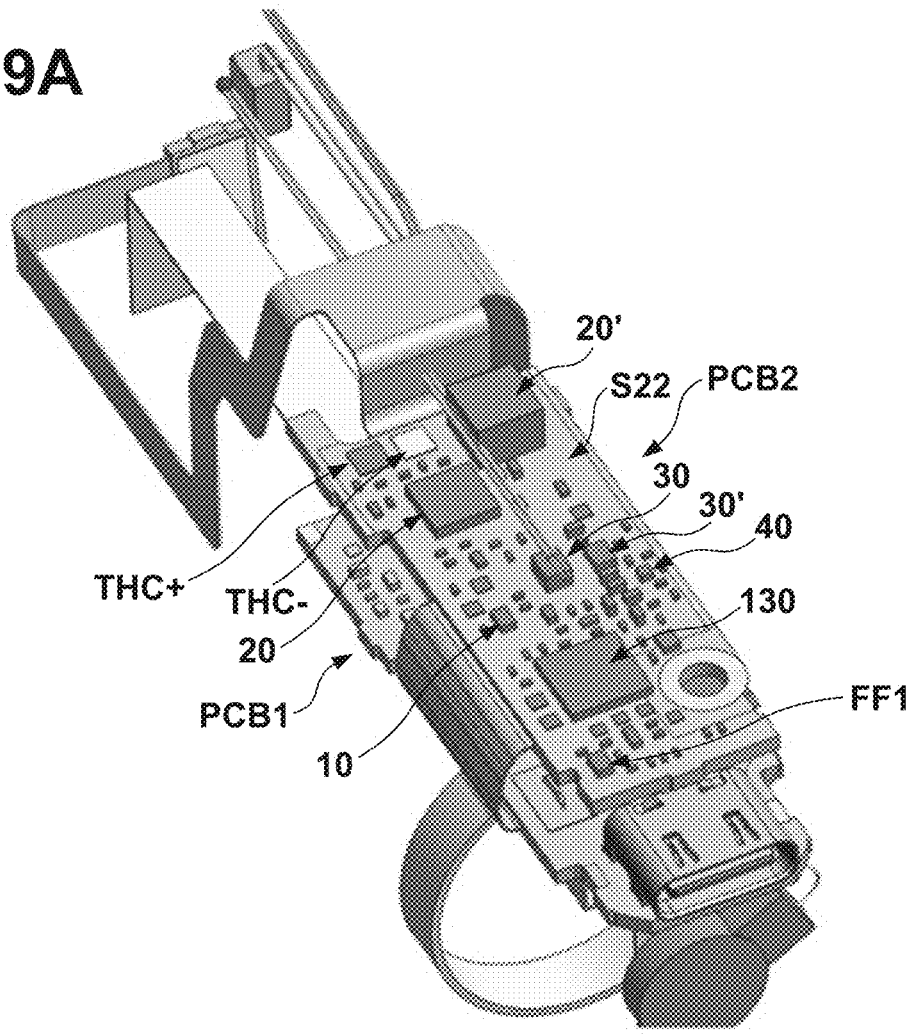
FIG. 9A is a view exemplifying the configuration of the aerosol generation device.
Figure 9B:
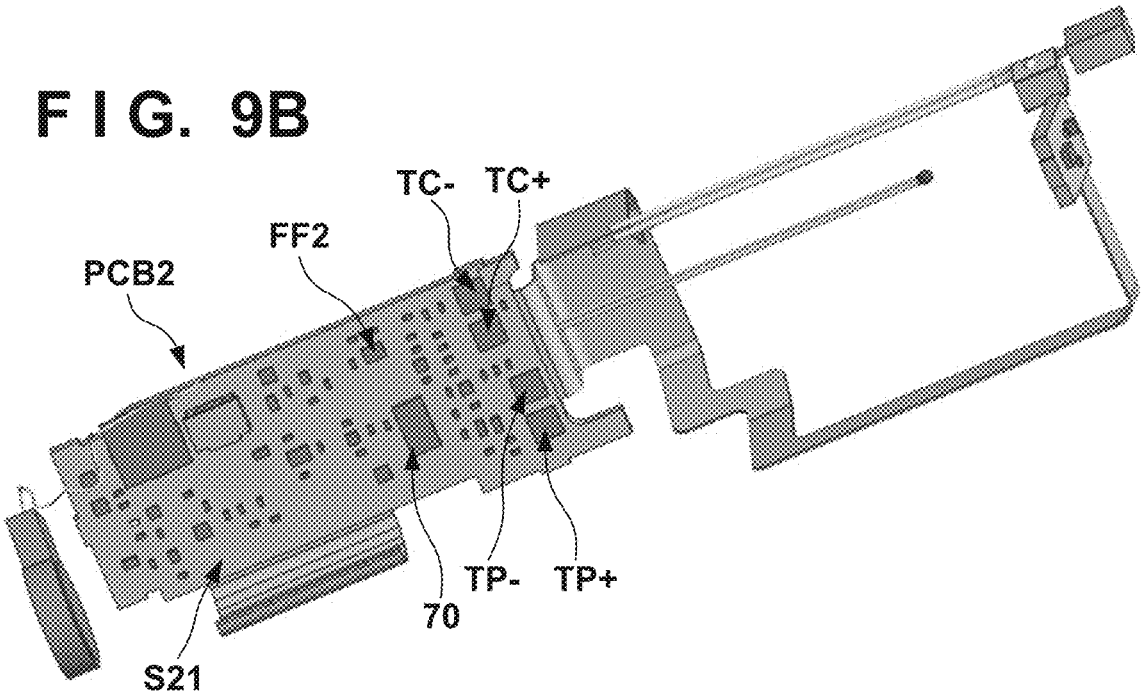
FIG. 9B is a view exemplifying the configuration of the aerosol generation device.

As exemplified in FIGS. 9A and 9B, the second board PCB2 includes a first surface S21 facing the second surface S12 of the first board PCB1, and a second surface S22 on the opposite side. The connectors THC+ and THC− of the thermistor TH configured to detect the temperature of the heater HT can be arranged on the second surface S22 of the second board PCB2. The charge circuit 20 and an inductor 20' accompanying it can be arranged on the same surface of the second board PCB2, that is, the second surface S22. The transformation circuit 30 and an inductor 30' accompanying it can be arranged on the same surface of the second board PCB2, that is, the second surface S22. The load switch 10 can be arranged on the second surface S22 of the second board PCB2. The control unit 130 can be arranged on the second surface S22 of the second board PCB2. The information holding circuit FF1 can be arranged on the second surface S22 of the second board PCB2. The nonvolatile memory 70 and the information holding circuit FF2 can be arranged on the first surface S21 of the second board PCB2. The thermistor connectors TC+ and TC− for the thermistor TC and the thermistor connectors TP+ and TP− for the thermistor TP can be arranged on the first surface S21 of the second board PCB2.

Figure 10:
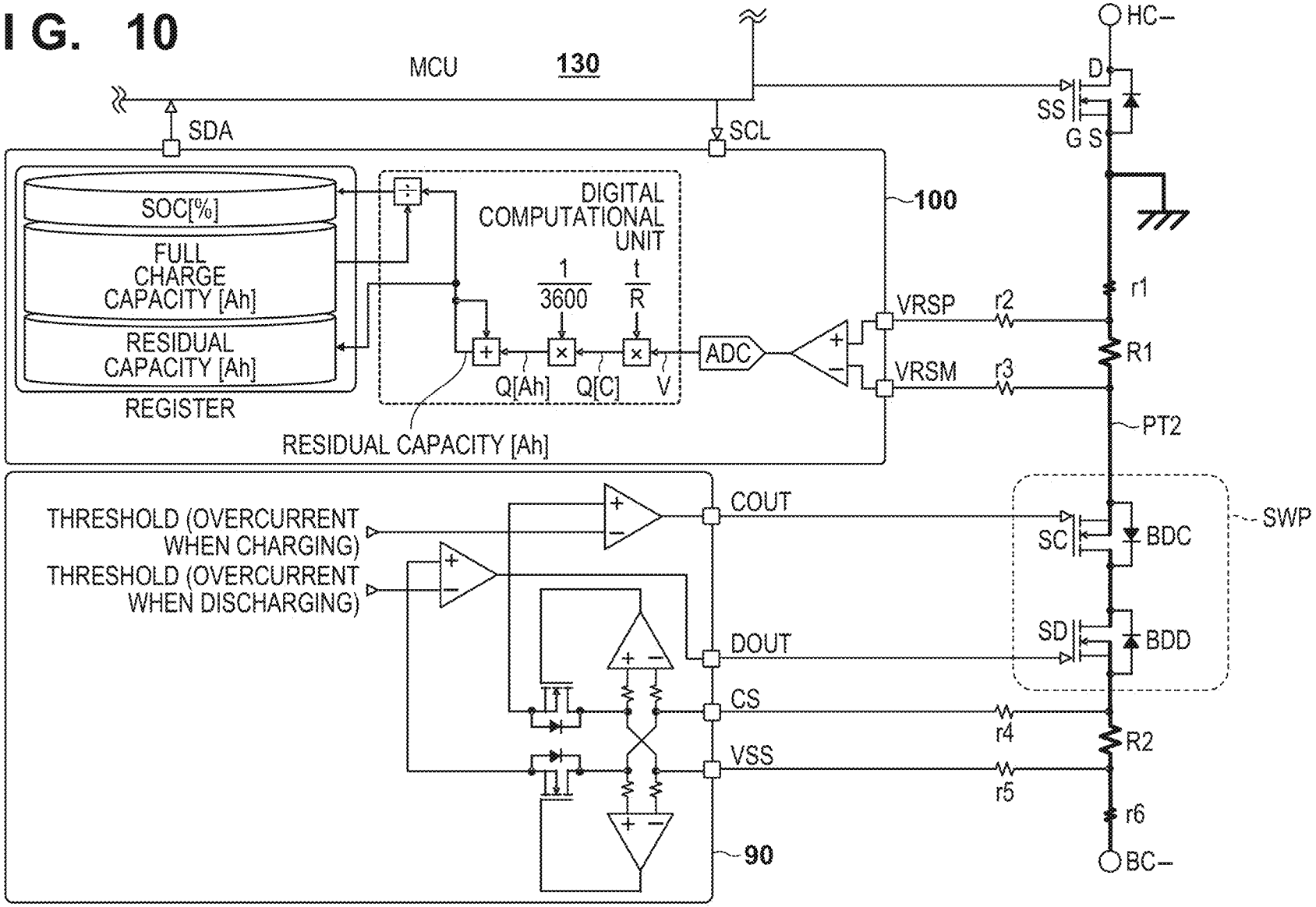
FIG. 10 is a view exemplifying the configuration of the aerosol generation device.

FIG. 10 shows the protection circuit 90, the measurement circuit 100, and electronic components arranged on the periphery thereof. Using the second resistor R2 arranged in a path to which a current output from the power supply BT flows, the protection circuit 90 can measure the current flowing to the path and control a switch unit SWP that is controlled to protect the power supply BT in accordance with the current. In place of or in addition to this, the protection circuit 90 can measure the voltage of the power supply BT based on the potential of the positive electrode of the power supply BT, which is supplied to the VBAT terminal, and control the switch unit SWP to protect the power supply BT in accordance with the voltage. The second resistor R2 and the switch unit SWP may be arranged in the first conductive path PT1 electrically connected to the first power supply connector BC+, but are preferably arranged in the second conductive path PT2 electrically connected to the second power supply connector BC−. This configuration can decrease the in-phase input voltage of an OP amplifier incorporated in the protection circuit 90 and is therefore advantageous in the point that the protection circuit 90 can stably operate and in the point that the inexpensive protection circuit 90 can be used. The switch unit SWP can include the first transistor SD and the second transistor SC, which are connected in series. The first transistor SD can function as a switch configured to cut off the second conductive path PT2 (in other words, the path to which the current output from the power supply BT flows) to stop discharge of the power supply BT. The second transistor SC can function as a switch configured to cut off the second conductive path PT2 (in other words, the path to which the current output from the power supply BT flows) to stop charge of the power supply BT.

A first rectifying element connected in parallel to the first transistor SD may be provided, and the first rectifying element may be formed as a body diode BDD of the first transistor SD. The forward direction of the first rectifying element is a direction in which the current for charging the power supply BT flows. Also, a second rectifying element connected in parallel to the second transistor SC may be provided, and the second rectifying element may be formed as a body diode BDC of the second transistor SC. The forward direction of the second rectifying element is a direction in which the current discharged from the power supply BT flows.

The resistance value of the second resistor R2 is known, and the protection circuit 90 can detect the current (current value) flowing to the second conductive path PT2 by detecting a voltage drop caused by the second resistance value R2. The protection circuit 90 can be configured to turn off the first transistor SD if the current discharged from the power supply BT, that is, the current flowing from the second heater connector HC− to the second power supply connector BC− exceeds a first threshold for determining an overcurrent in discharge. The protection circuit 90 can also be configured to turn off the second transistor SC if the current for charging the power supply BT, that is, the current flowing from the second power supply connector BC− to the second heater connector HC− exceeds a second threshold for determining an overcurrent in charge. The protection circuit 90 can also be configured to turn off the second transistor SC if the output voltage of the power supply BT indicates an overcharge state of the power supply BT. The protection circuit 90 can also be configured to turn off the first transistor SD if the output voltage of the power supply BT indicates an overdischarge state of the power supply BT.

The measurement circuit 100 can measure the state of the power supply BT using the first resistor R1 arranged in the path to which the current output from the power supply BT flows. The first resistor R1 may be arranged in the first conductive path PT1 electrically connected to the first power supply connector BC+, but is preferably arranged in the second conductive path PT2 electrically connected to the second power supply connector BC−. This configuration can decrease the in-phase input voltage of an OP amplifier incorporated in the measurement circuit 100 and is therefore advantageous in the point that the measurement circuit 100 can stably operate and in the point that the inexpensive measurement circuit 100 can be used. The measurement circuit 100 integrates the current (current value) flowing to the first resistor R1, that it, obtains a charge amount (power consumption) flowing via the first resistor R1, thereby calculating the residual capacity (Ah) and the SOC (State Of Charge) of the power supply BT. SOC (%) can be defined by "residual capacity (Ah)/full charge capacity (Ah)×100". The measurement circuit 100 can provide the residual capacity and the SOC to the control unit 130. The measurement circuit 100 may acquire the temperature of the power supply BT using the TREG terminal, the THM terminal, and the thermistor TB (none are shown in FIG. 10), and calculate the residual capacity and the SOC based on the acquired temperature of the power supply BT as well. Since the residual capacity and the SOC of the power supply BT are strongly influenced by the temperature of the power supply BT, this configuration is advantageous in correctly acquiring the residual capacity and the SOC of the power supply BT.

The switch SS, the first resistor R1, and the second resistor R2 can exist between the second heater connector HC− and the second power supply connector BC−. A parasitic resistance r1 can exist between the switch SS and the first resistor R1, and a parasitic resistance r6 can exist between the second resistor R2 and the second power supply connector BC−. A parasitic resistance r2 can exist between the first resistor R1 and the VRSP terminal of the measurement circuit 100, and a parasitic resistance r3 can exist between the first resistor R1 and the VRSM terminal of the measurement circuit 100.

Figure 11:
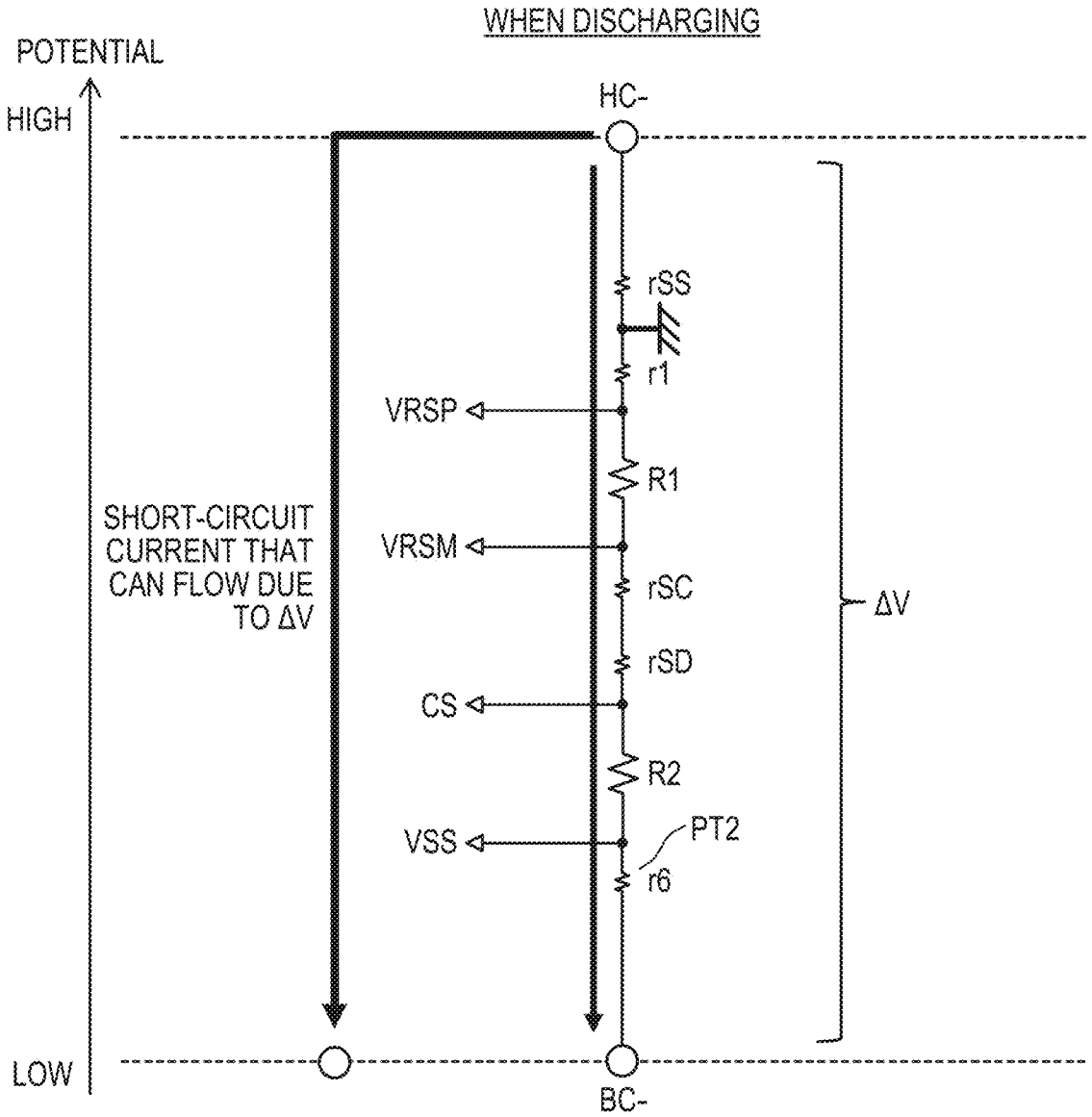
FIG. 11 is a view schematically showing a discharge state from a power supply.
Figure 12:
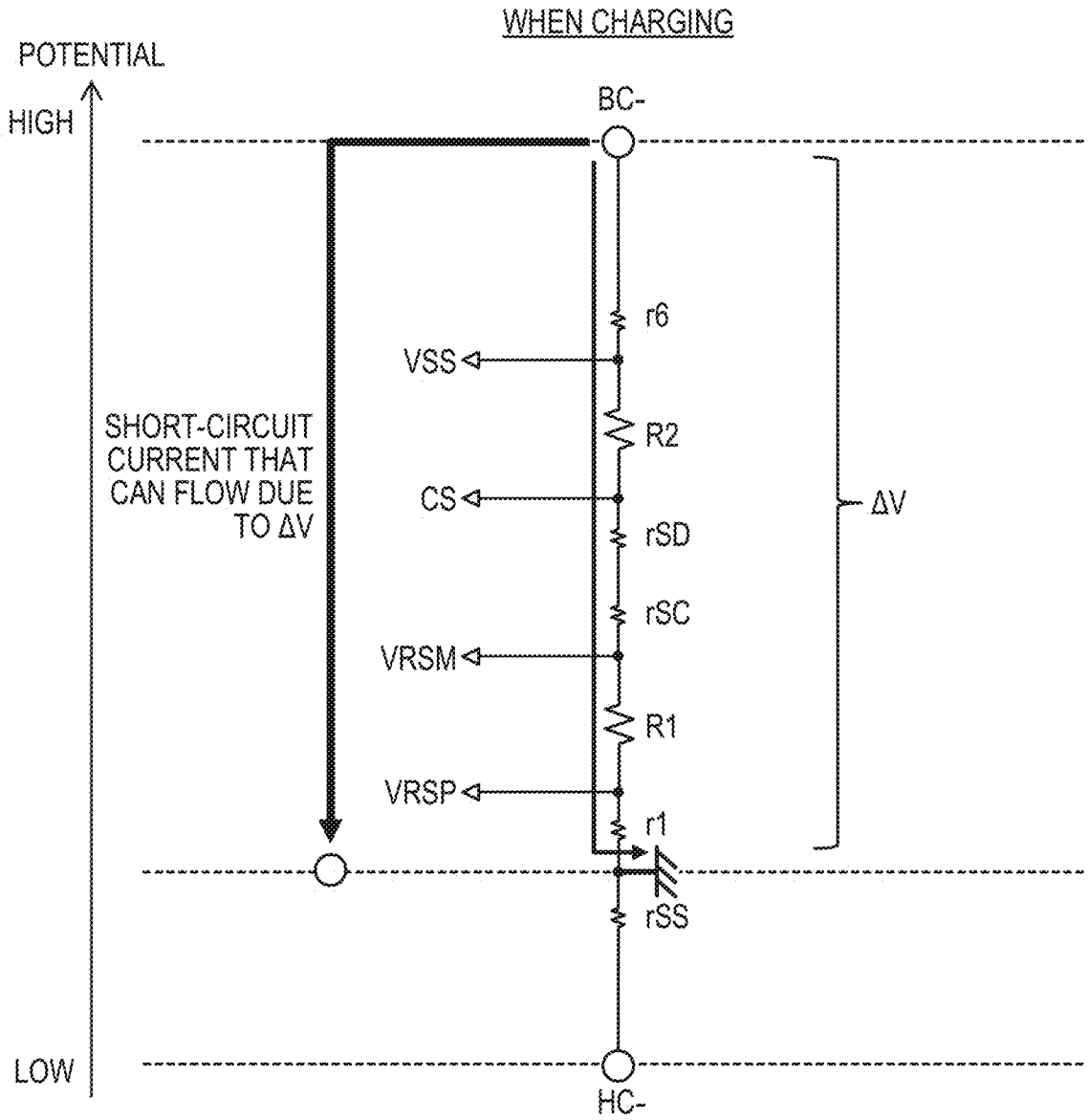
FIG. 12 is a view schematically showing the charge state of the power supply.

Although not illustrated, parasitic resistances can also exist between the first resistor R1 and the connection node between the parasitic resistance r2 and the first resistor R1 and between the first resistor R1 and the connection node between the parasitic resistance r3 and the first resistor R1. These can be factors that cause an error in the measurement result by the measurement circuit 100. FIG. 11 schematically shows the discharge state from the power supply BT. In FIG. 11 and FIG. 12 to be described later, rSS represents the ON resistance of the switch SS; rSC, the ON resistance of the second transistor SC; and rSD, the ON resistance of the first transistor SD. In discharge, the potential of the second heater connector HC− is higher than the potential of the second power supply connector BC−. The parasitic resistances r1 and r6 can be factors that increase a potential difference ΔV between the second heater connector HC− and the second power supply connector BC−. The increase of ΔV may increase a short-circuit current flowing when the second heater connector HC− and the second power supply connector BC− are short-circuited by, for example, dew condensation or water entering from the aerosol source.

FIG. 12 schematically shows the charge state from the power supply BT. In charge, the potential of the second power supply connector BC− is higher than the potential of the second heater connector HC−. The parasitic resistances r1 and r6 can be factors that increase the potential difference ΔV between the second power supply connector BC− and the second heater connector HC−. The increase of ΔV may increase the short-circuit current flowing when the second power supply connector BC− and the second heater connector HC− are short-circuited by, for example, dew condensation or water entering from the aerosol source.

Figure 13:
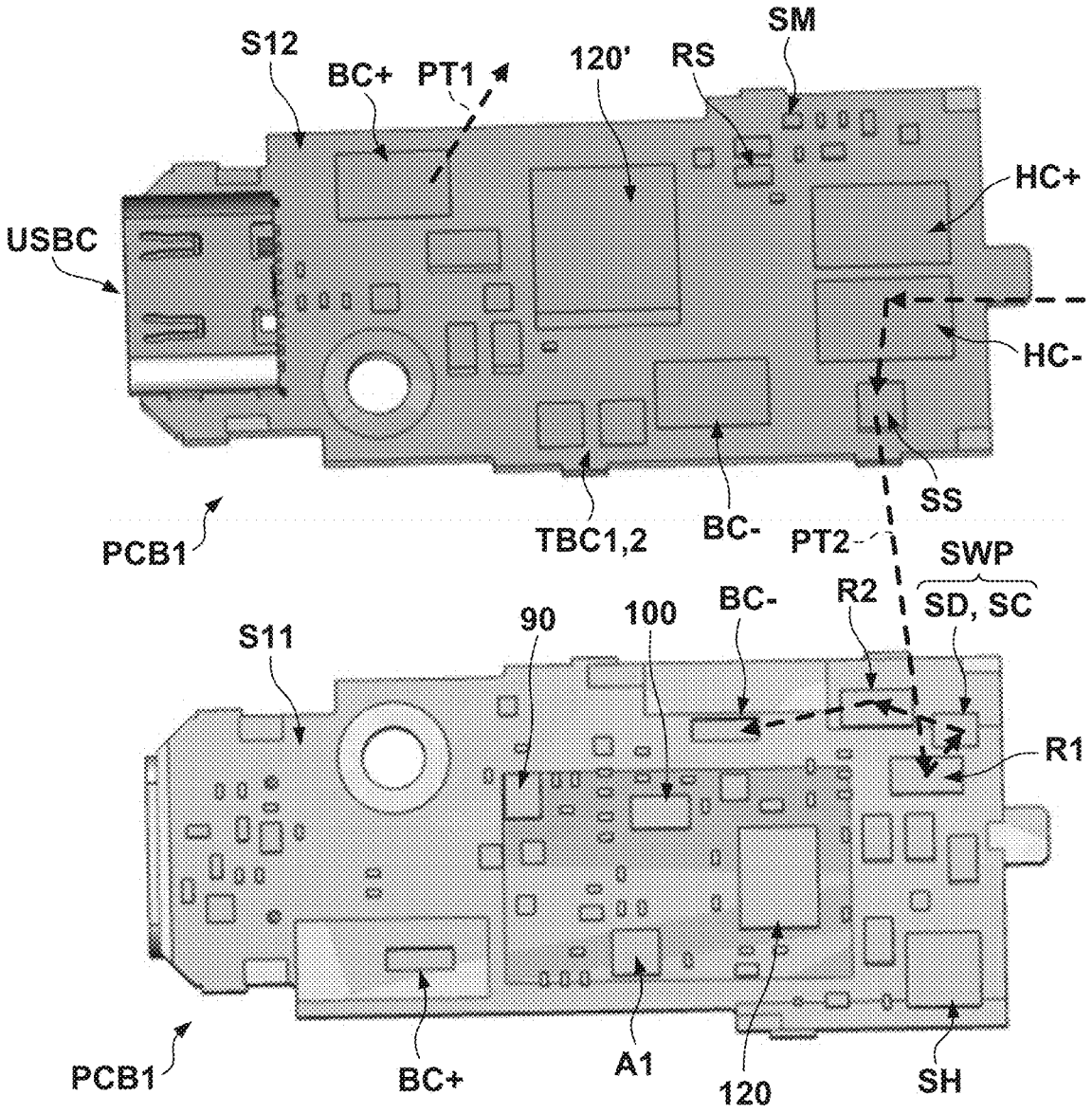
FIG. 13 is a view exemplifying the configuration of the aerosol generation device.

FIG. 13 exemplifies a physical path between the second heater connector HC− and the second power supply connector BC−. The power supply unit PSU or the aerosol generation device AGD can include the plurality of boards PCB1, PCB2, PCB3, and PCB4. FIG. 13 shows the configuration of the first board PCB1. The first heater connector HC+ and the second heater connector HC− can be arranged on the first board PCB1. When the measurement circuit 100 and the first resistor R1 are arranged on the first board PCB1 together with the second heater connector HC−, a conductive pattern that connects these becomes short, and therefore, the parasitic resistance r1 can be reduced. Thus, the short-circuit current that flows when the second power supply connector BC− and the second heater connector HC− are short-circuited can be made weak.

The first heater connector HC+ and the second heater connector HC− may be arranged on different surfaces of the first board PCB1 or may be arranged on the same surface. In the example shown in FIG. 13, the first heater connector HC+ and the second heater connector HC− may be arranged on the second surface S12 of the first board PCB1. According to the configuration in which the first heater connector HC+ and the second heater connector HC− are arranged on the same surface of the same board, the lead wire of the heater HT can easily be connected to the first heater connector HC+ and the second heater connector HC− at the time of manufacturing. This can reduce the cost of the aerosol generation device AGD or the power supply unit PSU.

The first power supply connector BC+ electrically connected to the positive electrode of the power supply BT and the second power supply connector BC− connected to the negative electrode of the power supply BT can be arranged on the first board PCB1. The path to which the current output from the power supply BT flows includes the first conductive path PT1 connected to the first power supply connector BC+ and the second conductive path PT2 connected to the second power supply connector BC. The first resistor R1 and the second resistor R2 can be arranged in the second conductive path PT2. According to this configuration, the in-phase input voltage for the VRSP terminal and the VRSM terminal of the measurement circuit 100 and the in-phase input voltage for the CS terminal and the VSS terminal of the protection circuit 90 can have small values. Since this obviates the necessity of the expensiveness and/or large measurement circuit 100 or protection circuit 90, the cost and size of the aerosol generation device AGD or the power supply unit PSU can be reduced.

The measurement circuit 100 that measures the state (for example, the residual capacity, the SOC, the like) of the power supply BT using the first resistor R1 can be arranged on, of the plurality of boards PCB1, PCB2, PCB3, and PCB4, the same board as the board on which the first resistor R1 is arranged, that is, the first board PCB1. In another viewpoint, the measurement circuit 100 can be arranged on, of the plurality of element arrangement surfaces (S11, S12, S21, S22, and the like), the same element arrangement surface as the element arrangement surface on which the first resistor R1 is arranged, that is, the first surface S11. According to these configurations, the first resistor R1 and the VRSP terminal and the VRSM terminal of the measurement circuit 100 can be arranged physically close to each other. This can reduce the parasitic resistance r2 existing between the first resistor R1 and the VRSP terminal of the measurement circuit 100 and the parasitic resistance r3 existing between the first resistor R1 and the VRSM terminal of the measurement circuit 100. Such reduction of the parasitic resistances enables accurate measurement of the state of the power supply BT by the measurement circuit 100. In addition, conductive patterns that connect the first resistor R1 and the VRSP terminal and the VRSM terminal of the measurement circuit 100 can be made short. Also, the length of the conductive pattern that connects the first resistor R1 and the VRSP terminal of the measurement circuit 100 and the length of the conductive pattern that connects the first resistor R1 and the VRSM terminal of the measurement circuit 100 can easily made substantially equal. These also enable accurate measurement of the state of the power supply BT by the measurement circuit 100.

The first resistor R1 and the second heater connector HC− can be arranged on the surfaces of the first board PCB1, which are opposite to each other. In the example shown in FIG. 13, the first resistor R1 is arranged on the first surface S11 of the first board PCB1, and the second heater connector HC− is arranged on the second surface S12 of the first board PCB1. In an orthographic projection to one of the two surfaces S11 and S12 of the first board PCB1, at least a part of the first resistor R1 can overlap at least a part of the second heater connector HC−. In another viewpoint, in the orthographic projection to one of the two surfaces S11 and S12 of the first board PCB1, the first resistor R1 can be arranged in the region of the second heater connector HC−. This arrangement is advantageous in reducing an undesirable parasitic resistance value (the resistance value of the above-described parasitic resistance r1) between the second power supply connector BC− and the second heater connector HC−, and this is advantageous in, for example, reducing the short-circuit current between the second power supply connector BC− and the second heater connector HC−.

The second conductive path PT2 can include the switch SS arranged between the first resistor R1 and the second heater connector HC−. The switch SS and the second heater connector HC− can be arranged on the same surface of the first board PCB1. In the example shown in FIG. 13, the switch SS and the second heater connector HC− are arranged on the second surface S12 of the first board PCB1. The switch SS can be the element closest to the second heater connector HC− among electronic components arranged on the same surface as that, that is, the second surface S12. In another viewpoint, the switch SS can be the element closest to the second heater connector HC− among active elements arranged on the same surface as that, that is, the second surface S12. According to this configuration, when the switch SS is turned off in an unuse state of the aerosol generation device AGD or the power supply unit PSU, static electricity and noise, which may enter from the heater HT, the first heater connector HC+, and the second heater connector HC−, hardly enter the first resistor R1 or the second conductive path PT2.

The second conductive path PT2 can further include the switch unit SWP arranged to be connected in series with the first resistor R1. According to this configuration, if an abnormality such as an overcurrent, overdischarge, or overcharge occurs in the power supply BT, the power supply BT can be protected by opening the switch unit SWP.

The first resistor R1 and the switch unit SWP are arranged on the same surface of the first board PCB1, that is, the first surface S11 in the example shown in FIG. 13. In addition to the first resistor R1 and the switch unit SWP, the second resistor R2 can also be arranged on the same surface of the first board PCB1, for example, the first surface S11. In the orthographic projection to one of the two surfaces S11 and S12 of the first board PCB1, at least a part of the switch unit SWP can overlap at least a part of the second heater connector HC−. According to this configuration, since the second conductive path PT2 can be made short, the parasitic resistance of the second conductive path PT2 can be reduced. The short-circuit current that flows when the second power supply connector BC− and the second heater connector HC− are short-circuited can thus be made weak.

The protection circuit 90 can control the switch unit SWP to protect the power supply BT in accordance with the current flowing to the second conductive path PT2 or the potential of the positive electrode of the power supply BT (the output voltage of the power supply BT) input to the VBAT terminal. According to this configuration, if an abnormality such as an overcurrent, overdischarge, or overcharge occurs in the power supply BT, the power supply BT can be protected.

The switch unit SWP can be arranged between the first resistor R1 in the second conductive path PT2 and the negative electrode of the power supply BT (or the second power supply connector BC−). According to this configuration, as will be described later, even in a state in which the first transistor SD is off, the measurement circuit 100 and the control unit 130 can communicate via their VC interfaces. It is also possible to make the protection of the power supply BT by the protection circuit 90 function as long as possible and suppress further discharge of the power supply BT to the utmost limits.

The protection circuit 90 can detect the current flowing to the second conductive path PT2 using the second resistor R2 arranged in the second conductive path PT2 to be connected in series with the first resistor R1. The first resistor R1 and the second resistor R2 can be arranged on the same surface of the first board PCB1, for example, the first surface S11. The second resistor R2 can be arranged between the switch unit SWP in the second conductive path PT2 and the negative electrode of the power supply BT (or the second power supply connector BC−). The first resistor R1 and the second resistor R2 can be arranged such that the shortest distance between the first resistor R1 and the second resistor R2 is smaller than at least one of the maximum size of the first resistor R1 and the maximum size of the second resistor R2. These configurations are advantageous in reducing the parasitic resistance between the first resistor R1 and the second resistor R2.

In an example, the measurement circuit 100 can be arranged on the first board PCB1, and the control unit 130 can be arranged on the second board PCB2. The measurement circuit 100 and the control unit 130 have functions of communicating with each other. The measurement circuit 100 and the control unit 130 may each be a noise generation source because many operations are performed inside. When these are arranged on boards different from each other, noise generated in one of them hardly affects the other.

To the VDD terminal (power supply terminal) of the measurement circuit 100, the voltage $V_{CC33}$ can be supplied via the $V_{CC33}$ line by the transformation circuit 30. The transformation circuit 30 can generate the voltage $V_{CC33_0}$ by transforming the voltage $V_{CC}$ supplied from the power supply BT via the charge circuit 20, and supply the voltage $V_{CC33}$ to the VDD terminal (power supply terminal) of the measurement circuit 100 via the load switch 40. According to this configuration, the voltage $V_{CC33}$ supplied to the VDD terminal (power supply terminal) of the measurement circuit 100 stabilizes. Thus, the operation of the measurement circuit 100 stabilizes.

In an example, the measurement circuit 100 can be arranged on the first board PCB1, and the transformation circuit 30 can be arranged on the second board PCB2. The transformation circuit 30 may generate noise when executing transformation. According to this configuration, since the measurement circuit 100 can physically be located apart from the transformation circuit 30 that may be a noise generation source, the operation of the measurement circuit 100 stabilizes.

The transformation circuit 120 that transforms the voltage supplied from the power supply BT and thus generates the voltage VBOOST to be supplied to the heater HT can be arranged on the first board PCB1. According to this configuration, the appropriate voltage VBOOST for heating the aerosol source can be supplied to the heater HT. This can provide aerosol whose amount and flavor are highly controlled to the user of the aerosol generation device AGD.

The switch SH can be arranged in the path that electrically connects the output of the transformation circuit 120 and the heater HT. The switch SH can be arranged on the first board PCB1. The switch SH can be arranged on, for example, the first surface S11 of the first board PCB1. Since large power for causing the heater HT to generate heat is supplied from the transformation circuit 120 to the switch SH, a conductive pattern that connects the switch SH and the transformation circuit 120 is preferably thick and short. According to this configuration, since the switch SH and the transformation circuit 120 are arranged on the first board PCB1, a thick and short conductive pattern can readily be formed. Hence, even of the above-described large current flows, heat or noise is hardly generated in the conductive pattern.

The OP amplifier A1 that forms a detection circuit configured to detect the resistance value or the temperature of the heater HT can be arranged on the first board PCB1. The OP amplifier A1 can be arranged on, for example, the first surface S11 of the first board PCB1.

Figure 14:
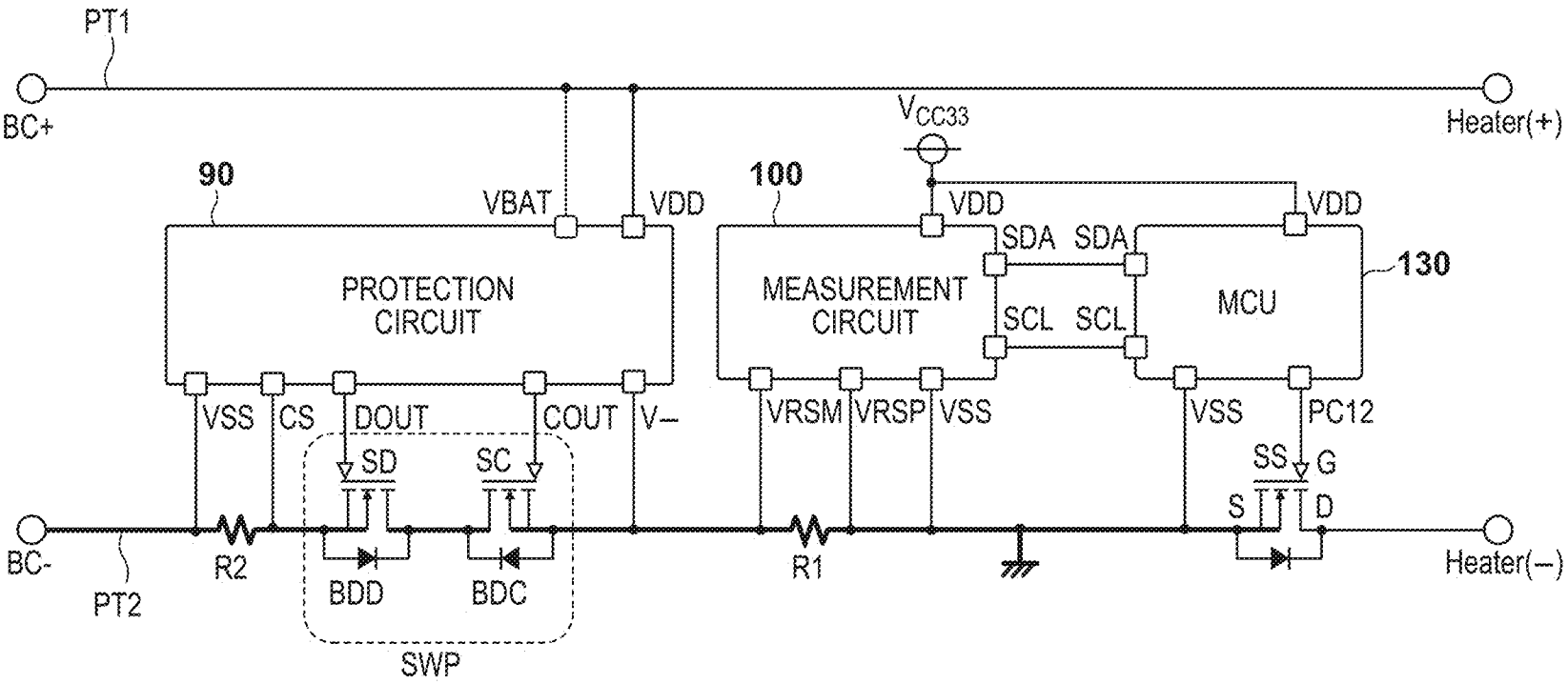
FIG. 14 is a view exemplifying a protection circuit, a measurement circuit, and electronic components arranged on the periphery thereof.

FIG. 14 shows the protection circuit 90, the measurement circuit 100, and electronic components arranged on the periphery thereof. FIG. 14 also the control unit 130 as well. The aerosol generation device AGD or the power supply unit PSU can include the first conductive path PT1 electrically connected to the positive electrode of the power supply BT or the first power supply connector BC+, and the second conductive path PT2 electrically connected to the negative electrode of the power supply BT or the second power supply connector BC−. The control unit 130 can control heat generation of the heater HT configured to heat the aerosol source using the voltage or power supplied from the power supply BT. The measurement circuit 100 can measure the state of the power supply BT using the first resistor R1 that can be arranged in the second conductive path PT2. The switch unit SWP can be arranged between the in first resistor R1 in the second conductive path PT2 and the negative electrode of the power supply BT (or the second power supply connector BC−) such that the current flowing to the second conductive path (and the first conductive path PT1) can be cut off. The protection circuit 90 can control the switch unit SWP to protect the power supply BT in accordance with the current flowing to the second conductive path PT2 and the potential of the positive electrode of the power supply BT supplied to the VBAT terminal. The protection circuit 90 can detect the current flowing to the second conductive path PT2 using the second resistor R2 arranged between the switch unit SWP in the second conductive path and the negative electrode of the power supply BT (or the second power supply connector BC−).

Aside from the switch unit SWP, the aerosol generation device AGD or the power supply unit PSU can include the switch SS that is arranged in the second conductive path PT2 such that the current flowing to the heater HT and the second conductive path can be cut off, and is usable as a cutoff switch. The control unit 130 can communicate with the measurement circuit 100 in accordance with a communication standard such as $I^2C$ communication. The control unit 130 can control the switch SS serving as a cutoff switch such that the current flowing to the second conductive path PT2 is cut off based on the measurement result by the measurement circuit 100.

Figure 15:
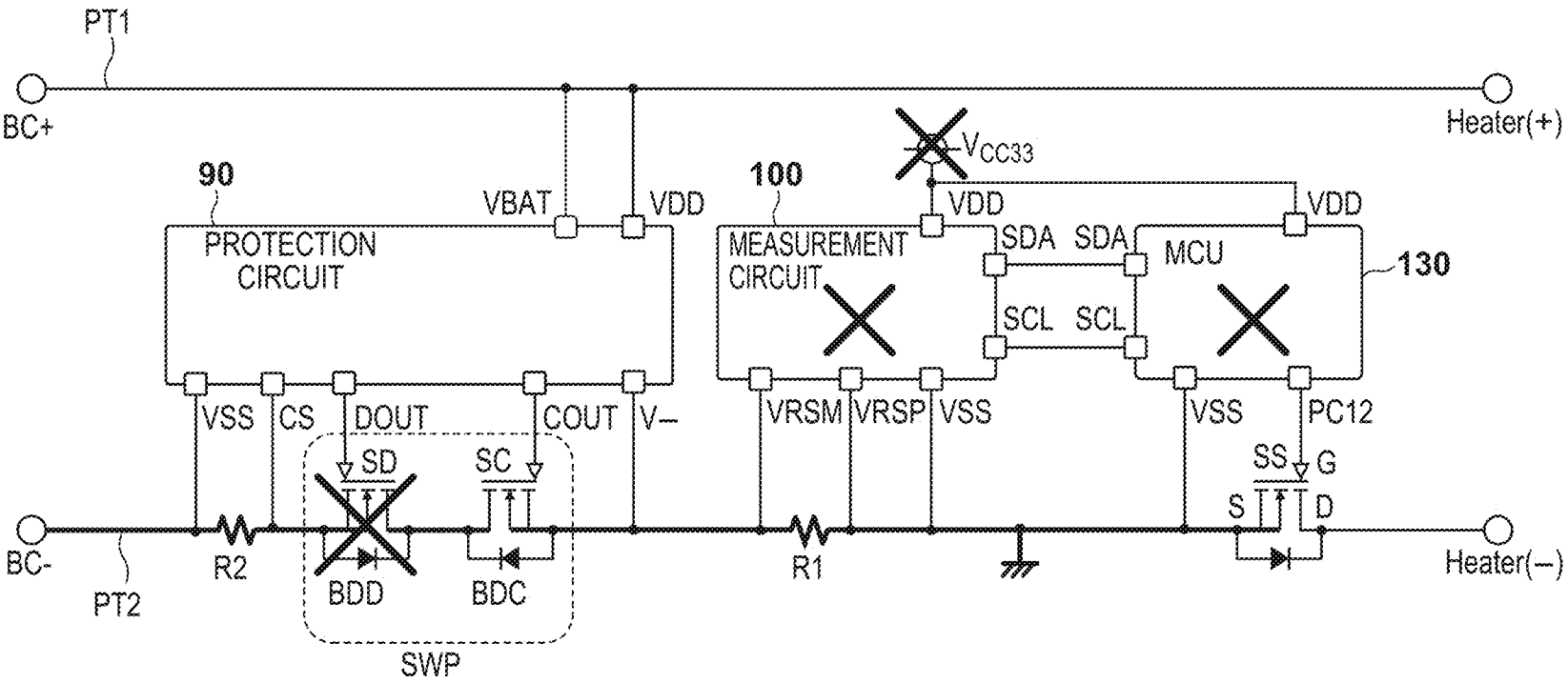
FIG. 15 is a view exemplifying the operations of the protection circuit, the measurement circuit, and the electronic components arranged on the periphery thereof.

FIG. 15 schematically shows a state in which the protection circuit 90 detects an overcurrent in discharge or the overdischarge state of the power supply BT and turns off the first transistor SD, and the second conductive path PT2 (the discharge path of the power supply BT) is cut off. The transformation circuit 30 can function as a voltage supply unit that supplies a voltage to the control unit 130 and the measurement circuit 100. To the transformation circuit 30 that can function as the voltage supply unit, a voltage or power can be supplied from the power supply BT via the first conductive path PT1 or the second conductive path PT2. If the current flowing to the second conductive path PT2 is cut off, the voltage between the positive electrode and the negative electrode of the power supply BT, that is, the power supply voltage is not supplied to the transformation circuit 30 functioning as the voltage supply unit that supplies the voltage to the control unit 130 and the measurement circuit 100. For this reason, the transformation circuit 30 can no longer output the voltage $V_{CC33_0}$ from the VOUT terminal. Hence, the supply of $V_{CC33}$ to the control unit 130 and the measurement circuit 100 by the load switch 40 also stops. Hence, the control unit 130 and the measurement circuit 100 stop the operation. At this time, the current consumed by the power supply unit PSU includes only the current that flows between the VBAT terminal and the VSS terminal for the protection circuit 90 to acquire the output voltage of the power supply BT and the current supplied to the VDD terminal (power supply terminal) for the operation of the protection circuit 90. This is a minute current.

On the other hand, in a configuration in which the position of the protection circuit 90 and the position of the measurement circuit 100 are interchanged, the current flowing between the VBAT terminal and the VSS terminal of the measurement circuit 100 is additionally consumed, and this current may cause further progress of overdischarge of the power supply BT or deep discharge of power supply BT. Hence, arranging the switch unit SWP controlled by the protection circuit 90 between the first resistor R1 in the second conductive path PT2 and the negative electrode of the power supply BT (second power supply connector BC−) is advantageous in the viewpoint of protecting the power supply BT.

Figure 16:
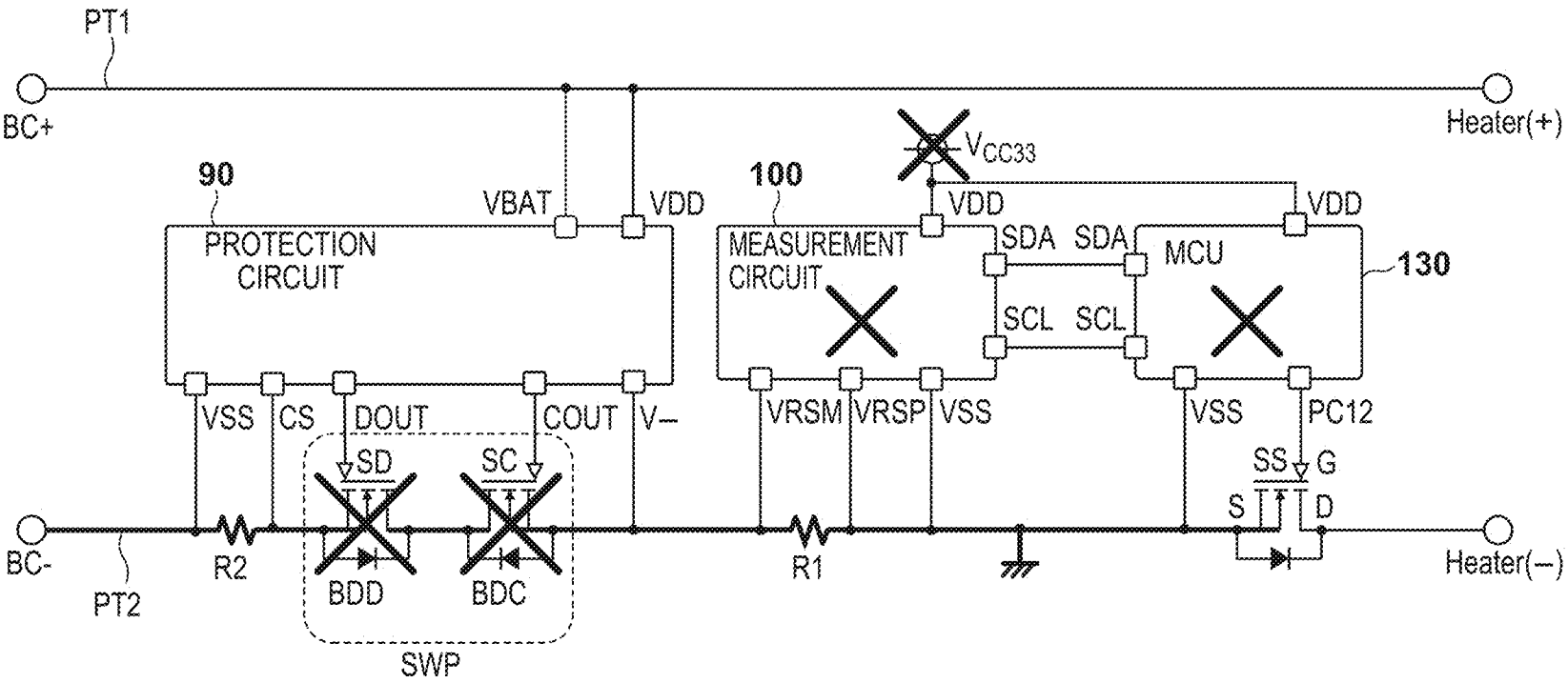
FIG. 16 is a view exemplifying the operations of the protection circuit, the measurement circuit, and the electronic components arranged on the periphery thereof.

The protection circuit 90 may be configured to, if the potential supplied from the power supply BT to the VBAT terminal of the protection circuit 90 indicates the possibility that the power supply BT is in an unrecoverable deep discharge state, fix the COUN terminal at low level and permanently fix the second transistor SC in the OFF state, as shown in FIG. 16. Since the power supply BT that may be in the deep discharge state thus becomes unchargeable, the safety of the power supply unit PSU or the aerosol generation device AGD can be improved. Alternatively, after the protection circuit 90 detects an overcurrent in discharge and turns off the first transistor SD, the protection circuit 90 may turn off the second transistor SC for a predetermined time, as shown in FIG. 16.

If an overcurrent in charge or the overcharge state of the power supply BT is detected, the protection circuit 90 can turn off the second transistor SC for a predetermined time. At this time, the protection circuit 90 may turn off the first transistor SD as well.

Figure 17:
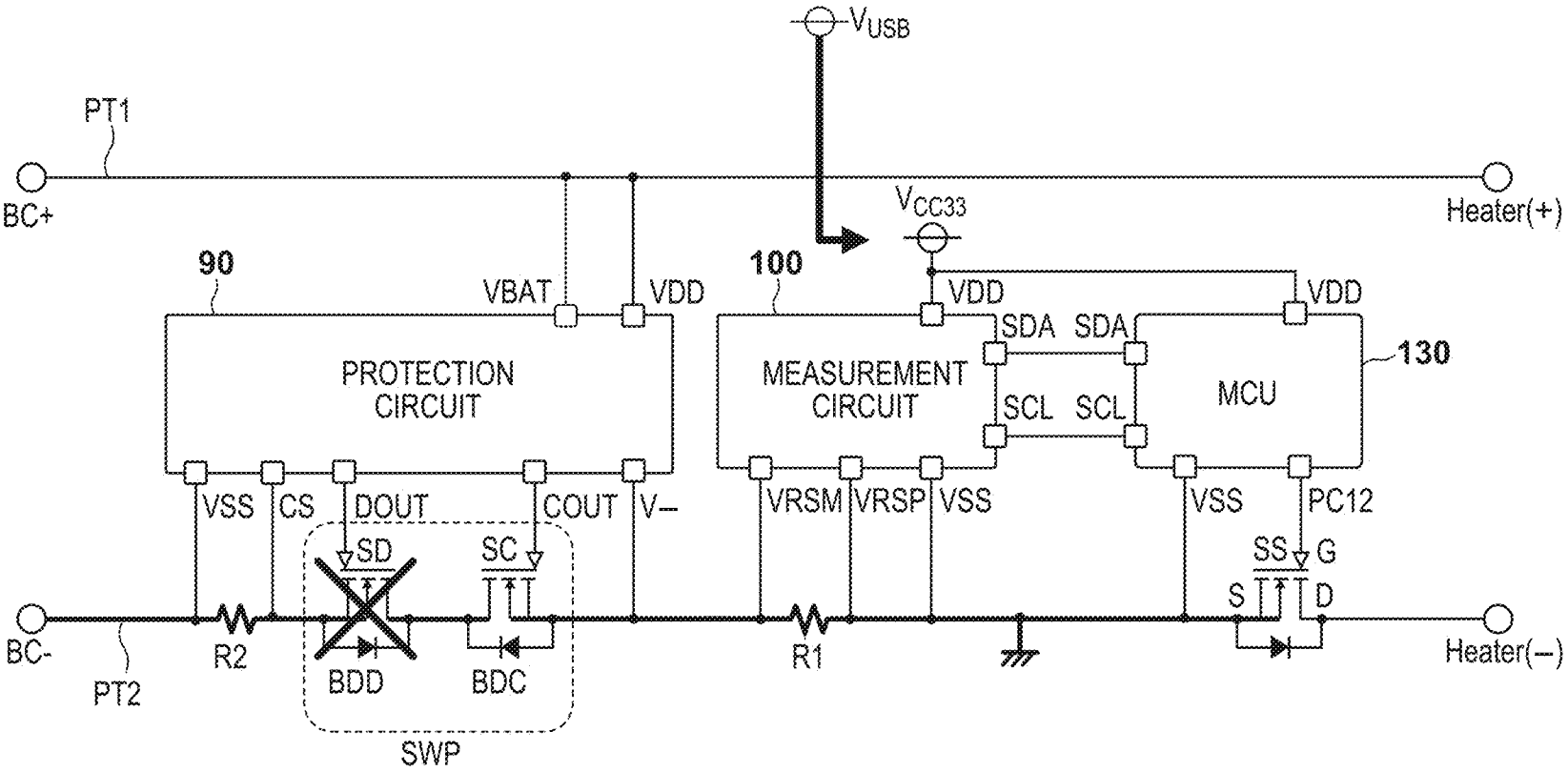
FIG. 17 is a view exemplifying the operations of the protection circuit, the measurement circuit, and the electronic components arranged on the periphery thereof.

FIG. 17 schematically shows a state in which the first transistor SD is turned off, and the USB cable is connected to the USB connector USBC. Here, connecting the USB cable to the USB connector USBC may be understood as connecting an external device to the USB connector USBC via the USB cable. At this time, the charge circuit 20 can operate in the first power-pass mode set by default. More specifically, in a state in which the SYS terminal and the BAT terminal are electrically disconnected, the charge circuit 20 can electrically connect the VBUS terminal and the SYS terminal, and supply the voltage $V_{CC}$ to the $V_{CC}$ line using the voltage $V_{CC5}$ supplied from the USB connector USBC via the $V_{CC5}$ line. Accordingly, the transformation circuit 30 functioning as the voltage supply unit that supplies the voltage to the control unit 130 and the measurement circuit 100 can supply the voltage $V_{CC33_0}$ to the $V_{CC33_0}$ line, and the load switch 40 can supply the voltage $V_{CC33}$ to the $V_{CC33}$ line. Thus, the voltage $V_{CC33}$ is supplied to the control unit 130 and the measurement circuit 100, and the control unit 130 and the measurement circuit 100 can start or resume the operation. That is, when an external device is connected to the aerosol generation device AGD or the power supply unit PSU, the transformation circuit 30 supplies the voltage $V_{CC33}$ to the control unit 130 and the measurement circuit 100 via the load switch 40, and the control unit 130 and the measurement circuit 100 can start or resume the operation. At this time, the control unit 130 can operate in the sleep mode.

Figure 18:
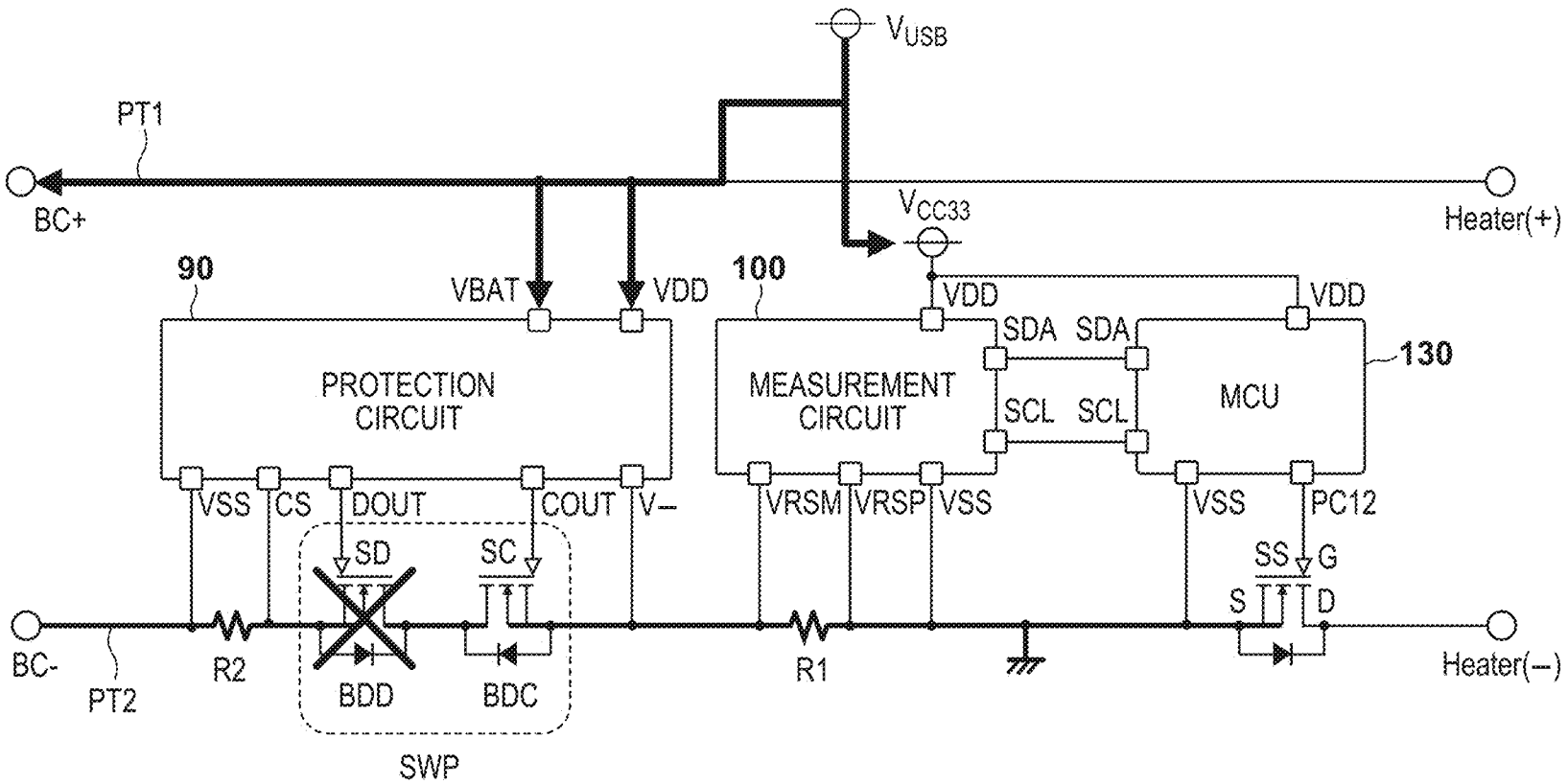
FIG. 18 is a view exemplifying the operations of the protection circuit, the measurement circuit, and the electronic components arranged on the periphery thereof.

The control unit 130 that has resumed the operation again can operate to acquire the output voltage of the power supply BT (the potential of the positive electrode) from the measurement circuit 100 and/or turn on the switch circuit 80 to acquire the potential of the power supply BT based on the potential supplied to the PC2 terminal. If the control unit 130 judges, based on the acquired potential, that the power supply BT is not in the deep discharge state, or judges that the power supply BT can be charged, low level is supplied from the PB3 terminal to the /CE terminal of the charge circuit 20 to shift the charge circuit 20 to the charge mode. Thus, as schematically shown in FIG. 18, the charge circuit 20 outputs a voltage for charging the power supply BT to between the BAT terminal and the GND terminal, and the power supply BT is charged. If it is judged that the power supply BT is not in the deep discharge state but in the overdischarge state, the charge circuit 20 preferably charges the power supply BT with a current smaller than in a case where the power supply BT is neither in the deep discharge state nor in the overdischarge state.

Figure 19:
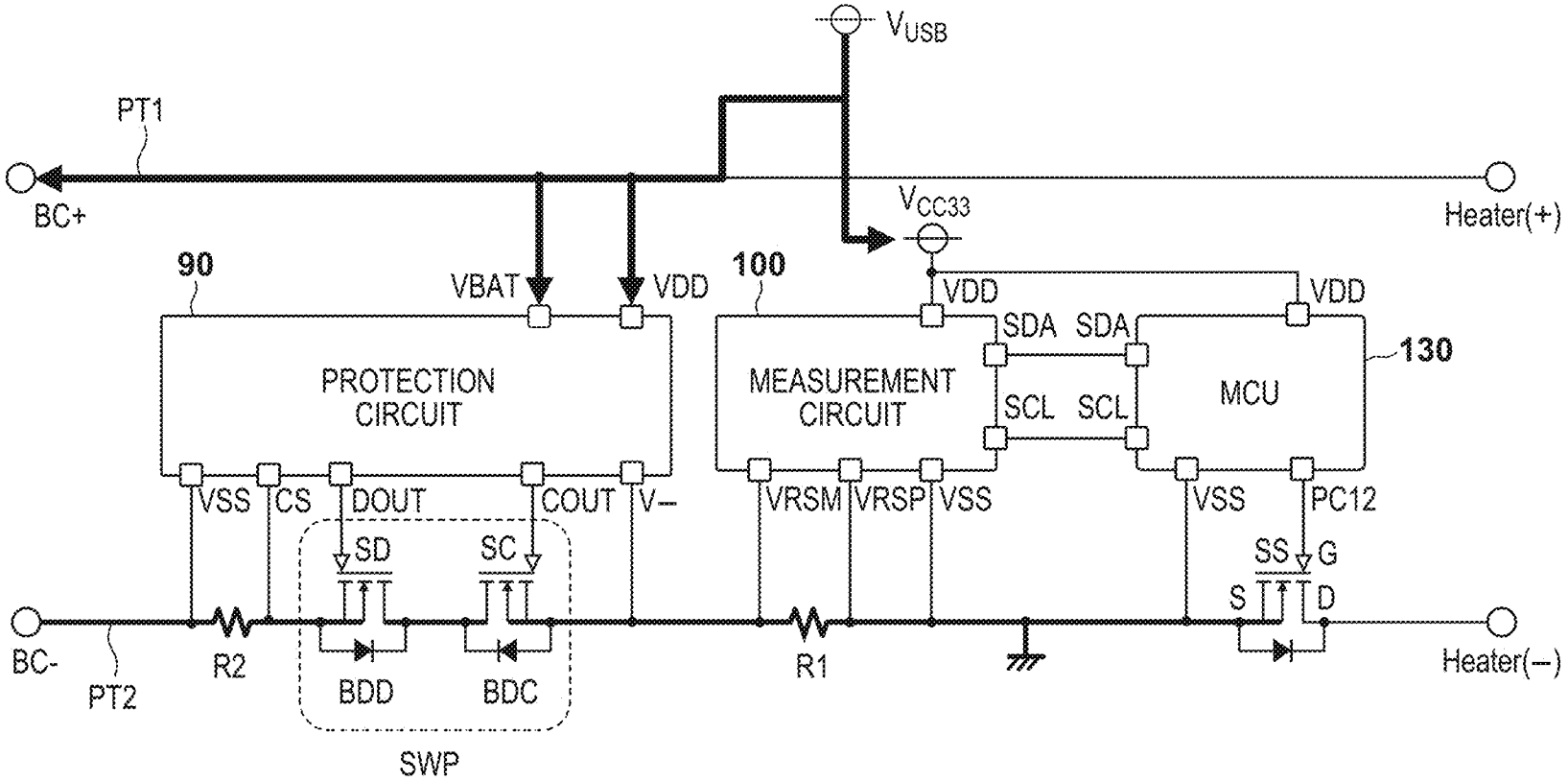
FIG. 19 is a view exemplifying the operations of the protection circuit, the measurement circuit, and the electronic components arranged on the periphery thereof.

If the residual capacity of the power supply BT is larger than a predetermined value, or if the residual capacity of the power supply BT exceeds a predetermined value due to charge, the protection circuit 90 can output high level from the DOUT terminal to turn on the first transistor SD, as schematically shown in FIG. 19. This is because it is judged that the residual capacity of the power supply BT is sufficiently recovered, and the power supply BT is not immediately set in the overdischarge state even if discharge is resumed.

In the configuration exemplified in FIGS. 14 to 19, the switch unit SWP can be arranged between the first resistor R1 used by the measurement circuit 100 to measure the state of the power supply BT and the second power supply connector BC− connected to the negative electrode of the power supply BT. According to this configuration, even in a state as shown in FIG. 17 in which the measurement circuit 100 and the control unit 130 operate by the voltage $V_{CC33}$ generated from the voltage $V_{USB}$ in the first power-pass mode, and the first transistor SD is off, the VSS terminal of the measurement circuit 100 and the VSS terminal of the control unit 130 are at equipotential. That is, the measurement circuit 100 and the control unit 130 can communicate via their VC interfaces. Also, in a state in which the first transistor SD is off, the first power supply connector BC+ and the second power supply connector BC− form a closed circuit only with the protection circuit 90. This makes it possible to make the protection of the power supply BT by the protection circuit 90 function as long as possible and suppress further discharge of the power supply BT to the utmost limits.

On the other hand, a configuration in which the measurement circuit 100 and the first resistor R1 are interchanged with the protection circuit 90, the second resistor R2, and the switch unit SWP from the configuration exemplified in FIGS. 14 to 19 will be examined. In this configuration, the switch unit SWP is provided between the VSS terminal of the measurement circuit 100 and the VSS terminal of the control unit 100. Hence, if the first transistor SD is turned off, the VSS terminal of the measurement circuit 100 and the VSS terminal of the control unit 130 are disconnected, and these are set at different potentials. Between the circuits whose VSS terminals to which a reference potential should be input receive different potentials, communication via the $I^2C$ interfaces is difficult. Also, in the state in which the first transistor SD is off, the first power supply connector BC+ and the second power supply connector BC− form a closed circuit not only with the protection circuit 90 but also with the measurement circuit 100. That is, further discharge of the power supply BT cannot be suppressed to the utmost limits.

Hence, the configuration exemplified in FIGS. 14 to 19 is advantages in the point that the communication via the $I^2C$ interface can satisfactorily be performed and in the point that the discharge of the power supply BT can be suppressed to the utmost limits, as compared to the configuration in which the measurement circuit 100 and the first resistor R1 are interchanged with the protection circuit 90, the second resistor R2, and the switch unit SWP from that configuration.

Figure 20:
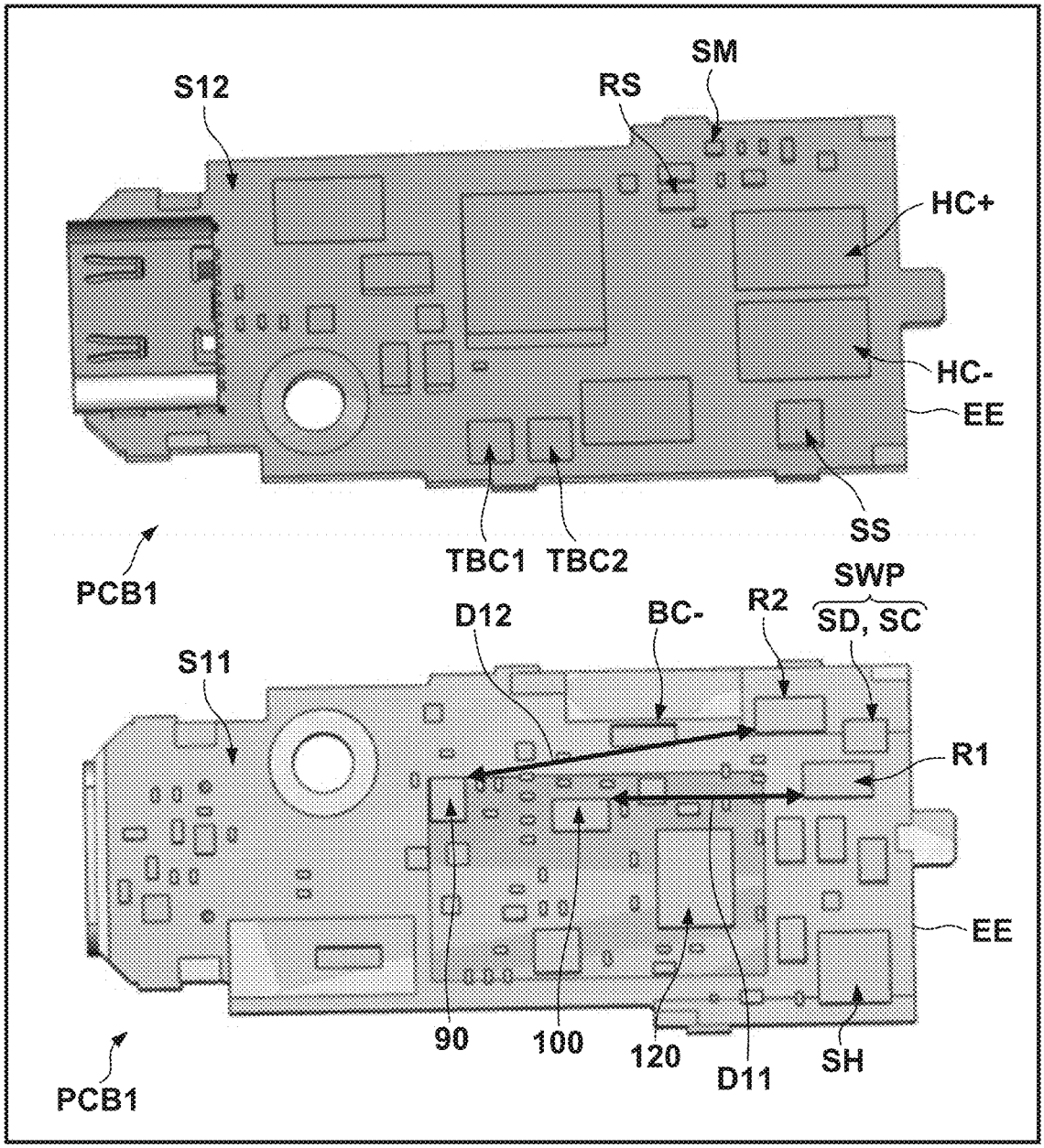
FIG. 20 is a view exemplifying the arrangement of the electronic components on a first board.

FIG. 20 shows an arrangement example of the electronic components on the first board PCB1. A shortest distance D11 between the first resistor R1 and the measurement circuit 100 is preferably smaller than a shortest distance D12 between the second resistor R2 and the protection circuit 90. Here, to calculate the state of the power supply BT, for example, the residual capacity and the SOC of the power supply BT at high accuracy, the measurement circuit 100 needs to detect and integrate the current flowing to the first resistor R1 at high accuracy. Hence, to eliminate the influence of parasitic resistances as much as possible, it is advantageous to make the shortest distance D11 between the first resistor R1 and the measurement circuit 100 as small as possible. On the other hand, the protection circuit 90 need only cut off the switch unit SWP if the current flowing to the second resistor R2 exceeds a threshold. Hence, the protection circuit 90 is more tolerable to noise than the measurement circuit 100. Hence, D11<D12 is one design guideline concerning how to arrange the electronic components in a limited board area. That is, D11<D12 is a condition in one viewpoint, and it is possible to provide a condition according to required accuracy or the specifications of the aerosol generation device AGD, such as D11<0.9×D12, D11<0.8×D12, D11<0.7×D12, D11<0.6×D12, D11<0.5×D12, D11<0.4×D12, D11<0.3×D12, D11<0.2×D12, or D11<0.1×D12.

The first resistor R1 and the measurement circuit 100 can be arranged on the same plane of the same board, for example, the first surface S11 of the first board PCB1. The configuration in which the first resistor R1 and the measurement circuit 100 are arranged on the same plane enables to connect these by a conductive path in the same plane without interposing a via or a through hole. This can reduce the parasitic resistance r2 existing between the first resistor R1 and the VRSP terminal of the measurement circuit 100 and the parasitic resistance r3 existing between the first resistor R1 and the VRSM terminal of the measurement circuit 100. Such reduction of the parasitic resistances enables accurate measurement of the state of the power supply BT by the measurement circuit 100. In addition, conductive patterns that connect the first resistor R1 and the VRSP terminal and the VRSM terminal of the measurement circuit 100 can be made short. Also, the length of the conductive pattern that connects the first resistor R1 and the VRSP terminal of the measurement circuit 100 and the length of the conductive pattern that connects the first resistor R1 and the VRSM terminal of the measurement circuit 100 can easily made substantially equal. These also enable accurate measurement of the state of the power supply BT by the measurement circuit 100.

The second resistor R2 and the protection circuit 90 can also be arranged on the same plane of the same board, for example, the first surface S11 of the first board PCB1. According to this configuration, the resistance value of the parasitic resistance r4 existing between the second resistor R2 and the CS terminal of the protection circuit 90 and the resistance value of the parasitic resistance r5 existing between the second resistor R2 and the VS S terminal of the protection circuit 90 can also be reduced. Such reduction of the resistance values of the parasitic resistances enables accurate protection of the power supply BT by the protection circuit 90.

In an example, the first resistor R1, the second resistor R2, the measurement circuit 100, and the protection circuit 90 can be arranged on the same plane of the same board, for example, the first surface S11 of the first board PCB1. According to this configuration, the resistance values of the parasitic resistances r2, r3, r4, and r5 can be reduced. This simultaneously enables accurately measurement of the state of the power supply BT by the measurement circuit 100 and accurate protection of the power supply BT by the protection circuit 90.

In another viewpoint, the first resistor R1, the second resistor R2, the measurement circuit 100, and the protection circuit 90 can be arranged on the same board, for example, the first board PCB1. The first board PCB1 includes an end portion EE on the side where the heater HT is arranged, and the shortest distance between the first resistor R1 and the end portion EE is preferably smaller than the shortest distance between the measurement circuit 100 and the end portion EE. The end portion of the board is predicted to receive external noise such as static electricity as compared to the center of the board. This is because external noise generally enters from the end portion of the board into the board. In particular, since the end portion EE is the end portion on the side where the heater HT is arranged, static electricity generated when inserting/removing an insertion object to/from the insertion hole C104 or opening/closing the slider C102 may enter. As for the center of the board, its entire periphery is surrounded by other electronic components, and these other electronic components serve as physical barriers to external noise. That is, according to this configuration, since the measurement circuit 100 is apart from the end portion EE, the measurement circuit 100 is hardly affected by external noise.

The shortest distance between the second resistor R2 and the end portion EE is preferably smaller than the shortest distance between the protection circuit 90 and the end portion EE. According to this configuration, since the protection circuit 90 is apart from the end portion EE, the protection circuit 90 is hardly affected by external noise.

These provide an example in which an idea to arrange the first resistor R1 and the second resistor R2 close to the end portion EE of the first board PCB1 is embodied.

The shortest distance between the measurement circuit 100 and the end portion EE is preferably smaller than the shortest distance between the protection circuit 90 and the end portion EE. The protection circuit 90 inhibits charge and/or discharge when an abnormality occurs in the power supply BT, thereby playing a role of protecting the power supply BT and the aerosol generation device AGD. In other words, the protection circuit 90 is more important than the measurement circuit 100. According to this configuration, the protection circuit 90 is apart from the end portion EE and is therefore hardly affected by external noise. This improves the safety of the aerosol generation device AGD.

On the first board PCB1, the first heater connector HC+ to which the positive-side terminal of the heater HT is electrically connected and the second heater connector HC− to which the negative-side terminal of the heater HT is electrically connected can be arranged. The shortest distance between the first heater connector HC+ and the end portion EE and the shortest distance between the second heater connector HC− and the end portion EE are preferably smaller than the shortest distance between the measurement circuit 100 and the end portion EE. This configuration is advantageous from the viewpoint of protecting the measurement circuit 100 from external noise.

The first resistor R1 and the second resistor R2 can be arranged on the first surface S11 of the first board PCB1, and the first heater connector HC+ and the second heater connector HC− can be arranged on the second surface S12 of the first board PCB1. This configuration is advantageous from the viewpoint of efficiently arranging the electronic components on the first surface S11 and the second surface S12 of the first board PCB1. In other words, if these electronic components having relatively large sizes are arranged together on one of the first surface S11 and the second surface S12, the board area of the first board PCB1 may become large, or there may be large restrictions on formation of a conductive pattern or arrangement of the other electronic components.

In an orthographic projection to the first surface S11, at least a part of the second heater connector HC− can be arranged to overlap at least a part of at least one of the first resistor R1 and the second resistor R2. Alternatively, unlike the example shown in FIG. 20, in the orthographic projection, at least a part of the first heater connector HC+ may be arranged to overlap at least a part of at least one of the first resistor R1 and the second resistor R2. This configuration is also advantageous from the viewpoint of efficiently arranging the electronic components on the first surface S11 and the second surface S12 of the first board PCB1.

The switch unit SWP can be arranged on the first surface S11 of the first board PCB1. This configuration is also advantageous from the viewpoint of efficiently arranging the electronic components on the first surface S11 and the second surface S12 of the first board PCB1.

The switch SS that is controlled by the control unit 130 and is usable as a cutoff switch that cuts off the current flowing through the heater HT can be arranged in the path that electrically connects the second heater connector HC− and the first resistor R1. As described above, by the switch SS, static electricity and noise that can enter from the heater HT, the first heater connector HC+, and the second heater connector HC− hardly enter the first resistor R1 or the second conductive path PT2.

The switch SS can be arranged on the second surface S12 of the first board PCB1. This configuration is also advantageous from the viewpoint of efficiently arranging the electronic components on the first surface S11 and the second surface S12 of the first board PCB1.

The shortest distance between the switch SS and the end portion EE is preferably smaller than the shortest distance between the measurement circuit 100 and the end portion EE. According to this configuration, since the measurement circuit 100 is apart from the end portion EE, and the switch SS serves as a physical barrier to external noise, the measurement circuit 100 is hardly affected by external noise.

The switch SH that is arranged in the path for electrically connecting the output of the transformation circuit 120 and the first heater connector HC+ and functions as a heater switch can be arranged on the first board PCB1. The shortest distance between the switch SH and the end portion EE is preferably smaller than the shortest distance between the measurement circuit 100 and the end portion EE. According to this configuration, since the measurement circuit 100 is apart from the end portion EE, and the switch SH serves as a physical barrier to external noise, the measurement circuit 100 is hardly affected by external noise.

Note that the switch SH can be switched at a high speed by the PWM (Pulse Width Modulation) method or the PFM (Pulse Frequency Modulation) method such that the temperature of the heater HT is maintained at a target temperature. Large power for causing the heater HT to generate heat is supplied to the switch SH, and the switch SH can be switched at a high speed.

The switch SH can be arranged on the first surface S11 of the first board PCB1. In the orthographic projection to the first surface S11 of the first board PCB1, at least a part of the switch SH can be arranged to overlap at least a part of at least a part of the first heater connector HC+. This configuration is advantageous in reducing the parasitic resistance between the switch SH and the first heater connector HC+. Alternatively, unlike the example shown in FIG. 20, in the orthographic projection, at least a part of the switch SH may be arranged to overlap at least a part of the second heater connector HC−.

In this configuration, the shortest distance between the first resistor R1 and the second resistor R2 may be smaller than at least one of the maximum size of the first resistor R1 and the maximum size of the second resistor R2. This configuration is also advantageous from the viewpoint of efficiently arranging the electronic components on the first surface S11 and the second surface S12 of the first board PCB1.

Figure 21:
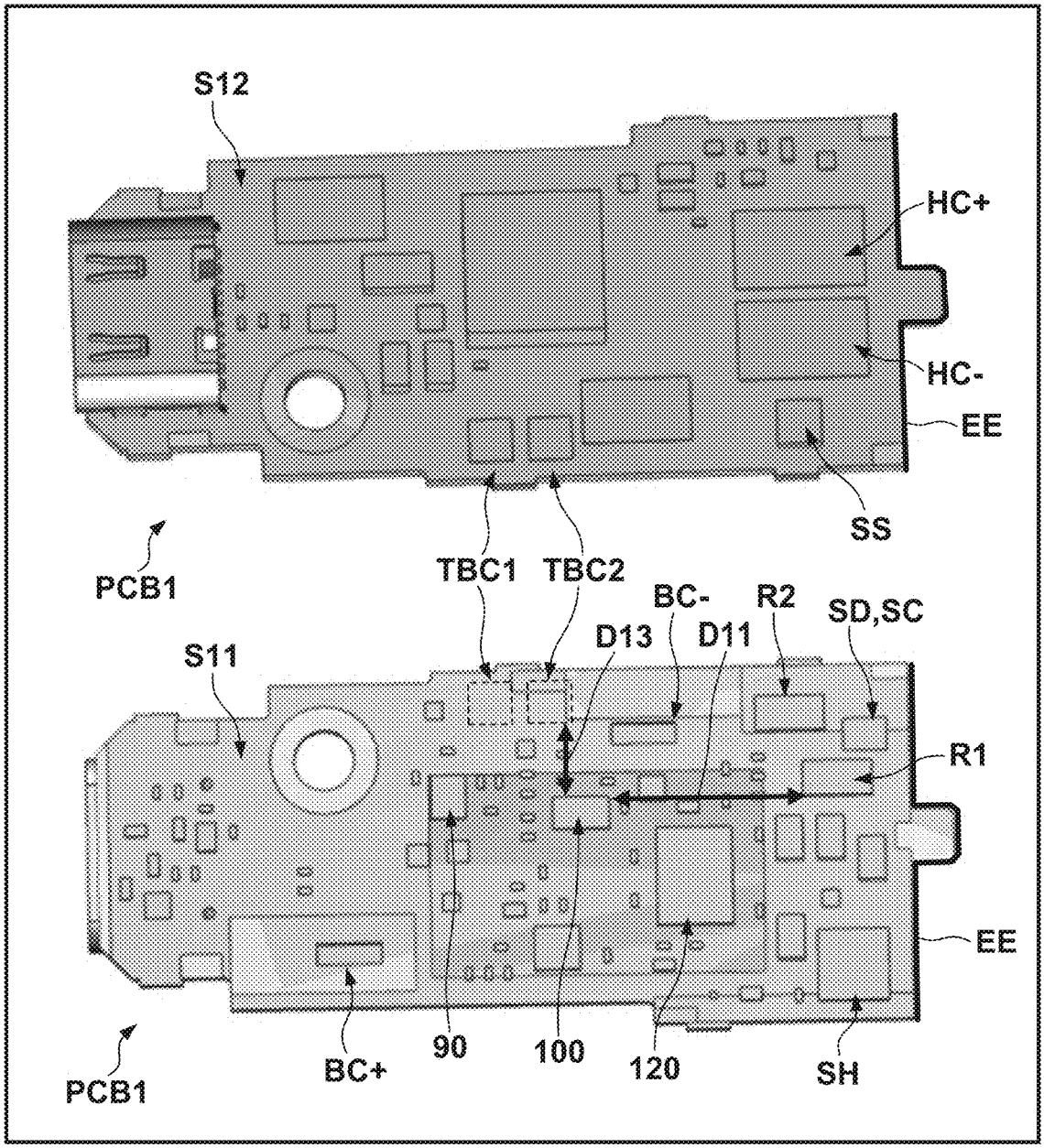
FIG. 21 is a view exemplifying the arrangement of the electronic components on a first board.

FIG. 21 shows an arrangement example of the electronic components on the first board PCB1. The thermistor TB configured to measure the temperature of the power supply BT includes two terminals, and these can electrically be connected to two thermistor connectors TBC1 and TBC2, respectively. The measurement circuit 100 can be configured to measure the state (for example, the residual capacity and the SOC) of the power supply BT using the first resistor R1 and measure the temperature of the power supply BT using the thermistor TB.

The first resistor R1, the two thermistor connectors TBC1 and TBC2, and the measurement circuit 100 can be arranged on the first board PCB1. In one aspect, a shortest distance D13 between the two thermistor connectors TBC1 and TBC2 and the measurement circuit 100 is preferably smaller than the shortest distance D11 between the first resistor R1 and the measurement circuit 100. Both the first resistor R1 and the thermistor TB connected to the two thermistor connectors TBC1 and TBC2 are important parameters used to measure the state of the power supply BT by the measurement circuit 100. An error readily occurs in the temperature of the power supply BT indirectly acquired from the resistance value of the thermistor TB, unlike the first resistor R1. According to this configuration, at least when the measurement circuit 100 acquires the temperature of the power supply BT, the error caused by the parasitic resistance can be reduced. Thus, the measurement circuit 100 can acquire the parameters necessary for measuring the state of the power supply BT from the first resistor R1 and the thermistor TB in a state with little error.

For example, among all the components forming the aerosol generation device AGD or the power supply unit PSU, the power supply BT can be a component with the largest volume. The power supply BT can account for 20% or more, 25% or more, or 30% or more the volume of the aerosol generation device AGD or the power supply unit PSU. The thermistor TB can be arranged along at least a part of the side surface of the power supply BT. The thermistor TB can be arranged between the outer case C101 and the power supply BT or near the inner side surface of the outer case C101. Considering this point, arranging the thermistor connectors TBC1 and TBC2 to which the thermistor TB is electrically connected near the outer edge of the whole region (effective region) of the first board PCB1 is effective for efficiently using the space. In other words, if the thermistor connectors TBC1 and TBC2 are arranged at the center of the first board PCB1 or near that, it is disadvantageous from the viewpoint of arrangement of other electronic components, formation of a conductive pattern on the board surface, and formation of a ground layer in the board.

The measurement circuit 100 can measure or detect the temperature of the power supply BT by measuring the resistance value of the thermistor TB, and calculate the residual quantity (for example, the residual capacity and the SOC) of the power supply BT using the temperature as one parameter value. Hence, correctly measuring the temperature of the power supply BT is important to correctly measure the residual quantity of the power supply BT. Also, an increase of the distance between the thermistor connectors TBC1 and TBC2 and the measurement circuit 100 causes an increase of the parasitic resistance of the conductive path that electrically connects the thermistor connectors TBC1 and TBC2 and the measurement circuit 100, and this may lower the measurement accuracy of the temperature of the power supply BT.

Providing arrangement restrictions to make the shortest distance D13 between the thermistor connectors TBC1 and TBC2 and the measurement circuit 100 as small as possible is an advantageous design concept concerning how to arrange the electronic components in a limited board area. That is, D13<D11 is a condition in one viewpoint. For example, it is possible to provide a condition according to required accuracy or the specifications of the aerosol generation device AGD, such as D13<0.9×D11, D13<0.8×D11, D13<0.7×D11, D13<0.6×D11, D13<0.5×D11, D13<0.4×D11, D13<0.3×D11, D13<0.2×D11, or D13<0.1×D11.

The measurement circuit 100 can include a first function of providing information representing the temperature of the power supply BT to the control unit 130, and a second function of notifying the control unit 130 of an abnormality of the temperature of the power supply BT. The control unit 130 can be configured to stop at least one of discharge of the power supply BT and charge of the power supply BT in response to a notification from the measurement circuit 100 by the second function. According to these configurations, the measurement circuit 100 can not only provide information representing the temperature of the power supply BT to the control unit 130 in response to polling from the control unit 130 but also notify the control unit 130 of the abnormality of the temperature of the power supply BT without waiting for polling from the control unit 130. This makes it possible to protect the power supply BT and the aerosol generation device AGD if the temperature of the power supply BT is abnormal while suppressing power consumption of the control unit 130 and the measurement circuit 100 in a case where the temperature of the power supply BT is not abnormal.

The measurement circuit 100 can calculate the residual quantity (for example, the residual capacity and the SOC) of the power supply BT based on information (for example, an integrated current amount) obtained using the first resistor R1 and information obtained using the thermistor TB. The residual quantity of the power supply BT depends not only on the information (for example, the integrated current amount) obtained using the first resistor R1 but also on the temperature of the power supply BT. According to this configuration, the measurement circuit 100 can accurately calculate the residual quantity (for example, the residual capacity and the SOC) of the power supply BT.

The two terminals of the thermistor TB can directly be connected to the two thermistor connectors TBC1 and TBC2, respectively. In other words, the two terminals of the thermistor TB can be connected to the two thermistor connectors TBC1 and TBC2, respectively, without interposing a conductive line, an active element, or a passive element. This conforms an idea of reducing the parasitic resistance value between the thermistor connectors TBC1 and TBC2 and the two terminals of the thermistor TB.

The thermistor TB is arranged to at least partially surround the periphery of the power supply BT, and this is advantages in measuring the average temperature of the surface of the power supply BT in a case where the power supply BT has an adequate temperature distribution. In an example, the power supply BT can have a columnar shape, and the thermistor TB can include an arc-shaped portion along the columnar shape of the power supply BT. In another example, the power supply BT can have a square shape, and the thermistor TB can have a structure or shape conforming to the square shape of the power supply BT.

The measurement circuit 100 and the first resistor R1 can be arranged on the same surface of the first board PCB1, for example, the first surface S11 or the second surface S12. According to this configuration, the state of the power supply BT can accurately be measured by the measurement circuit 100, as described above. Instead, the measurement circuit 100 and the first resistor R1 may be arranged on different surfaces of the first board PCB1.

The distance between the geometric center of a figure (closed figure) formed by the outer edge of the first board PCB1 and the geometric center of the measurement circuit 100 is preferably smaller than the distance between the geometric center of the figure and the first resistor R1. Alternatively, the distance between the geometric center of the figure (closed figure) formed by the outer edge of the first board PCB1 and the geometric center (or area centroid) of the measurement circuit 100 is preferably smaller than the shortest distance between the geometric center of the figure and the two thermistor connectors TB1 and TB2. Alternatively, the distance between the geometric center of the figure (closed figure) formed by the outer edge of the first board PCB1 and the geometric center of the measurement circuit 100 is preferably smaller than the shortest distance between the geometric center of the figure and the first resistor R1 and smaller than the shortest distance between the geometric center of the figure and the two thermistor connectors TBC1 and TBC2. The outer edge of the board is more readily affected by external noise such as static electricity than the geometric center of the board. Hence, this configuration is advantageous in making the precise continuous circuit 100 hard to be affected by noise.

The two power supply connectors connected to the power supply BT, that is, the first power supply connector BC+ and the second power supply connector BC− can be arranged on the first board PCB1. The distance between the geometric center of the figure (closed figure) formed by the outer edge of the first board PCB1 and the geometric center of the measurement circuit 100 is preferably smaller than the shortest distance between the two power supply connectors BC+ and BC−. According to this configuration, a bus bar connected to the two power supply connectors BC+ and BC− serves as a physical barrier to external noise that enters from the outer edge of the board. The bus bar is suitable as a physical barrier because the bus bar to which a large current flows is thick. Hence, the measurement circuit 100 is more hardly affected by noise.

The control unit 130 can be arranged on a board different from the first board PCB1 on which the first resistor R1, the two thermistor connectors TB1 and TB2, and the measurement circuit 100 are arranged, for example, the second board PCB2. The measurement circuit 100 and the control unit 130 may each be a noise generation source because many operations are performed inside. When these are arranged on different boards, noise generated in one of them hardly affects the other.

FIG. 22 exemplifies functions associated with protection of the power supply BT. The columns of "measurement circuit", "charge circuit", and "protection circuit" in FIG. 22 show functions that can be provided by the measurement circuit 100, the charge circuit 20, and the protection circuit 90, respectively. The column of "$I^2C$" in "measurement circuit" exemplifies conditions when the control unit 130 executes error processing based on information provided from the measurement circuit 100 to the control unit 130 via the $I^2C$ interface. The column of "nGAUGE_INT1" exemplifies an nGAUGE_INT1 signal output from the ALERT terminal of the measurement circuit 100. The column of "nGAUGE_INT2" exemplifies an nGAUGE_INT2 signal output from the 105 terminal of the measurement circuit 100. The column of "charge circuit" ("$I^2C$") exemplifies conditions when the control unit 130 executes error processing based on information provided from the charge circuit 20 to the control unit 130 via the $I^2C$ interface. The column of "protection circuit" exemplifies conditions for the protection circuit 90 to set the switch unit SWP in a cutoff state.

The control unit 130 can acquire information representing the charge current during charge of the power supply BT, the discharge current during discharge of the power supply BT, the voltage of the power supply BT, and the temperature of the power supply BT at the time of discharge and charge of the power supply BT from the measurement circuit 100 by polling via the $I^2C$ interface. For example, if the charge current acquired by the measurement circuit 100 is 1.1 times or more a set value, the control unit 130 can execute error processing. The set value may be a charge current value in constant current (CC) charge of CCCV (constant current−constant voltage) charge executed by the charge circuit 20. Also, if the temperature of the power supply BT at the time of discharge of the power supply BT is 55° C. or more, the control unit 130 can execute error processing. Also, if the temperature of the power supply BT at the time of charge of the power supply BT is 51° C. or more, the control unit 130 can execute error processing. Also, for example, if the temperature of the power supply BT at the time of charge is 0° C. or less, the control unit 130 can execute error processing. The control unit 130 can, for example, periodically monitor the discharge current from the power supply BT and the positive electrode potential of the power supply BT via the VC interface, and judge, based on these, whether the power supply BT is in the deep discharge state. In the table shown in FIG. 22, the condition to judge whether the deep discharge state is set is shown as "internal algorithm". Details of the "internal algorithm" will be described later.

For example, upon detecting one of a state in which the discharge current from the power supply BT is 10 A or more, a state in which the charge current of the power supply BT is 3.0 A or more, and a state in which the temperature at the time of discharge from the power supply BT is 60° C. or more for 2 sec, the measurement circuit 100 can change the nGAUGE_INT1 signal to the active level. The active level of the nGAUGE_INT1 signal is, for example, low level.

Also, upon detecting one of a state in which the discharge current from the power supply BT is 9.75 A or more, a state in which the charge current of the power supply BT is 2.75 A or more, a state in which the temperature at the time of discharge from the power supply BT is 85° C. or more for 2 min, a state in which the temperature at the time of charge of the power supply BT is 85° C. or more for 2 min, a state in which the temperature at the time of discharge from the power supply BT is −5° C. or less for 5 sec, a state in which the positive electrode potential of the power supply BT at the time of charge of the power supply BT is 4.235 V or more, and a state in which the positive electrode potential of the power supply BT at the time of discharge from the power supply BT is 2.8 V or less, the measurement circuit 100 can change the nGAUGE_INT2 signal to the active level. The active level of the nGAUGE_INT2 signal is, for example, low level. The positive electrode potential of the power supply BT acquired by the measurement circuit 100 corresponds to the difference between the positive electrode potential of the power supply BT and the potential of the VSS terminal. Since both the VSS terminal of the measurement circuit 100 and the second power supply connector BC− are connected to the ground line, the positive electrode potential of the power supply BT acquired by the measurement circuit 100 corresponds to the output voltage of the power supply BT.

Also, the control unit 130 can acquire information representing the potential of the BAT terminal (the positive electrode potential of the power supply BT) at the time of charge of the power supply BT from the charge circuit 20 by polling via the $I^2C$ interface. The potential of the BAT terminal (the positive electrode potential of the power supply BT) acquired by the charge circuit 20 corresponds to the difference between the potential of the BAT terminal (the positive electrode potential of the power supply BT) and the potential of the GND terminal. Since both the GND terminal of the charge circuit 20 and the second power supply connector BC− are connected to the ground line, the potential of the BAT terminal (the positive electrode potential of the power supply BT) acquired by the charge circuit 20 corresponds to the output voltage of the power supply BT. For example, if the potential of the BAT terminal (the positive electrode potential of the power supply BT) at the time of charge is 4.343 V or more, the control unit 130 can execute error processing.

For example, if the discharge current from the power supply BT is 12.67 A or more, the protection circuit 90 can change the first transistor SD to the cutoff state. The protection circuit 90 can acquire the positive electrode potential of the power supply BT based on the input to the VBAT terminal. The positive electrode potential of the power supply BT acquired by the protection circuit 90 corresponds to the difference between the positive electrode potential of the power supply BT and the potential of the V− terminal. Since both the V− terminal of the protection circuit 90 and the second power supply connector BC− are connected to the ground line, the positive electrode potential of the power supply BT acquired by the protection circuit 90 corresponds to the output voltage of the power supply BT. For example, if the positive electrode potential of the power supply BT at the time of charge of the power supply BT is 4.28 V or more, the protection circuit 90 can change the second transistor SC to the cutoff state. Also, for example, if the positive electrode potential of the power supply BT at the time of discharge from the power supply BT is 2.5 V or less, the protection circuit 90 can change the first transistor SD to the cutoff state. The state in which the positive electrode potential of the power supply BT at the time of charge of the power supply BT is 4.28 V or more corresponds to the above-described overcharge state of the power supply BT. The state in which the positive electrode potential of the power supply BT at the time of charge of the power supply BT is 2.5 V or less corresponds to the above-described overdischarge state of the power supply BT.

Figure 23:
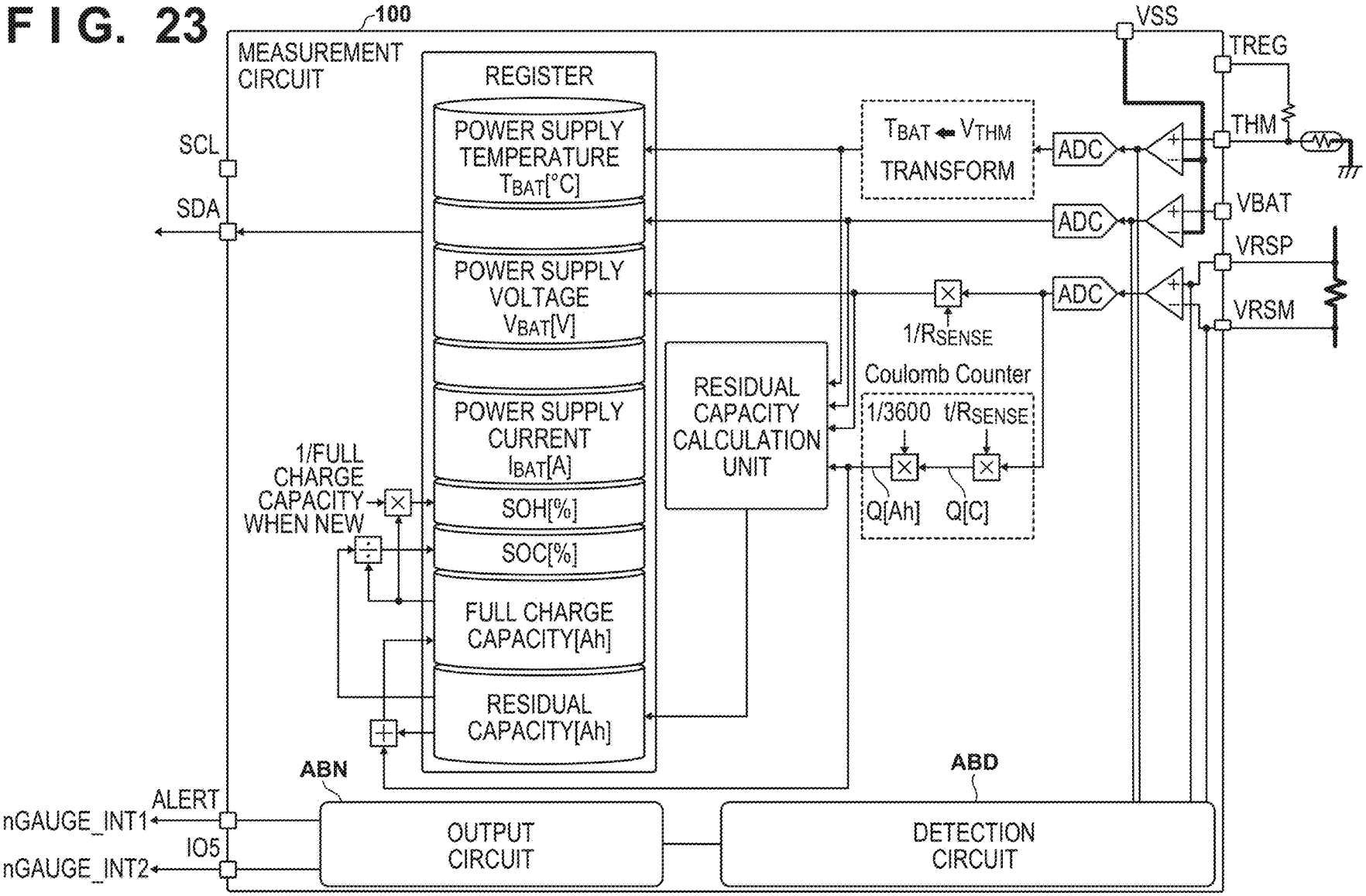
FIG. 23 is a view schematically showing an example of the configuration of the measurement circuit configured to implement the functions of the measurement circuit shown in FIG. 22.

FIG. 23 schematically shows an example of the configuration of the measurement circuit 100 configured to implement the functions of the measurement circuit 100 shown in FIG. 22. The measurement circuit 100 can include, for example, a detection circuit ABD configured to detect that the state of the power supply BT is an abnormal state, and an output unit ABN configured to output an abnormality notification in response to the detection by the detection circuit ABD. The detection circuit ABD can include a first detection logic circuit that individually detects a state in which the discharge current from the power supply BT is 10 A or more, a state in which the charge current of the power supply BT is 3.0 A or more, and a state in which the temperature at the time of discharge from the power supply BT is 60° C. or more for 2 sec. The output unit ABN can include a first output logic circuit that, if the first detection logic circuit detects at least one of these states, changes the nGAUGE_INT1 signal to the active level as an operation of outputting an abnormality notification.

Also, the measurement circuit 100 can include a second detection logic circuit that individually detects one of a state in which the discharge current from the power supply BT is 9.75 A or more, a state in which the charge current of the power supply BT is 2.75 A or more, a state in which the temperature at the time of discharge from the power supply BT is 85° C. or more for 2 min, a state in which the temperature at the time of charge of the power supply BT is 85° C. or more for 2 min, a state in which the temperature at the time of discharge from the power supply BT is −5° C. or less for 5 sec, a state in which the positive electrode potential of the power supply BT at the time of charge of the power supply BT is 4.235 V or more, and a state in which the positive electrode potential of the power supply BT at the time of discharge from the power supply BT is 2.8 V or less. The output unit ABN can include a second output logic circuit that, if the second detection logic circuit detects at least one of these states, changes the nGAUGE_INT2 signal to the active level as an operation of outputting an abnormality notification.

Figure 24:
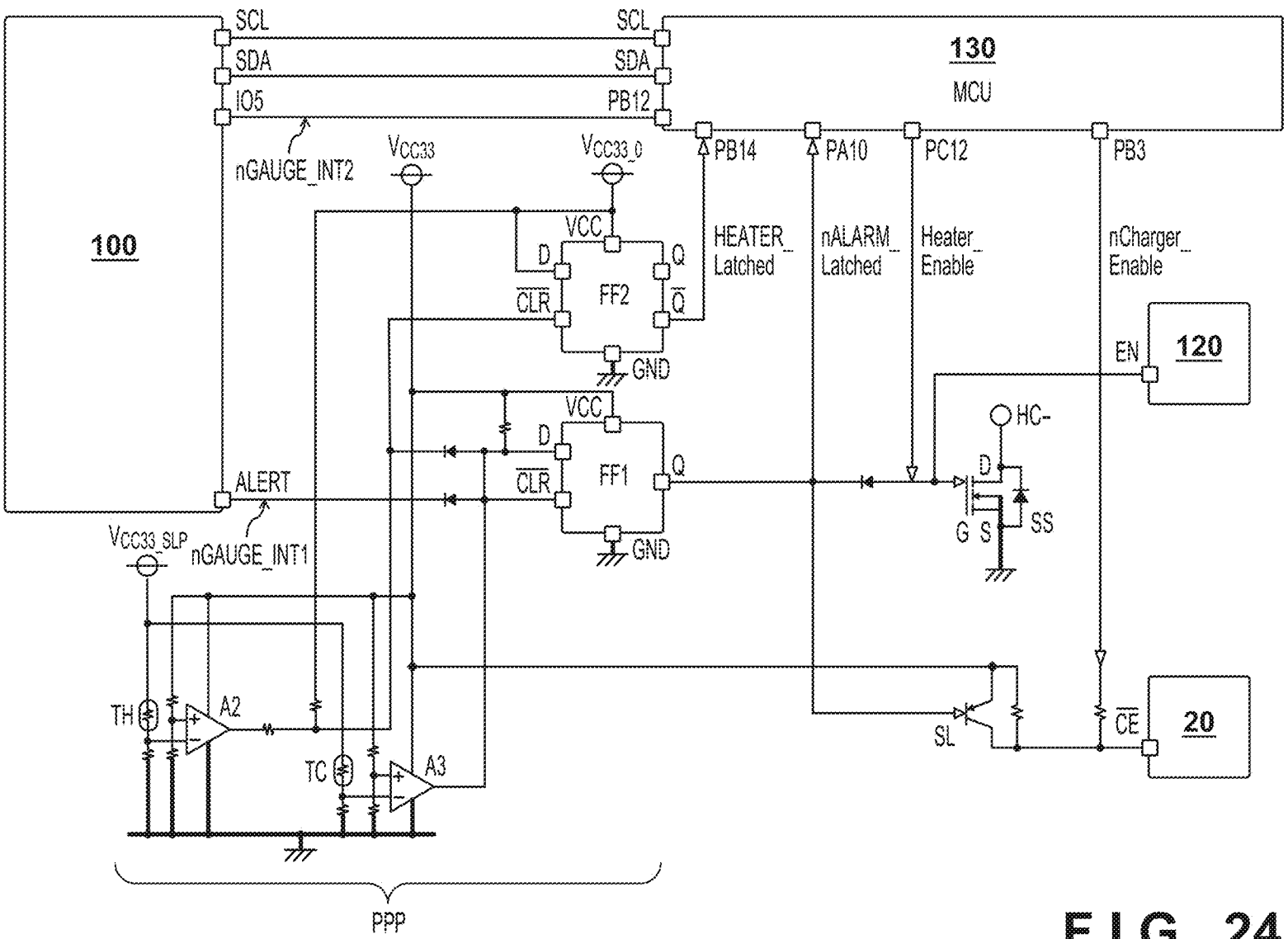

FIG. 24 shows an example of connection of the measurement circuit 100, the control unit 130, the transformation circuit 120, the charge circuit 20, the information holding circuits FF1 and FF2, the OP amplifiers A2 and A3, and the like. The control unit 130 can be configured to control supply of power to the heater HT configured to heat the aerosol source using power supplied from the power supply BT and charge of the power supply BT.

The measurement circuit 100 can be configured to measure the state (For example, the residual capacity, the SOC, and the temperature) of the power supply BT. As shown in FIG. 23, the measurement circuit 100 can include the detection circuit ABD configured to detect that the power supply BT is in the abnormal state, and the output unit ABN configured to output an abnormality notification in response to the detection by the detection circuit ABD. The output unit ABN can be configured to, for example, output a first abnormality signal by changing the nGAUGE_INT1 signal output from the ALERT terminal to the active level (here, low level) and output a second abnormality signal by changing the nGAUGE_INT2 signal output from the 105 terminal to the active level (here, low level). The measurement circuit 100 can include an interface configured to provide state information concerning the state of the power supply BT to the control unit 130 in response to a request from the control unit 130, for example, the $I^2C$ interface. The $I^2C$ interface can be formed by an SCL terminal and an SDA terminal different from the ALERT terminal and the 105 terminal.

The control unit 130 can be configured to execute a protection operation for protecting the power supply BT in accordance with the abnormality notification and the state information. The protection operation can include, for example, inhibiting charge of the power supply BT and/or inhibiting discharge from the power supply BT to the heater HT.

The output circuit ABN of the measurement circuit 100 can output the abnormality notification in accordance with at least one of a state in which the charge current of the power supply BT exceeds a first reference value and a state in which the discharge current from the power supply BT exceeds a second reference value. In the example shown in FIG. 22, if the charge current of the power supply BT is 3.0 A or more, the output circuit ABN of the measurement circuit 100 changes the nGAUGE_INT1 signal to the active level (here, low level) as the output of the abnormality notification. Also, if the discharge current from the power supply BT is 10 A or more, the output circuit ABN of the measurement circuit 100 changes the nGAUGE_INT1 signal to the active level (here, low level) as the output of the abnormality notification. If the discharge current from the power supply BT is 9.75 A or more, the output circuit ABN of the measurement circuit 100 changes the nGAUGE_INT2 signal to the active level (here, low level) as the output of the abnormality notification. If the charge current of the power supply BT is 2.75 A or more, the output circuit ABN of the measurement circuit 100 changes the nGAUGE_INT2 signal to the active level (here, low level) as the output of the abnormality notification.

In response to the change of the nGAUGE_INT2 signal to the active level (here, low level), the control unit 130 can acquire state information from the measurement circuit 100 via the VC interface. The state information can include at least one of information used by the control unit 130 to judge whether to shift to the above-described permanent failure mode and information indicating the shift to the permanent failure mode. For example, in the example shown in FIG. 22, if the state information acquired from the measurement circuit 100 via the FC interface indicates that the temperature at the time of discharge from the power supply BT is 85° C. or more for 2 min or that the temperature at the time of charge of the power supply BT is 85° C. or more for 2 min, the control unit 130 can judges to shift to the permanent failure mode. Alternatively, if the temperature at the time of discharge from the power supply BT is 85° C. or more for 2 min, or the temperature at the time of charge of the power supply BT is 85° C. or more for 2 min, the measurement circuit 100 may provide the information indicating the shift to the permanent failure mode as state information to the control unit 130 in accordance with polling from the control unit 130.

Based on the information acquired from the measurement circuit 100, for example, the information acquired from the measurement circuit 100 via the $I^2C$ interface, the control unit 130 can judge whether an abnormality of the power supply BT occurs. In addition to or in place of this, the control unit 130 can judge, based on the output from the output unit ABN of the measurement circuit 100, whether an abnormality of the power supply BT occurs. Upon judging that an abnormality of the power supply BT occurs, the control unit 130 may control the notification unit NU to make a notification indicating that. This notification can urge the user to do a predetermined operation for reset. This notification can be one of generation of light of a predetermined color, blinking indication, generation of a predetermined sound, and generation of a predetermined vibration, or a combination of two or more of these.

Upon judging to shift to the permanent failure mode, the control unit 130 can change the aerosol generation device AGD or the power supply unit PSU to an unusable state. The control unit 130, for example, sends a command for inhibiting operations in all power-pass modes to the charge circuit 20 via the $I^2C$ interface, thereby stopping the output of the voltage from the SYS terminal and the SW terminal of the charge circuit 20. Since the output of the voltage $V_{CC}$, the voltage $V_{CC33_0}$, and the voltage $V_{CC33}$ is thus stopped, supply of power to the control unit 130 is cut off, and the control unit 130 is set in an inoperable state. Since the charge circuit 20 continuously holds the command for inhibiting operations in all power-pass modes, which is sent from the control unit 130, no voltage is output from the SYS terminal and the SW terminal of the charge circuit 20 even if the voltage $V_{BUS}$ is supplied from the USB connector USBC. This inhibits a change from the permanent failure mode to all other modes. This operation is useful for inhibiting charge and discharge of the power supply BT judged to have failed and increasing the safety.

The aerosol generation device AGD or the power supply unit PSU may include a protection unit PPP having a function of protecting the power supply BT in response to the abnormality notification from the measurement circuit 100 without control by the control unit 130. The protection unit PPP may further include a function of protecting the power supply BT under the control of the control unit 130. The protection unit PPP can include, for example, the information holding circuit FF1. As will be described later in detail, the information holding circuit FF1 can change an nALARM_Latched signal to the active level (here, low level) in accordance with driving of the nGAUGE_INT1 signal output from the ALERT terminal of the measurement circuit 100 to the active level (here, low level) (that is, a first abnormality signal), thereby turning off the switch SS arranged in a current path for driving the heater HT. Information (that is, the first abnormality signal) representing that the nGAUGE_INT1 signal is driven to the active level can be provided to the PA10 terminal of the control unit 130 via the information holding circuit FF1. More specifically, the information holding circuit FF1 can be formed by a D flip-flop with a /CLR terminal. As is well known, since a D flip-flop can hold 1-bit information that can take high level and low level and can therefore be used as an information holding circuit. The nGAUGE_INT1 signal can be supplied to the /CLR terminal of the information holding circuit FF1 (D flip-flop). The nALARM_Latched signal can be output from the Q terminal of the information holding circuit FF1

(D flip-flop). If the nGAUGE_INT1 signal supplied to the /CLR terminal that is a negative logic changes to low level, the information holding circuit FF1 (D flip-flop) fixes the level of the held information to low level. The same level as the level of the held information is output from the Q terminal of the information holding circuit FF1 (D flip-flop). According to this configuration, the nALARM_Latched signal can be changed to the active level (here, low level) in accordance with the change of the nGAUGE_INT1 signal to the active level (here, low level). As will be described later, the nALARM_Latched signal can also be provided to the EN terminal of the transformation circuit 120 or the base or the gate of the transistor that forms a switch SL.

In other words, upon judging that a criterion (condition) to inhibit energization to the heater HT (heat generation) or charge of the power supply BT is satisfied, the measurement circuit 100 drives the nGAUGE_INT1 signal output from the ALERT terminal of the measurement circuit 100 to the active level, and in response to this, the protection unit PPP turns off the switch SS without interposing control by the control unit 130. Thus, heat generation of the heater HT (supply of power to the heater HT) is inhibited.

In the example shown in FIG. 22, if one of a criterion that the current is 10 A or more, a criterion that the charge current of the power supply BT is 3.0 A or more, and a criterion that the temperature at the time of discharge from the power supply BT is 60° C. or more for 2 sec is satisfied, the nGAUGE_INT1 signal is changed to the active level. As the criteria, other criteria may be set. For example, the measurement circuit 100 can drive the nGAUGE_INT1 signal to the active level if at least one of the value of the discharge current, the value of the charge current, the temperature of the power supply BT at the time of discharge of the power supply BT, the temperature of the power supply BT at the time of charge of the power supply BT, the positive electrode potential (output voltage) of the power supply BT at the time of discharge of the power supply BT, and the positive electrode potential (output voltage) of the power supply BT at the time of charge of the power supply BT satisfies the criterion to inhibit supply of power to the heater HT or charge of the power supply BT.

After the protection unit PPP protects the power supply BT in response to the abnormality notification, if the state information acquired from the measurement circuit 100 via the $I^2C$ interface indicates that the power supply BT is not in the abnormal state, the control unit 130 may enable supply of power to the heater HT or charge of the power supply BT. For example, after the protection unit PPP protects the power supply BT in response to the abnormality notification, the control unit 130 can, using the notification unit NU, urge the user to perform an operation for reset or reactivation. If the control unit 130 is thus reset or reactivated, the control unit 130 acquires state information from the measurement circuit 100 via the $I^2C$ interface or confirms the level of the nGAUGE_INT1 signal, and if the power supply BT is not in the abnormal state, can enable supply of power to the heater HT or charge of the power supply BT. To the contrary, the control unit 130 may be set in a state in which supply of power to the heater HT is possible when it is reset or reactivated. In this case, the control unit 130 can acquire state information from the measurement circuit 100 via the $I^2C$ interface and, in accordance with the state information, inhibit supply of power to the heater HT as needed.

As described above, protection of the power supply BT by the protection unit PPP in response to the nGAUGE_INT1 signal can be handled as cancelable protection. This is because protection of the power supply BT by the protection unit PPP is performed without interposing control by the control unit 130, and the protection may occur by an operation error of one of the electronic components forming the protection unit PPP. This is also because if the protection occurs due to a failure such as freeze in the control unit 130, the aerosol generation device AGD or the power supply unit PSU can be returned to the normal state by resetting or reactivating the control unit 130. The conditions shown in the column of "nGAUGE_INT2" in FIG. 22 are set to be satisfied before the conditions shown in the column of "nGAUGE_INT1" in order to judges whether a failure such as freeze occurs in the control unit 130.

On the other hand, an inoperable state that is set by judging the shift to the permanent failure mode cannot be canceled in principle. If the temperature of the power supply BT is 85° C. or more for 2 min at the time of discharge or charge, the aerosol generation device AGD or the power supply unit PSU is shifted to the permanent failure mode by the control unit 130. In other words, as is apparent from the fact that the control unit 130 can acquire the temperature of the power supply BT, no failure such as freeze occurs in the control unit 130. Nevertheless, if the temperature of the power supply BT is high, an unrecoverable error occurs outside the control unit 130, and the error cannot be eliminated even by reset or reactivation of the control unit 130. For this reason, the aerosol generation device AGD or the power supply unit PSU needs to be shifted to the permanent failure mode.

The control unit 130 can acquire first information concerning the state of the power supply BT from the measurement circuit 100 via the FC interface by periodical polling, and acquire second information concerning the state of the power supply BT from the measurement circuit 100 via the $I^2C$ interface in response to the abnormality notification. If the first information indicates that the power supply BT is in a first state, the control unit 130 can execute the operation of protecting the power supply BT. If the power supply BT changes to a second state that is more serious than the first state, the measurement circuit 100 can output the abnormality notification. An example will be described with reference to FIG. 22. If the first information indicates the first state (a state in which the temperature of the power supply BT at the time of discharge to the heater HT is 55° C. or more), the control unit 130 can execute the operation of protecting the power supply BT (for example, reset request). If the power supply BT changes to the second state (a state in which the temperature of the power supply BT at the time of discharge to the heater HT or charge is 60° C. or more for 2 sec) more serious than the first state, the measurement circuit 100 can output the abnormality notification (drive the nGAUGE_INT1 signal to the active level). In this example, the first information and the second information are information representing the temperature of the power supply BT. However, the first information and the second information may be information representing another state (for example, the discharge current or the charge current).

In one configuration example, if the first information indicates that at the time of charge of the power supply BT, the state of the power supply BT satisfies one of conditions included in a first condition group, the control unit 130 executes the operation of protecting the power supply BT. If the first information indicates that at the time of discharge of the power supply BT, the state of the power supply BT satisfies one of conditions included in a second condition group, the control unit 130 executes the operation of protecting the power supply BT. Here, the number of conditions included in the first condition group is larger than the number of conditions included in the second condition group. In other words, this means that protection of the power supply BT based on the first information functions more strongly at the time of charge than at the time of discharge. This is because at the time of charge, energy stored in the power supply BT continuously increases, unlike discharge, and therefore, protection of the power supply BT is more important at the time of charge. This is also because charge at a low temperature may cause an irreversible change in the internal structure of the power supply BT, such as electrodeposition on the negative electrode, unlike discharge, and therefore, protection of the power supply BT is more important at the time of charge.

In another configuration example, if the second information indicates that at the time of charge of the power supply BT, the state of the power supply BT satisfies one of conditions included in a third condition group, the control unit 130 executes the operation of protecting the power supply BT. If the second information indicates that at the time of discharge of the power supply BT, the state of the power supply BT satisfies one of conditions included in a fourth condition group, the control unit 130 executes the operation of protecting the power supply BT. Here, the number of conditions included in the third condition group is smaller than the number of conditions included in the fourth condition group. In other words, this means that protection of the power supply BT based on the second information functions more strongly at the time of discharge than at the time of charge. This is because at the time of charge, energy stored in the power supply BT continuously increases, or an irreversible change may occur in the internal structure of the power supply BT, as described above.

Figure 25:
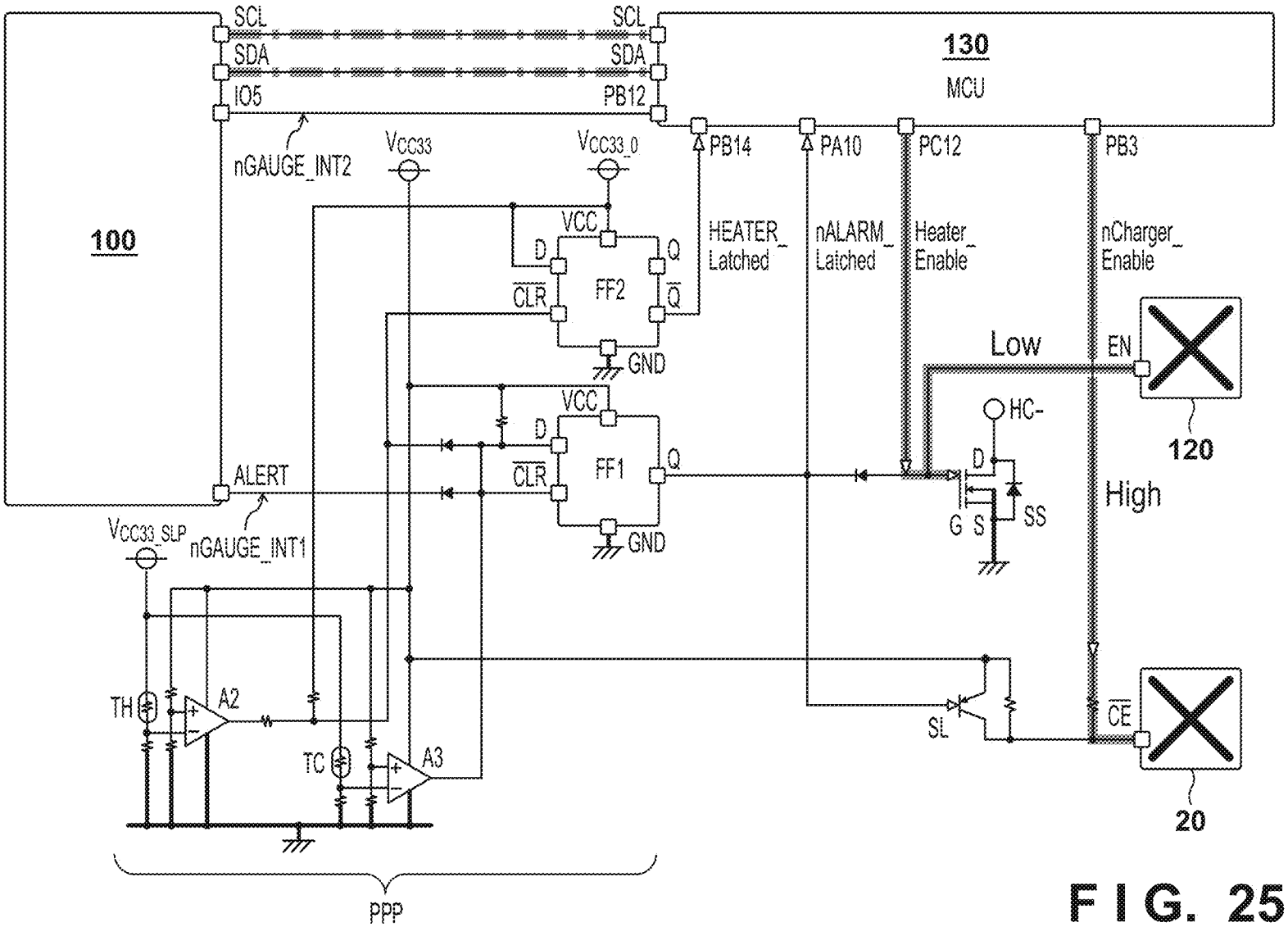
FIG. 25 is a view for explaining the operation of the circuit configuration shown in FIG. 24.

FIG. 25 schematically shows protection of the power supply BT based on the state of the power supply BT acquired by periodical polling to the measurement circuit 100 by the control unit 130. The control unit 130 can acquire state information concerning the state of the power supply BT from the measurement circuit 100 by periodical polling to the measurement circuit 100. If the state information satisfies a criterion for protection of the power supply BT, the control unit 130 can perform the protection operation of protecting the power supply BT. The protection operation can include, for example, an operation of changing a Heater_Enable signal output from the PC12 terminal to an inactive level (here, low level) to stop the operation of the transformation circuit 120 and turn off the switch SS arranged in the c current path of the heater HT. The protection operation can also include, for example, an operation of changing an nCharger_Enable signal output from the PB3 terminal to an inactive level (here, high level) to stop the charge of the power supply BT by the charge circuit 20. As a detailed example, if the EN terminal of the transformation circuit 120 is a positive logic, and the switch SS is formed by an n-channel MOSFET, the Heater_Enable signal changed to low level is supplied to the EN terminal of the transformation circuit 120 and the gate terminal of the switch SS, thereby stopping the operation of the transformation circuit 120 and turning off the switch SS. If the /CE terminal of the charge circuit 20 is a negative logic, the nCharger_Enable signal changed to high level is supplied to the /CE terminal of the charge circuit 20, thereby stopping the charge of the power supply BT by the charge circuit 20.

The protection operation may include an operation of continuing the error processing mode until a predetermined condition is satisfied, and after the predetermined condition is satisfied, changing to the sleep mode. For example, according to the example shown in FIG. 22, if the temperature of the power supply BT is 51° C. or more at the time of discharge from the power supply BT, the control unit 130 changes to the error processing mode. If the temperature of the power supply BT then lowers to 45° C. or less, the control unit 130 can shift to the sleep mode.

Figure 26:
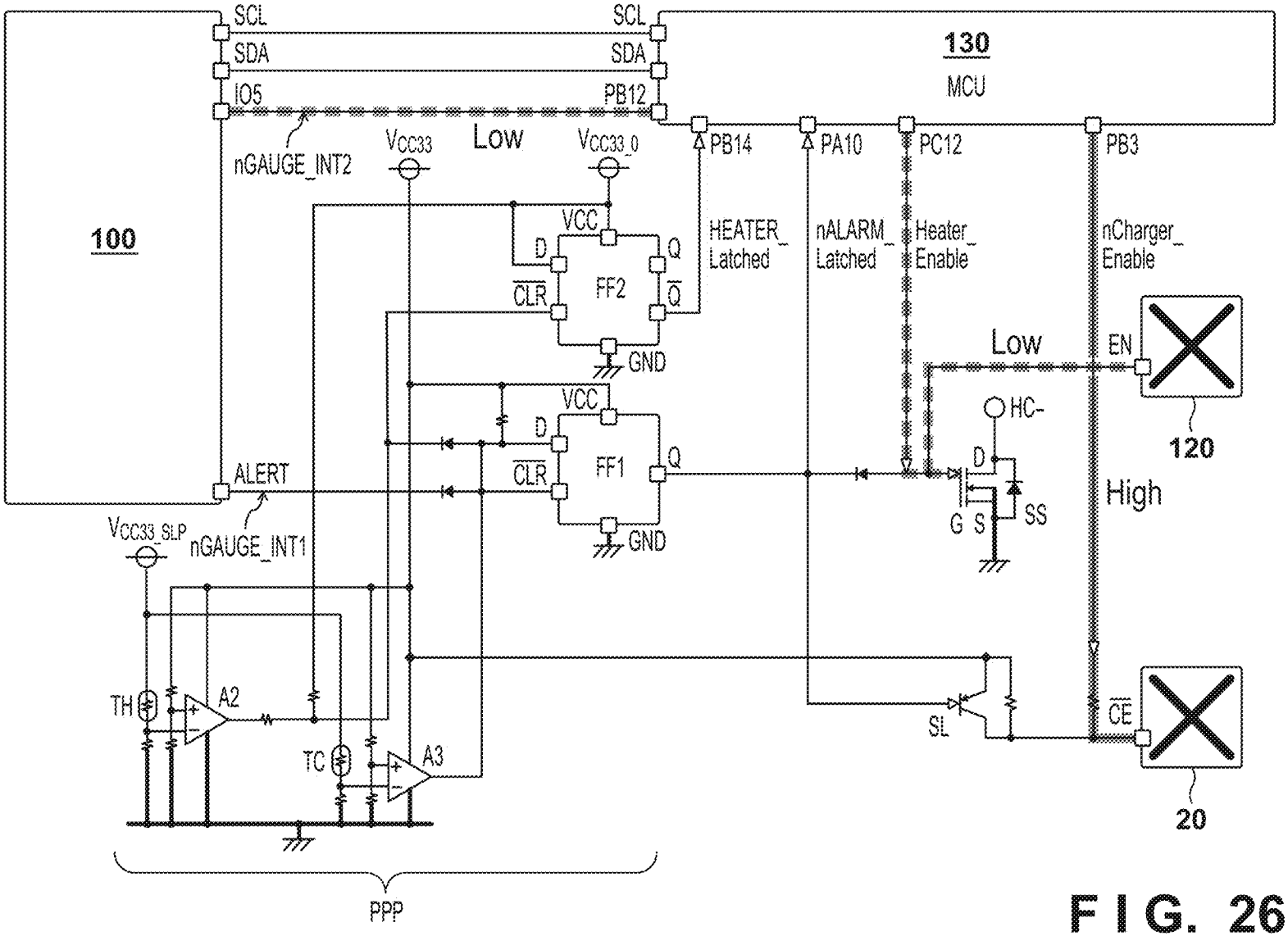
FIG. 26 is a view for explaining the operation of the circuit configuration shown in FIG. 24.

FIG. 26 schematically shows protection of the power supply BT, which is performed in response to the second abnormality signal output when the measurement circuit 100 changes the nGAUGE_INT2 signal to the active level (here, low level). The control unit 130 can perform polling to the measurement circuit 100 in response to the change of the nGAUGE_INT2 signal to the active level (second abnormality signal) and acquire the state information concerning the state of the power supply BT from the measurement circuit 100. If the state information satisfies a criterion for protection of the power supply BT, the control unit 130 can perform the protection operation of protecting the power supply BT. The protection operation may be the same as the protection operation described with reference to FIG. 25 or different. If periodical polling to the measurement circuit 100 by the control unit 130 is stopped because the aerosol generation device AGD or the power supply unit PSU is in the sleep mode, the control unit 130 can resume the periodical polling to the measurement circuit 100 based on the nGAUGE_INT2 signal changed to the active level. In other words, the nGAUGE_INT2 signal can be understood as an interrupt signal to the control unit 130.

The protection operation may include an operation of continuing the error processing mode until a predetermined condition is satisfied, and after the predetermined condition is satisfied, changing to the sleep mode. For example, according to the example shown in FIG. 22, if the temperature of the power supply BT is −5° C. or less for 5 sec at the time of discharge from the power supply BT, the control unit 130 can shift to the sleep mode via the error processing mode. Alternatively, if the positive electrode potential of the power supply BT is 2.8 V or less at the time of discharge from the power supply BT, the control unit 130 can shift to the sleep mode via the error processing mode.

On the other hand, if the state information indicates that the temperature at the time of discharge from the power supply BT is 85° C. or more for 2 min, or the temperature at the time of charge of the power supply BT is 85° C. or more for 2 min, the control unit 130 can judge to shift the aerosol generation device AGD or the power supply unit PSU to the permanent failure mode. In this case, the control unit 130 can change the aerosol generation device AGD or the power supply unit PSU to a permanently unusable state.

Figure 27:
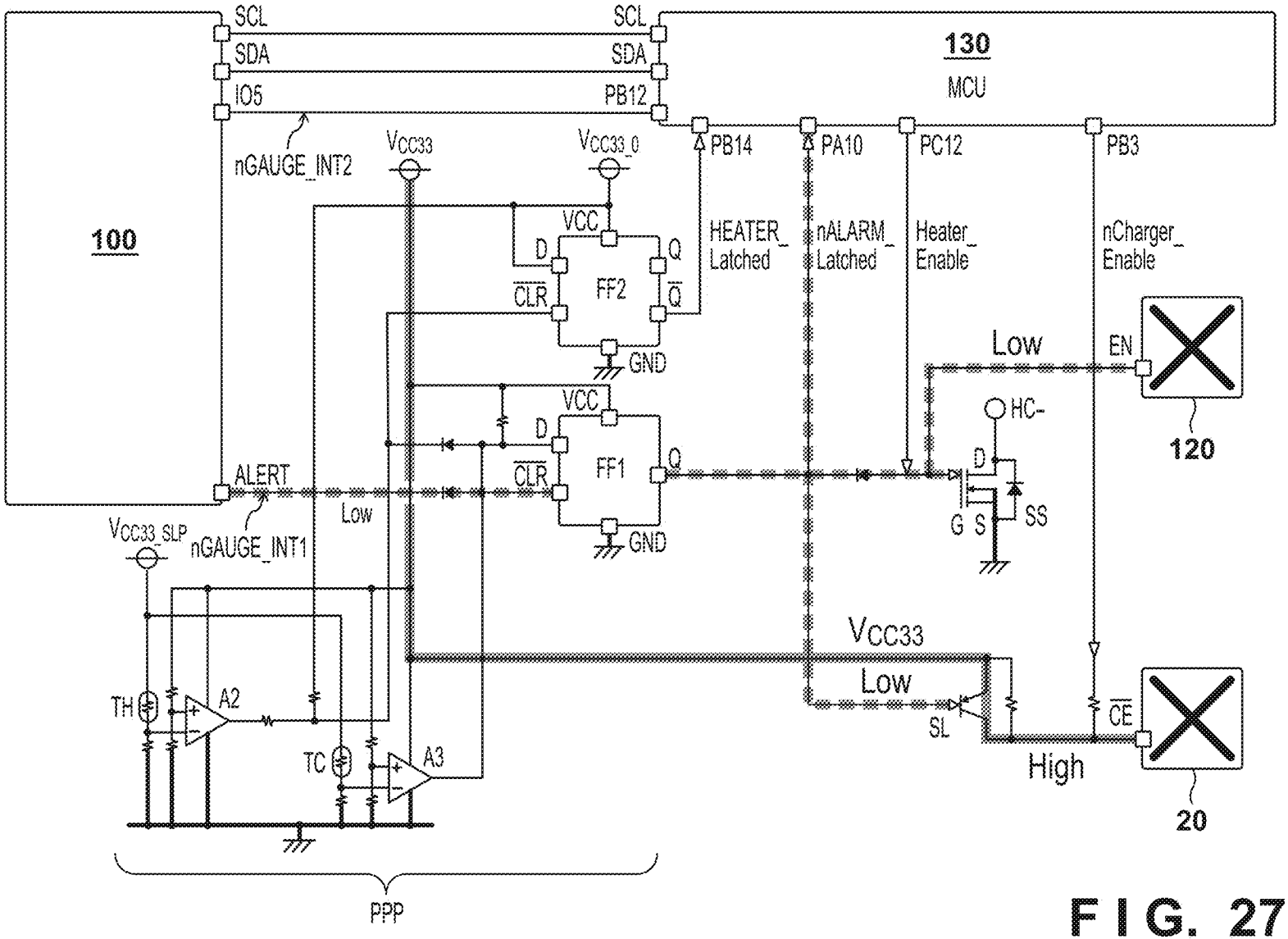
FIG. 27 is a view for explaining the operation of the circuit configuration shown in FIG. 24.

FIG. 27 schematically shows protection of the power supply BT, which is executed by the protection unit PPP in response to the change of the nGAUGE_INT1 signal n1 to the active level by the measurement circuit 100. The information holding circuit FF1 can change the nALARM_Latched signal to the active level (here, low level) in accordance with driving of the nGAUGE_INT1 signal output from the ALERT terminal of the measurement circuit 100 to the active level (here, low level) (that is, the first abnormality signal). In response to this, the switch SS arranged in the current path that drives the heater HT can be turned off, the transformation circuit 120 that generates the voltage Vboost can stop the operation, and the charge circuit 20 can stop the operation. As a detailed example, if the EN terminal of the transformation circuit 120 is a positive logic, and the switch SS is formed by an n-channel MOSFET, the nALARM_Latched signal changed to low level is supplied to the EN terminal of the transformation circuit 120 and the gate terminal of the switch SS, thereby stopping the operation of the transformation circuit 120 and turning off the switch SS. Also, if the /CE terminal of the charge circuit 20 is a negative logic, and the switch SL is formed by a pnp-type bipolar transistor, the nALARM_Latched signal changed to high level is supplied to the base terminal of the switch SL, thereby turning on the switch SL. If the switch SL is turned on, division of the voltage $V_{CC33}$ by the two resistors connected in parallel with the /CE terminal of the charge circuit 20 stops. Thus, the voltage $V_{CC33}$ of high level is supplied to the /CE terminal of the charge circuit 20 via the switch SL. Since the /CE terminal of the charge circuit 20 is a negative logic, the operation of the charge circuit 20 can stop.

The information holding circuit FF1 may change the nALARM_Latched signal to the active level (here, low level) even if the temperature of the heater HT measured using the thermistor TH configured to detect the temperature of the heater HT exceeds its upper limit value. More specifically, the electrical resistance values of resistors connected to the noninverting input terminal and the inverting input terminal of the OP amplifier A2 and the physical property of the thermistor TH are selected such that the output of the OP amplifier A2 changes to low level when the temperature of the heater HT exceeds its condition value. Since low level output from the OP amplifier A2 is supplied to the /CLR terminal of the information holding circuit FF1, like the nGAUGE_INT1 signal changed to the active level, the nALARM_Latched signal can change to the active level (here, low level).

The information holding circuit FF1 may change the nALARM_Latched signal to the active level even if the temperature of the outer case C101 measured using the thermistor TC configured to detect the temperature of the outer case C101 exceeds its upper limit value. More specifically, the electrical resistance values of resistors connected to the noninverting input terminal and the inverting input terminal of the OP amplifier A3 and the physical property of the thermistor TC are selected such that the output of the OP amplifier A3 changes to low level when the temperature of the heater HT exceeds its condition value. Since low level output from the OP amplifier A3 is supplied to the /CLR terminal of the information holding circuit FF1, like the nGAUGE_INT1 signal changed to the active level, the nALARM_Latched signal can change to the active level (here, low level).

The protection unit PPP may further include the information holding circuit FF2. In an example, the information holding circuit FF2 is driven by the voltage $V_{CC33_0}$ and therefore continuously holds information unless it is in the permanent failure mode if the power supply BT is normal. If the temperature of the heater HT measured using the thermistor TH configured to detect the temperature of the heater HT exceeds its upper limit value, the information holding circuit FF2 can continuously hold information indicating it and change a Heater_Latched signal to the active level (here, high level). More specifically, the information holding circuit FF2 can be formed by a D flip-flop with a /CLR terminal. The output signal of the OP amplifier A2 can be supplied to the /CLR terminal of the information holding circuit FF2 (D flip-flop). The Heater_Latched signal can be output from the/Q terminal of the information holding circuit FF2 (D flip-flop). If the output signal of the OP amplifier A2, which is supplied to the /CLR terminal that is a negative logic, changes to low level, the information holding circuit FF2 (D flip-flop) fixes the level of the held information to low level. A level opposite to the level of the held information is output from the/Q terminal of the information holding circuit FF2 (D flip-flop). According to this configuration, when the temperature of the heater HT exceeds its upper limit value, the Heater_Latched signal can be changed to the active level (here, high level). Note that the Heater_Latched signal may be output from the Q terminal of the information holding circuit FF2 (D flip-flop). In this case, it should be noted that unless an inverter is connected to the Q terminal, the active level of the Heater_Latched signal is low level. Also, in this case, the information holding circuit FF2 (D flip-flop) may not have the/Q terminal.

If the Heater_Latched signal changes to the active level, the control unit 130 can judge that overheat of the heater HT occurs, and control the notification unit NU to make a notification indicating it. This notification can urge the user to do a predetermined operation for reset. This notification can be one of generation of light of a predetermined color, blinking indication, generation of a predetermined sound, and generation of a predetermined vibration, or a combination of two or more of these.

When reset or reactivated, the control unit 130 can confirm the information held by the information holding circuit FF2 based on the state (logic level) of the Heater_Latched signal and further confirm whether overheat occurs in the heater HT. Upon recognizing that overheat of the heater HT occurs, the control unit 130 can shift the aerosol generation device AGD or the power supply unit PSU to the permanent failure mode. As described above, shift of the aerosol generation device AGD or the power supply unit PSU to the permanent failure mode can be performed by the control unit 130 sending a command for inhibiting operations in all power-pass modes to the charge circuit 20 via the $I^2C$ interface. However, in a situation in which overheat occurs in the heater HT, a failure such as freeze may simultaneously occur in the control unit 130. Hence, the control unit 130 is reset to reactivated to reliably shift the aerosol generation device AGD or the power supply unit PSU to the permanent failure mode. Note that even if a failure such as freeze of the control unit 130 occurs, if the temperature of the heater HT exceeds its upper limit value, the information holding circuit FF1 changes the Heater_Latched signal to the active level (here, low level), overheat of the heater HT never progresses.

Note that if the information holding circuit FF2 is formed by a D flip-flop, the information holding circuit FF2 (D flip-flop) can include a CLK (clock) terminal (not shown) connected to the control unit 130. By inputting a CLK signal to the CLK terminal, the level of the information held by the information holding circuit FF2 (D flip-flop) can be made equal to the level input to the D terminal. However, to allow the reset or reactivated control unit 130 to recognize occurrence of overheat of the heater HT, it is preferable that the control unit 130 does not input the CLK signal to the CLK terminal of the information holding circuit FF2 (D flip-flop) at least immediately after reset or reactivation.

Figure 28:
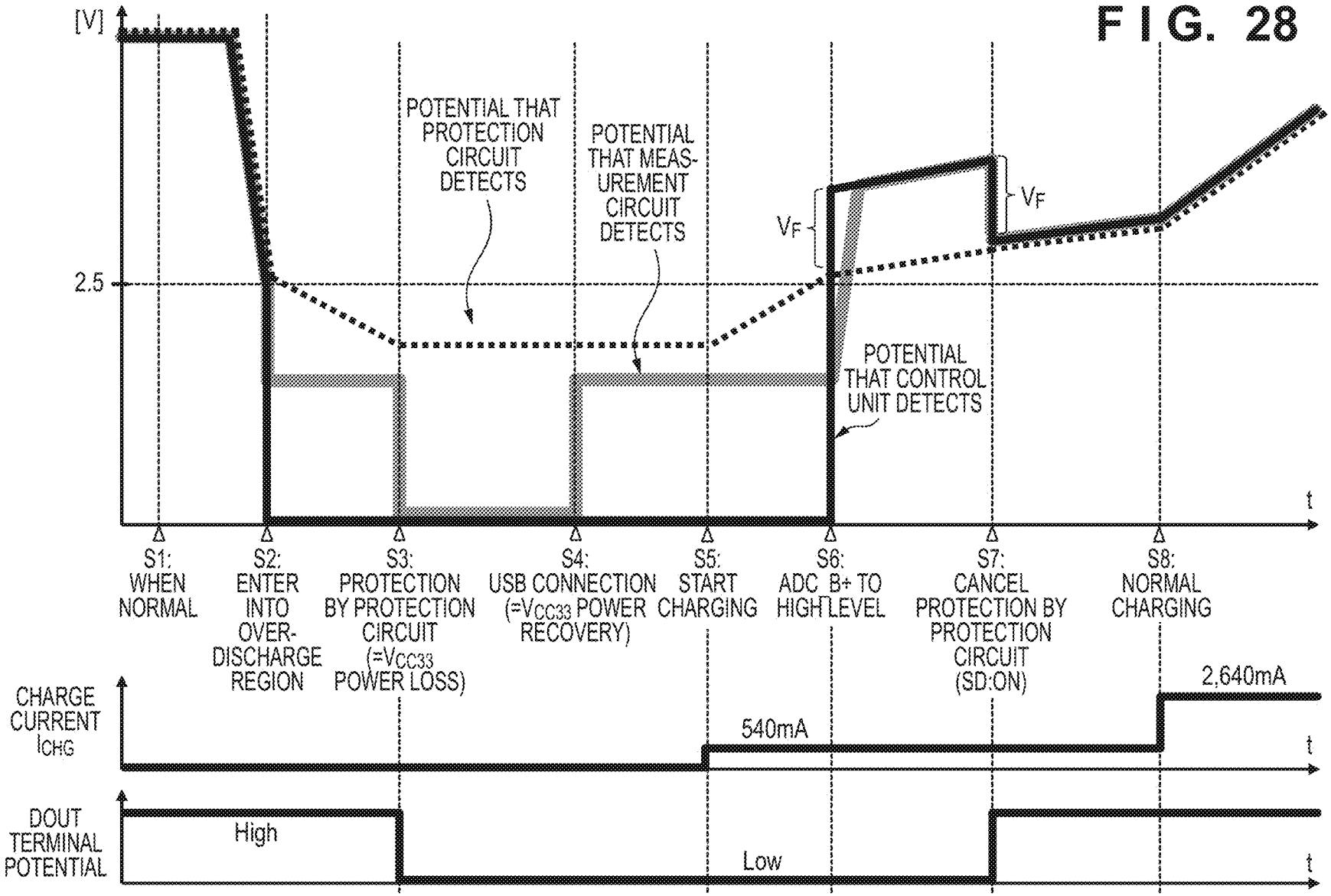
FIG. 28 is a view schematically showing an example of the change of a state concerning discharge and charge of the power supply.

FIG. 28 schematically shows the change of a state concerning discharge and charge of the power supply BT. S1 to S8 indicate timings. The upper stage of FIG. 28 exemplifies a potential (dotted line) detected as the positive electrode potential of the power supply BT by the protection circuit 90, a potential (gray solid line) detected as the positive electrode potential of the power supply BT by the measurement circuit 100, and a potential (black solid line) detected as the positive electrode potential of the power supply BT by the control unit 130. The potential detected as the positive electrode potential of the power supply BT by the protection circuit 90 corresponds to a voltage detected as the output voltage of the power supply BT by the protection circuit 90. The potential detected as the positive electrode potential of the power supply BT by the measurement circuit 100 corresponds to a voltage detected as the output voltage of the power supply BT by the measurement circuit 100. The potential detected as the positive electrode potential of the power supply BT by the control unit 130 corresponds to a voltage detected as the output voltage of the power supply BT by the control unit 130. The middle stage of FIG. 28 exemplifies a charge current that charges the power supply BT. The lower stage of FIG. 28 exemplifies the level of the DOUT terminal of the protection circuit 90.

At the timing S1, the potential of the positive electrode of the power supply BT (the output voltage output between the positive electrode and the negative electrode) is normal. Here, "normal" can be understood as a state in which the potential of the positive electrode of the power supply BT (the output voltage output between the positive electrode and the negative electrode) is not more than the full charge voltage and higher than the discharge end voltage of the power supply BT. Discharge from the power supply BT progresses until the timing S2, and the state of the power supply BT enters the overdischarge state at the timing S2. FIG. 28 exemplifies 2.5 V as the discharge end voltage of the power supply BT. When the potential of the positive electrode of the power supply BT (the output voltage output between the positive electrode and the negative electrode) falls below the discharge end voltage, the state of the power supply BT enters the overdischarge region. At the timings S2 to S6, the potential (dotted line) detected by the protection circuit 90, the potential (gray solid line) detected by the measurement circuit 100, and the potential (black solid line) detected by the control unit 130 can be largely different from each other. In the example to be described here, as will be described later in detail, in the period from the timing S2 to S5, since the potential of the positive electrode of the power supply BT lowers, the first conductive path PT1 and the PC2 terminal of the control unit 130 cannot electrically be connected by the switch circuit 80. Hence, in the period from the timing S2 to S5, the potential (black solid line) detected by the control unit 130 is zero. Also, in the example to be described here, in the overdischarge region of the power supply BT, the measurement circuit 100 cannot correctly detect the potential of the positive electrode of the power supply BT. This is because 0 mAh that is the minimum value of the residual capacity and 0% that is the minimum value of the SOC are assigned to a state in which the output voltage of the power supply BT equals the discharge end voltage, and therefore, the measurement circuit 100 is not designed to correctly measure a state in which the values are less than these minimum values.

At the timing S3 when the potential of the positive electrode of the power supply BT further lowers and falls below a first level due to discharge, to protect the power supply BT, the protection circuit 90 opens the first transistor (switch) SD of the switch unit SWP to stop discharge from the power supply BT to components other than the protection circuit 90. Here, as described above, the first transistor SD is a switch arranged in the path to which the current output from the power supply BT flows, more specifically, a switch arranged in the second conductive path PT2 electrically connected to the second power supply connector BC−. Note that even if the first transistor (switch) SD is opened, a closed circuit is formed by the first power supply connector BC+, the VDD terminal of the protection circuit 90, the VSS terminal of the protection circuit 90, and the second power supply connector BC−, and therefore, the protection circuit 90 can maintain the state in which the first transistor (switch) SD is opened. If the first transistor (switch) SD is opened, the control unit 130 and the measurement circuit 100 stop the operations because the voltage $V_{CC33}$ is not supplied to these.

At the timing S4, to charge the power supply BT, a USB cable to which an external device (for example, a charger or an electronic device) is connected is connected to the USB connector USBC by the user. In this state, since the voltage $V_{CC33}$ is not supplied to the VDD terminal (power supply terminal) of the control unit 130, low level is supplied to the base or the gate of the transistor that forms the switch SI, and the switch SI is off. Hence, a high level obtained by dividing the power supply V USB can be supplied to the ON terminal of the load switch 10. Hence, the load switch 10 can supply the voltage V USB supplied to the VIN terminal as the voltage $V_{CC5}$ to the $V_{BUS}$ terminal of the charge circuit 20 via the $V_{CC5}$ line. The charge circuit 20 can operate in the first power-pass mode, electrically connect the $V_{BUS}$ terminal and the SW terminal, and supply the voltage $V_{CC}$ to the $V_{CC}$ line using the voltage $V_{CC5}$ supplied via the $V_{CC5}$ line. Upon receiving the supply of the voltage $V_{CC}$, the transformation circuit 30 generates the voltage $V_{CC33_0}$, and the load switch 40 can receive the voltage $V_{CC33_0}$ and output the voltage $V_{CC33}$. Thus, the voltage $V_{CC33}$ is supplied to the control unit 130 and the measurement circuit 100, and these can resume the operations.

From the timing S4, the measurement circuit 100 can detect the potential of the power supply BT supplied to the VBAT terminal. The control unit 130 can judge whether a failure with which the aerosol generation device AGD or the power supply unit PSU should be shifted to the permanent failure mode occurs in the power supply BT. Upon judging that the failure occurs in the power supply BT, the control unit 130 can shift the aerosol generation device AGD or the power supply unit PSU to the permanent failure mode. On the other hand, upon judging that the failure does not occur in the power supply BT, the control unit 130 can performs an operation to be described below.

At the timing S5, the control unit 130 can output low level from the PB3 terminal to supply low level (enable level) to the /CE terminal of the charge circuit 20. Thus, the charge circuit 20 can start an operation of supplying the charge voltage (first voltage) from the BAT terminal to the power supply BT. The charge current of the power supply BT at this time can be a first current value (540 mA in FIG. 28) smaller than a predetermined current value. The potential of the positive electrode of the power supply BT starts rising by charge. Also, the charge circuit 20 can supply the voltage $V_{CC}$ from the SYS terminal to the $V_{CC}$ line, and the transformation circuit 30 can supply the voltage $V_{CC33_0}$ to the $V_{CC33_0}$ line. The load switch 40 can receive the voltage $V_{CC33_0}$ and supply it as $V_{CC33}$ (second voltage) to the control unit 130 and the measurement circuit 100 via the $V_{CC33}$ line. Here, the charge circuit 20, the transformation circuit 30, and the load switch 40 can be understood to form one voltage supply circuit. The voltage supply circuit can supply, to between the first conductive path PT1 and the second conductive path PT2, the first voltage for charging the power supply BT using the voltage supplied from the external device via the USB cable and generate the second voltage for operating the control unit 130. According to this configuration, using the voltage supplied from the external device via the USB cable, the voltage supply circuit can perform reactivation of the control unit 130 that has stopped the operation and recovery of the power supply BT in the overdischarge state. In other words, the voltage supply circuit can return the aerosol generation device AGD or the power supply unit PSU to the normal state.

At the timing S6, the switch circuit 80 is turned on by the rise of the potential of the positive electrode of the power supply BT, and a potential ADC_B+ obtained by dividing the potential of the positive electrode of the power supply BT at a predetermined voltage division ratio can be supplied to the PC2 terminal of the control unit 130. The control unit 130 can convert the potential of the PC2 terminal into the potential of the positive electrode of the power supply BT based on the voltage division ratio.

In this example, when the potential of the positive electrode of the power supply BT exceeds a certain level after the timing S5, the potential detected by the measurement circuit 100 may abruptly increase. In the example shown in FIG. 28, the timing matches the timing S6, but this is merely an example.

The value detected, at this stage, as the potential of the positive electrode of the power supply BT (the output voltage of the power supply BT) by the control unit 130 and the measurement circuit 100 can be a voltage obtained by adding a forward voltage V F of the body diode BDD that is the first rectifying element connected in parallel with the first transistor SD to the output voltage of the power supply BT, as will be described later, because the first transistor SD of the switch unit SWP is off.

The control unit 130 judges whether the output voltage of the power supply BT acquired from the measurement circuit 100 exceeds the second level larger than the first level, and if the output voltage exceeds the second level, can increase the charge current of the power supply BT by the charge circuit 20 to a second current value (2,640 mA in FIG. 28) larger than the predetermined current value.

Also, the control unit 130 can judge whether the potential of the positive electrode of the power supply BT converted or detected based on the potential supplied to the PC2 terminal exceeds the second level, and if the potential of the positive electrode exceeds the second level, increase the charge current of the power supply BT by the charge circuit 20 to the second current value (as an example, 2,640 mA). Here, the difference between the second level and the first level is a value larger than the forward voltage $V_F$ of the body diode BDD. According to these configurations, it is possible to accurately judge whether the overdischarge state of the power supply BT is eliminated in consideration of the forward voltage $V_F$ of the body diode BDD included in the apparent potential of the positive electrode of the power supply BT detected by the control unit 130. It is therefore possible to not only improve the charge speed of the power supply BT whose overdischarge state is eliminated but also suppress high-rate charge for the power supply BT whose overdischarge state is not eliminated.

Note that the above-described judgement by the control unit 130 can be affirmative between the timing S6 and the timing S7 in FIG. 28. That is, if the above-described judgement is affirmative, the timing S8 can come without waiting for the timing S7, unlike the exemplification of FIG. 28.

At the timing S7 when the potential of the power supply BT further rises, and the potential detected as the potential of the power supply BT detected by the protection circuit 90 exceeds a third level higher than the first level, the protection circuit 90 closes the first transistor SD. Hence, the potential detected as the potential of the power supply BT by the control unit 130 and the measurement circuit 100 matches the potential of the positive electrode of the power supply BT. That is, when the first transistor SD is closed, the potential detected by the protection circuit 90 lowers by an amount corresponding to the forward voltage VF of the body diode BDD that is the first rectifying element.

After that, the control unit 130 can judge whether the output voltage of the power supply BT acquired from the measurement circuit 100 exceeds a fourth level smaller than the second level, and if the potential of the positive electrode exceeds the fourth level, increase the charge current of the power supply BT by the charge circuit 20 to the second current value (in FIG. 28, 2,640 mA). Also, the control unit 130 can judge whether the potential of the positive electrode of the power supply BT converted or detected based on the potential supplied to the PC2 terminal exceeds the third level larger than the first level, and if the potential of the positive electrode exceeds the third level, increase the charge current of the power supply BT by the charge circuit 20 to the second current value (In FIG. 28, 2,640 mA).

That is, the protection circuit 90 can operate to open the first transistor (switch) SD to cut off the discharge of the power supply BT when the potential of the positive electrode of the power supply BT (the output voltage of the power supply BT) falls below the first level. In addition, the control unit 130 can operate to increase the charge current of the power supply BT when the potential of the positive electrode of the power supply BT detected based on the potential supplied to the PC2 terminal exceeds the second level larger that then first level by the charge of the power supply BT.

Figure 29:
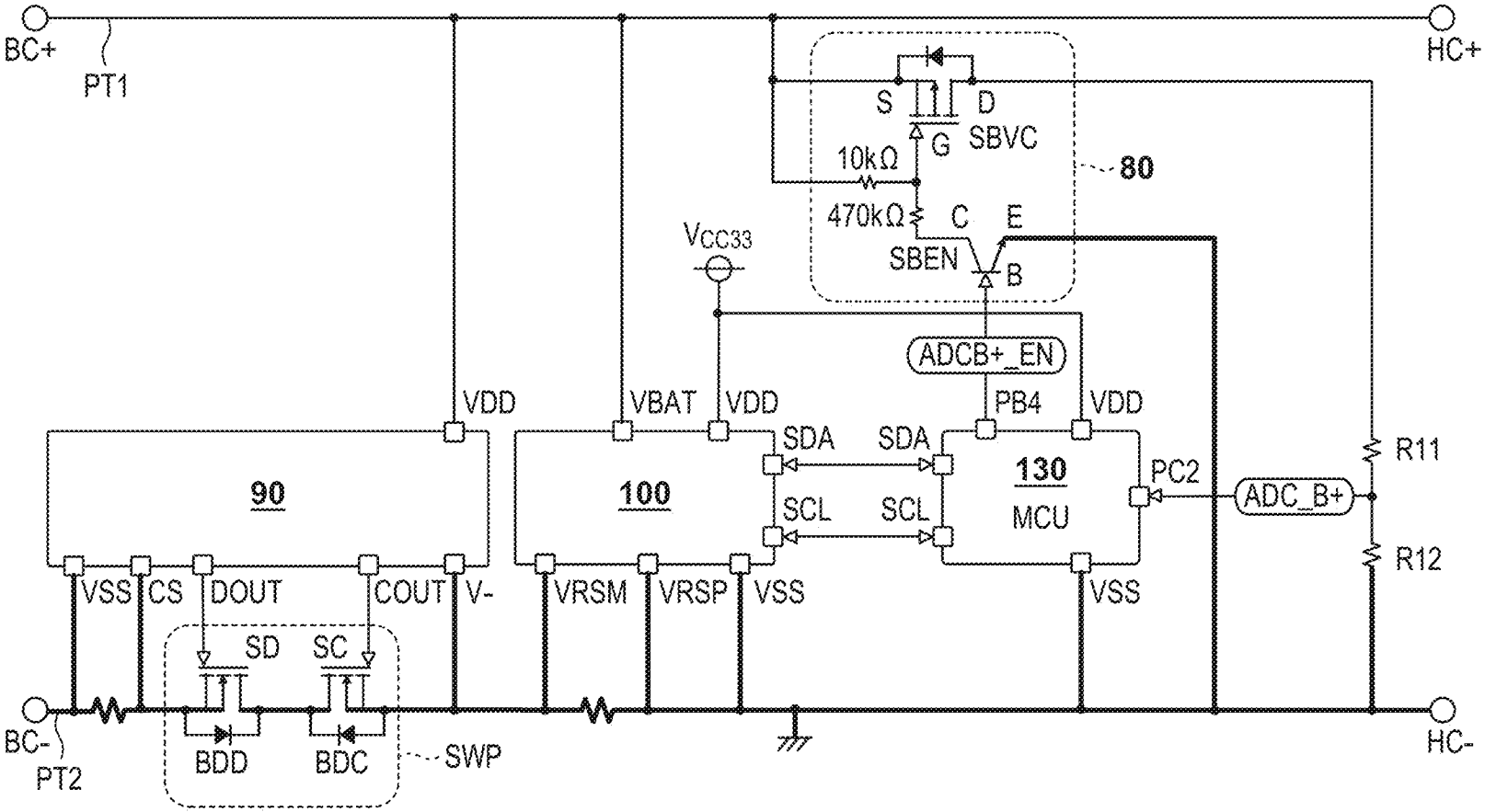
FIG. 29 is a view showing the protection circuit, a switch unit, the measurement circuit, the control unit, and a switch circuit together with a first conductive path and a second conductive path.

FIG. 29 shows the protection circuit 90, the switch unit SWP, the measurement circuit 100, the control unit 130, and the switch circuit 80 together with the first conductive path PT1 and the second conductive path PT2. The switch circuit 80 can include, for example, a PMOS transistor SBVC, an npn-type bipolar transistor SBEN, and two resistors (10 kΩ and 470 SΩ, but is not limited to this configuration. The switch circuit 80 may be formed by, for example, a single transistor that is turned on when an ADCB+_EN signal output from the PB4 terminal of the control unit 130 is at the active level.

In the example shown in FIG. 29, in a case where the power supply BT is in the normal state, if the ADCB+_EN signal is set to the active level (here, high level), the PMOS transistor SBVC is turned on. More specifically, if the ADCB+_EN signal changed to the active level (here, high level) is supplied to the base terminal of the npn-type bipolar transistor SBEN, the npn-type bipolar transistor SBEN is turned on. Since the gate terminal of the PMOS transistor SBVC is connected to the second conductive path PT2 that is the ground line via the npn-type bipolar transistor SBEN, the potential of the gate terminal of the PMOS transistor SBVC is about 0 V. Since the potential of the positive electrode of the power supply BT is supplied to the source terminal of the PMOS transistor SBVC via the first conductive path PT1, the source-gate voltage (absolute value) of the PMOS transistor SBVC is larger than the threshold (absolute value) of the PMOS transistor SBVC and the PMOS transistor SBVC is turned on. If the PMOS transistor SBVC is turned on, the potential of the positive electrode of the power supply BT, which is divided by resistors R11 and R12 for voltage division, is input to the PC2 terminal of the control unit 130. Since the magnitude of the signal input to the PC2 terminal of the control unit 130 depends on the potential of the positive electrode of the power supply BT, the control unit 130 can acquire the potential of the positive electrode of the power supply BT based on the signal input to the PC2 terminal. Note that both the VSS terminal of the control unit 130 and the second power supply connector BC− are connected to the second conductive path PT2. That is, the VSS terminal of the control unit 130 and the second power supply connector BC− are at equipotential. For this reason, the potential of the positive electrode of the power supply BT acquired by the control unit 130 substantially equals the output voltage of the power supply BT.

On the other hand, if the power supply BT is in the overdischarge state or the deep discharge state, even if the ADCB+_EN signal is set to the active level, the PMOS transistor SBVC is not turned on. Here, the lower limit value of the potential of the positive electrode of the power supply BT when the PMOS transistor SBVC is turned on is decided by the voltage division ratio by the two resistors of the switch circuit 80. To turn on the PMOS transistor SBVC, the potential of the gate needs to be lower than the potential of the source by an amount corresponding to the threshold of the PMOS transistor SBVC. For this, the potential of the positive electrode of the power supply BT needs to be equal to or larger than the value decided by the voltage division ratio. In the example shown in FIG. 29, if the power supply BT is in the overdischarge state or the deep discharge state, the current is prevented from flowing from the power supply BT via the switch circuit 80 (PMOS transistor SBVC) and the resistors R11 and R12 for voltage division. This prevents the power supply BT from being further discharged if the power supply BT is in the overdischarge state or the deep discharge state.

FIGS. 29A, 28B, 29C, 29D, 29E, and 29F show the same configuration as in FIG. 29. FIGS. 29A, 28B, 29C, 29D, 29E, and 29F schematically show states at the timings S2, S3, S4, S5, S6, and S7 shown in FIG. 28, respectively.

Figure 29A:
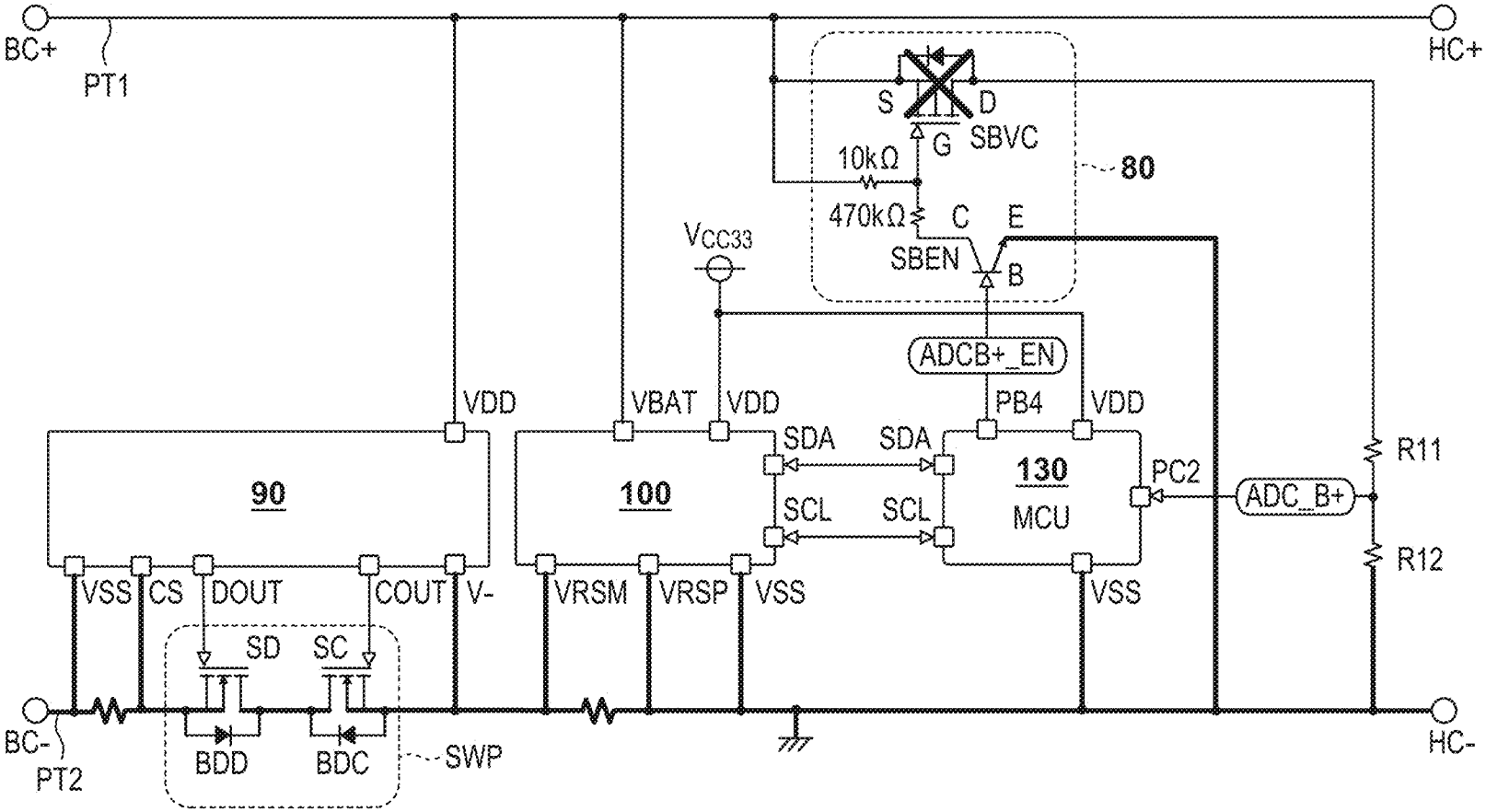
FIG. 29A is a view for explaining the operation of the circuit configuration shown in FIG. 29.

At the timing S2 shown in FIG. 29A, the power supply BT enters the overdischarge state, and the potential of its positive electrode (the potential of the first power supply connector BC+) lowers to the potential in the overdischarge state (here, 2.5 V). Thus, the source-gate voltage (absolute value) of the PMOS transistor SBVC becomes smaller than the threshold of the PMOS transistor SBVC, and the PMOS transistor SBVC is turned on. If the PMOS transistor SBVC is turned off, the current is prevented from flowing from the power supply BT via the switch circuit 80 (PMOS transistor SBVC) and the resistors R11 and R12 for voltage division. Hence, the potential of the second conductive path PT2 is input to the PC2 terminal of the control unit 130 via the resistor R12. The control unit 130 thus acquires 0 V as the potential of the positive electrode of the power supply BT. The VBAT terminals of the protection circuit 90 and the measurement circuit 100 are directly connected to the first conductive path PT1. For this reason, at the timing S2, the protection circuit 90 and the measurement circuit 100 can acquire a value larger than 0 V as the potential of the positive electrode of the power supply BT (the output voltage of the power supply BT).

Figure 29B:
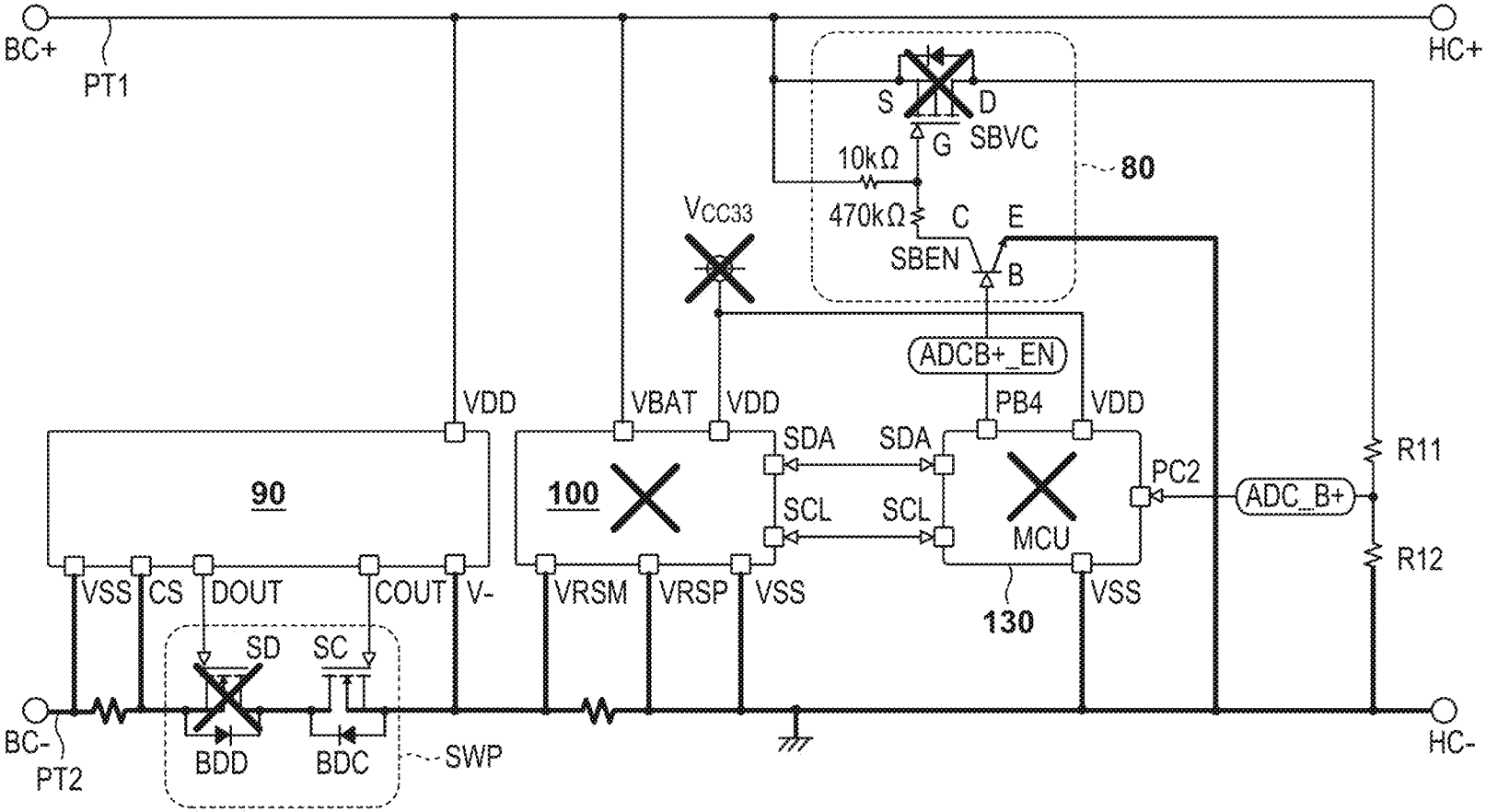
FIG. 29B is a view for explaining the operation of the circuit configuration shown in FIG. 29.

At the timing S3 shown in FIG. 29B, the discharge of the power supply BT further progresses, the potential of the positive electrode of the power supply BT falls below the first threshold, and the protection circuit 90 thus turns off the first transistor (switch) SD to protect the power supply BT. Hence, the path from the positive electrode of the power supply BT to the negative electrode of the power supply BT via the first power supply connector BC+, the first conductive path PT1, the second conductive path PT2, and the second power supply connector BC− is cut off. For this reason, supply of the power or the voltage to the charge circuit 20 to which the power or the voltage is supplied from the power supply BT via the first conductive path PT1 and the second conductive path PT2 and the transformation circuit 30 and the load switch 40 to which the power or the voltage is supplied via the charge circuit 20 is cut off. Hence, the supply of the voltage $V_{CC33}$ to the measurement circuit 100 and the control unit 130 is stopped, and the measurement circuit 100 and the control unit 130 stop the operations. That is, the measurement circuit 100 and the control unit 130 cannot acquire the potential of the positive electrode of the power supply BT (the output voltage of the power supply BT). On the other hand, the protection circuit 90 can continue the operation because it receives the supply of the power or the voltage directly from the power supply BT by the above-described closed circuit irrespective of the state of the first transistor (switch) SD. At this time, since the operations of the measurement circuit 100 and the control unit 130 are stopped, the progress of the discharge of the power supply BT can be suppressed.

Figure 29C:
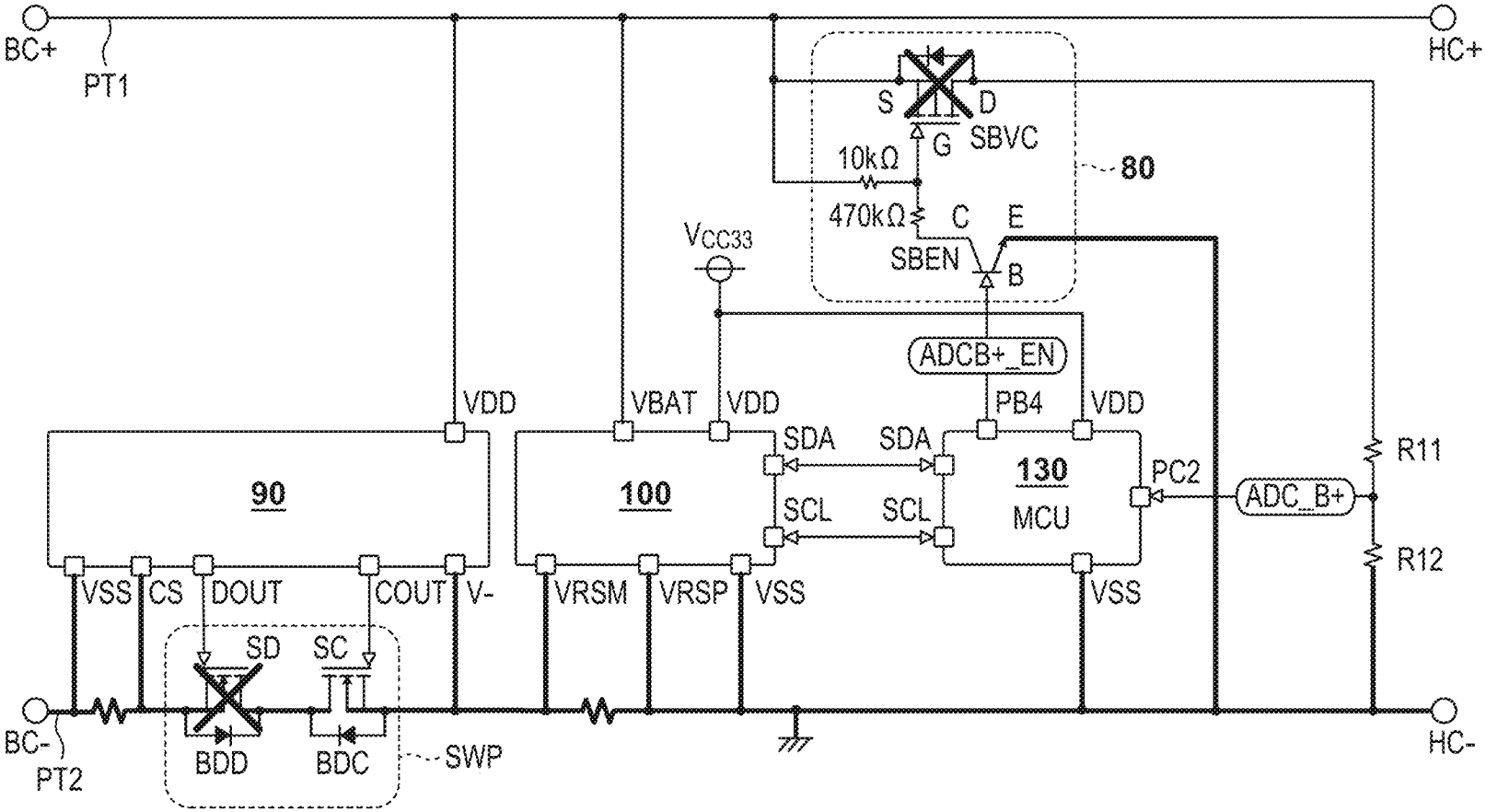
FIG. 29C is a view for explaining the operation of the circuit configuration shown in FIG. 29.

At the timing S4 shown in FIG. 29C, to charge the power supply BT, the USB cable is connected to the USB connector USBC by the user. Accordingly, the voltage supplied via the USB cable is supplied to the charge circuit 20 via the overvoltage protection circuit 110, the $V_{USB}$ line, the load switch 10, and the $V_{CC5}$ line, and the charge circuit 20 operates in the first power-pass mode set by default to supply the voltage $V_{CC}$ to the $V_{CC}$ line. Accordingly, the supply of the voltage $V_{CC33}$ to the measurement circuit 100 and the control unit 130 is resumed or started. Hence, the measurement circuit 100 and the control unit 130 resume or start the operations.

Figure 29D:
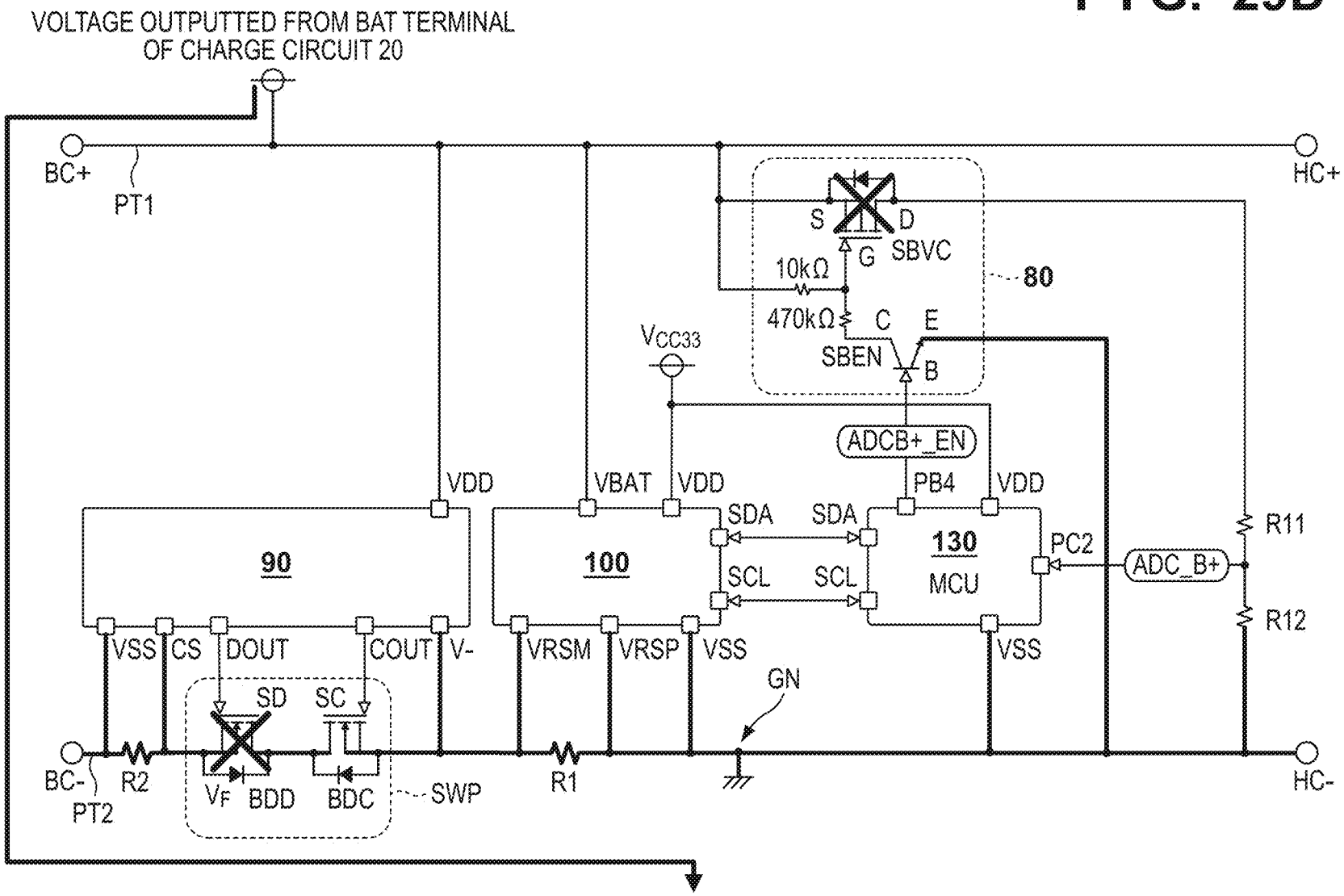
FIG. 29D is a view for explaining the operation of the circuit configuration shown in FIG. 29.
Figure 29E:
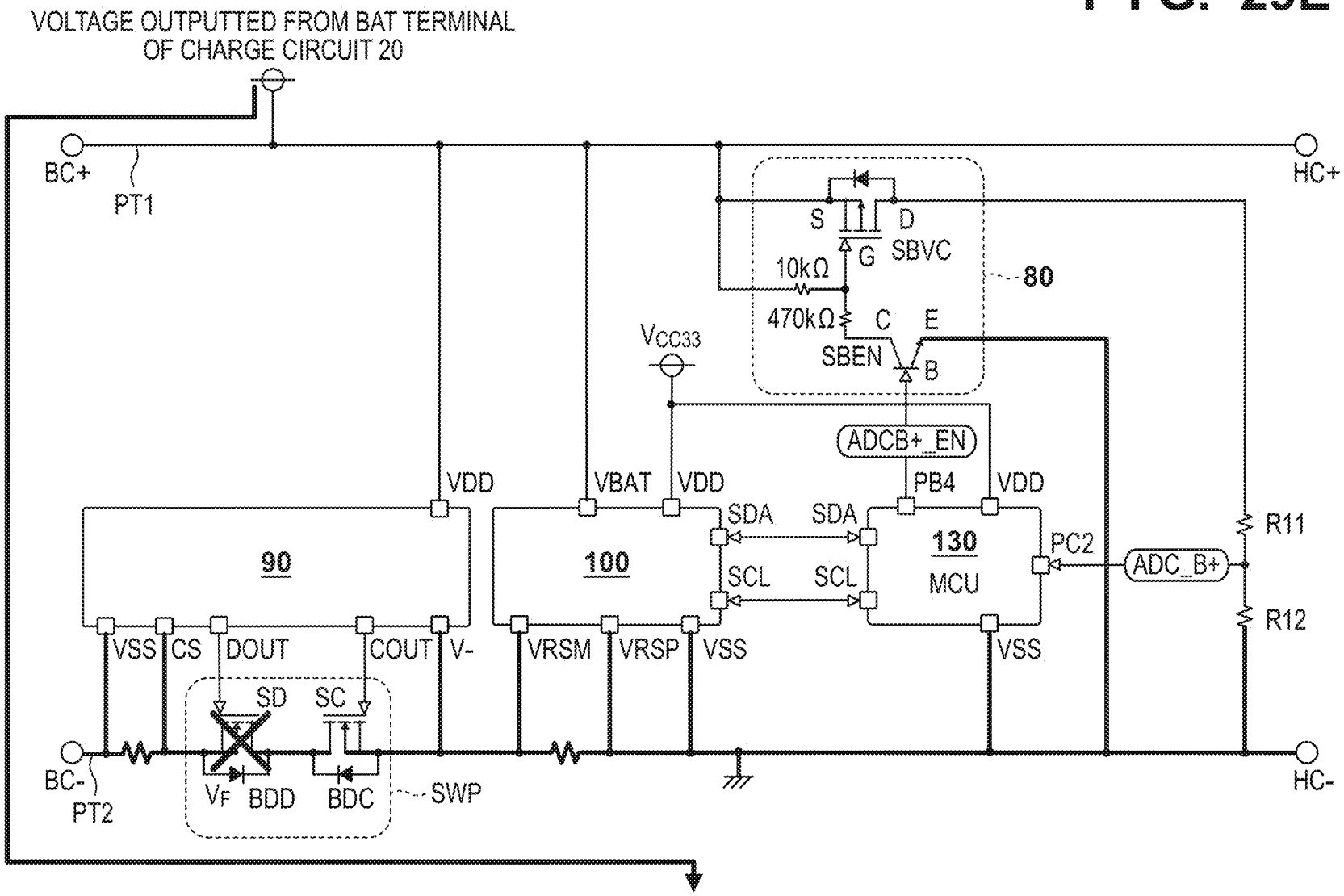
FIG. 29E is a view for explaining the operation of the circuit configuration shown in FIG. 29.

At the timing S5 shown in FIG. 29D, the control unit 130 outputs low level from the PB3 terminal to supply low level (enable level) to the /CE terminal of the charge circuit 20. Thus, the charge circuit 20 starts an operation of supplying the charge voltage from the BAT terminal to the power supply BT, and the potential of the positive electrode of the power supply BT starts rising. The charge current of the power supply BT at this time can be a first current value (in FIG. 28, 540 mA) smaller than a predetermined current value. This is because if change is performed using a current value as in normal charge in the overdischarge state or the deep discharge state of the power supply BT, the power supply BT may be in an unrecoverable state.

In the period of timings S5 to S7, the first transistor SD is off. However, since the forward direction of the body diode BDD connected in parallel with the first transistor SD and the direction in which the charge current for charging the power supply BT flows match, the power supply BT can be charged. However, with respect to a ground node GN (the same node as the ground terminal of the USB connector USBC) as a reference, the potential of the second power supply connector BC− to which the negative electrode of the power supply BT is connected is higher by an amount corresponding to the voltage drop in the path therebetween. In the example shown in FIG. 29D, the potential of the second power supply connector BC− to which the negative electrode of the power supply BT is connected is higher than the potential of the ground node GN by an amount corresponding to the forward voltage VF of the body diode BDD and the voltage drop caused by the resistors R1 and R2. Since the electrical resistance value of the resistor R2 connected to the protection circuit 90 and the electrical resistance value of the resistor R1 connected to the measurement circuit 100 are very small, the voltage drop caused by the resistors R1 and R2 is negligible. Hence, if the power supply BT is in the normal state, the potential of the second power supply connector BC− substantially equals the potential of the ground node GN. However, the forward voltage V F of the body diode BDD is generally several hundred mV and cannot be neglected.

At the timing S6 when the potential of the positive electrode of the power supply BT rises up to the potential before the overdischarge region, the switch circuit 80 is turned on, and a potential ADC_B+ obtained by dividing the potential of the positive electrode of the power supply BT at a predetermined voltage division ratio is supplied to the PC2 terminal of the control unit 130. Based on the voltage division ratio, the control unit 130 can convert the potential of the PC2 terminal into the potential of the positive electrode of the power supply BT. The voltage division ratio is determined by the resistance values of the resistors R11 and R12.

Figure 29F:
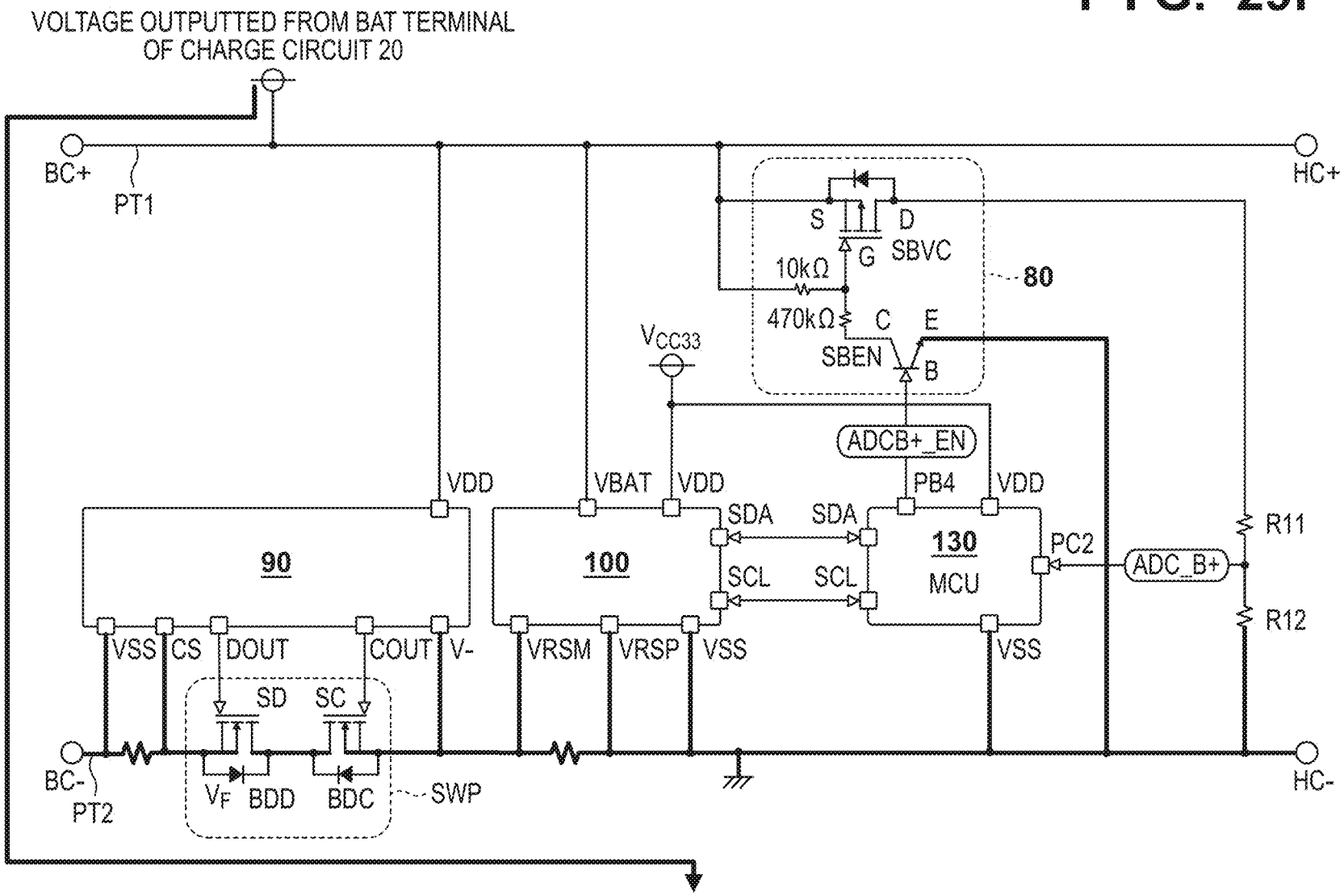
FIG. 29F is a view for explaining the operation of the circuit configuration shown in FIG. 29.

After that, at the timing S7 shown in FIG. 29F, the protection circuit 90 closes the first transistor SD. The path passing through the first transistor SD is thus formed. Since the ON resistance of the first transistor SD can be neglected, the potential detected as the potential of the power supply BT by the control unit 130 and the measurement circuit 100 matches the potential of the positive electrode of the power supply BT. That is, when the first transistor SD is closed, the potential detected by the protection circuit 90 lowers by an amount corresponding to the forward voltage VF of the body diode BDD. The protection circuit 90 acquires the potential difference between the VBAT terminal and the VSS terminal as the potential of the positive electrode of the power supply BT (the output voltage of the power supply BT). That is, the potential of the positive electrode of the power supply BT (the output voltage of the power supply BT) acquired by the protection circuit 90 is not affected by the forward voltage V F of the body diode BDD. Hence, the potential of the positive electrode of the power supply BT (the output voltage of the power supply BT) acquired by the protection circuit 90 substantially equals its true value. At the timing S3 shown in FIG. 29B, the first transistor (switch) SD is turned off, and at the timing S7 shown in FIG. 29F, the first transistor (switch) SD is turned on. As is apparent from FIG. 28 and the like, the potential of the positive electrode of the power supply BT (the output voltage of the power supply BT) when turning off the first transistor (switch) SD can be different from the potential of the positive electrode of the power supply BT (the output voltage of the power supply BT) when turning on the first transistor (switch) SD. More specifically, the potential of the positive electrode of the power supply BT (the output voltage of the power supply BT) when turning off the first transistor (switch) SD is lower than the potential of the positive electrode of the power supply BT (the output voltage of the power supply BT) when turning on the first transistor (switch) SD. This can function as a hysteresis for suppressing a situation in which the first transistor (switch) SD is turned off immediately after the first transistor (switch) SD is turned on.

Figure 30:
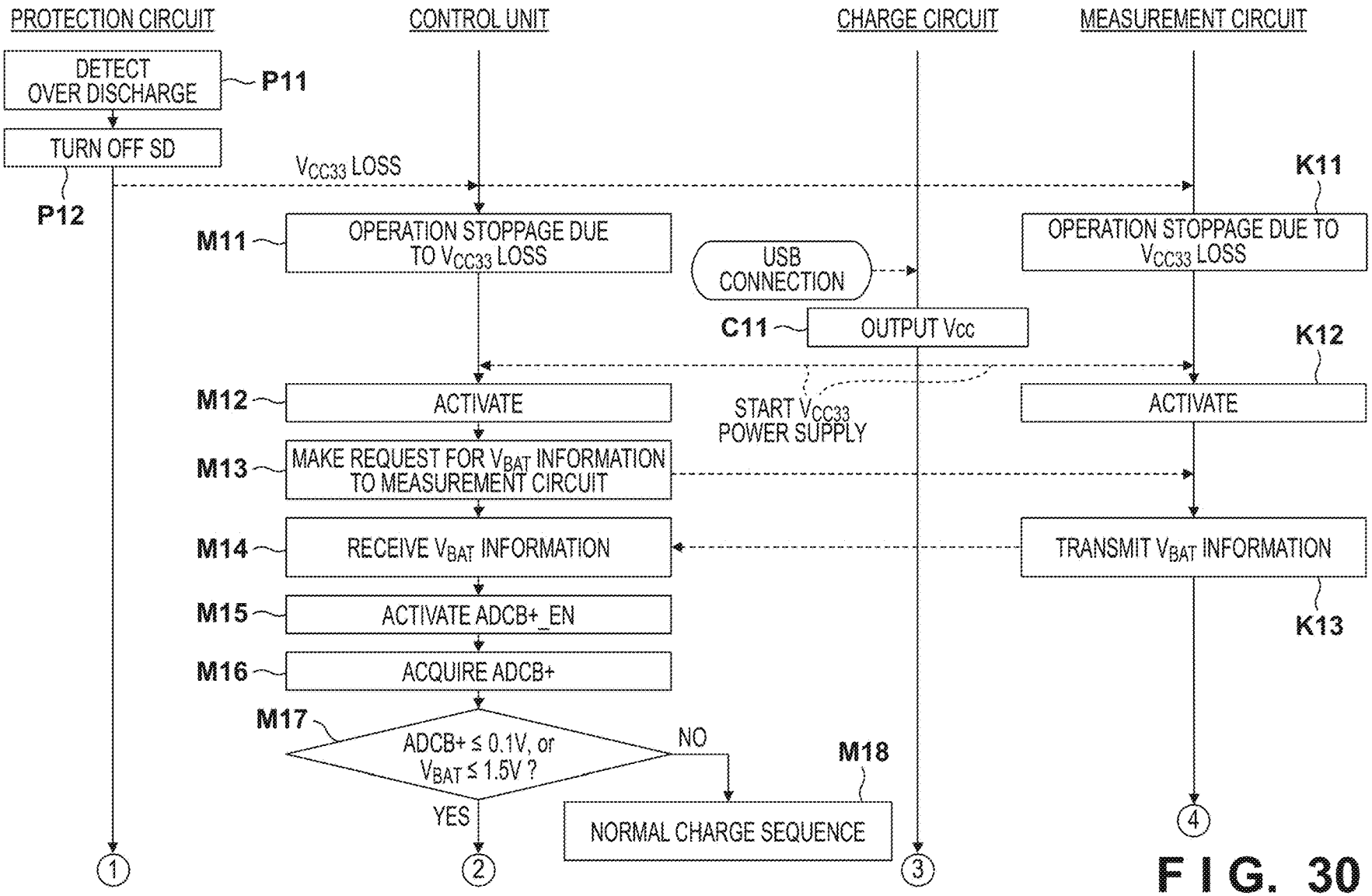
FIG. 30 is a sequence chart time-serially showing an example of the operations of the protection circuit, the control unit, the charge circuit, and the measurement circuit.
Figure 31:
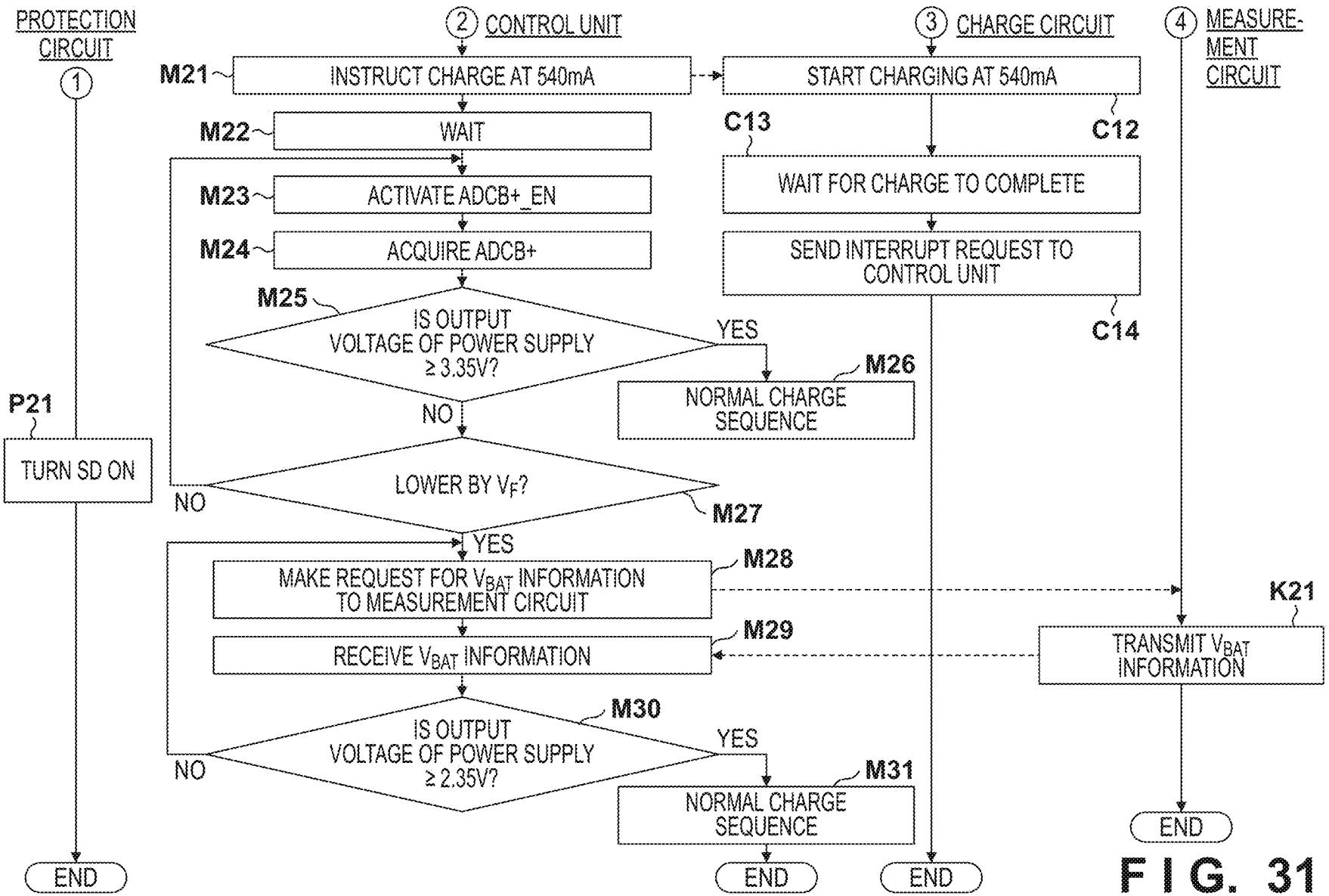
FIG. 31 is a sequence chart time-serially showing an example of the operations of the protection circuit, the control unit, the charge circuit, and the measurement circuit.
Figure 32:
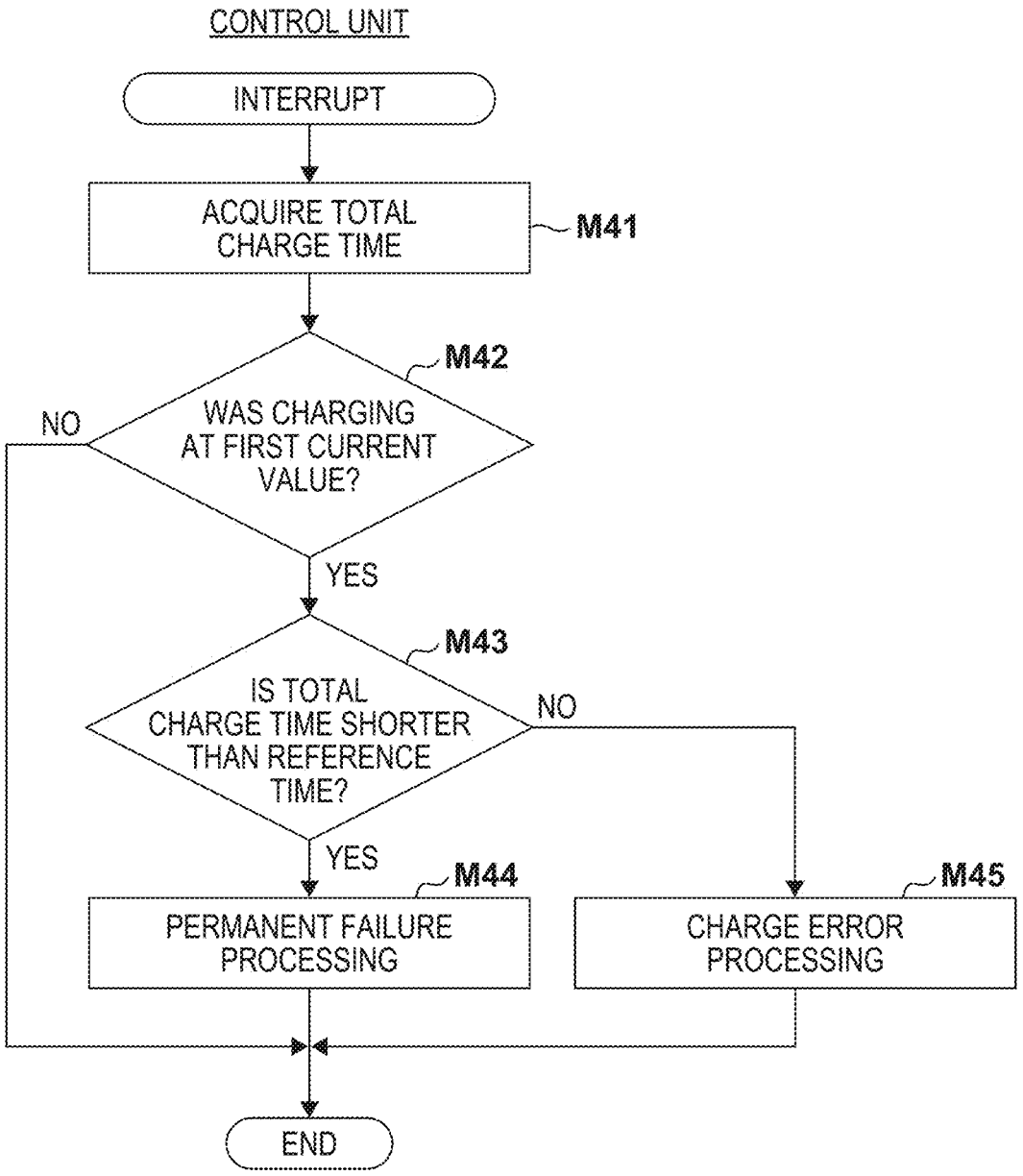
FIG. 32 is a flowchart showing an example of the operation of the control unit when interrupted by completion of charge.

FIGS. 30 and 31 time-serially show an example of the operations of the protection circuit 90, the control unit 130, the charge circuit 20, and the measurement circuit 100. FIG. 32 shows an example of the operation of the control unit 130 when interrupted by completion of charge. First, the potential of the positive electrode of the power supply BT continuously lowers due to discharge from the power supply BT. In step P11, the protection circuit 90 detects that the potential of the positive electrode of the power supply BT falls below the first level. In response to this, in step P12, the protection circuit 90 turns off the first transistor (switch) SD (the timing S3 in FIG. 28 and FIG. 29B). Thus, the supply of the voltage $V_{CC33}$ to the control unit 130 and the measurement circuit 100 is cut off. For this reason, the control unit 130 stops the operation in step M11 and the measurement circuit 100 stops the operation in step K11. Steps P12, M11, and K11 can occur substantially simultaneously.

After that, the USB cable connected to an external device is connected to the USB connector USBC (the timing S4 shown in FIG. 28 and FIG. 29C). Thus, power can be supplied from the external device to the $V_{BUS}$ terminal of the charge circuit 20. The charge circuit 20 operates in the first power-pass mode, electrically connects the $V_{BUS}$ terminal and the SW terminal, and supplies the voltage $V_{CC}$ to the $V_{CC}$ line using the voltage $V_{CC5}$ supplied via the $V_{CC5}$ line (step C11). Upon receiving the supply of the voltage $V_{CC}$, the transformation circuit 30 generates the voltage $V_{CC33_0}$, and the load switch 40 receives the voltage $V_{CC33_0}$ and outputs the voltage $V_{CC33}$. Thus, the voltage $V_{CC33}$ is supplied to the control unit 130 and the measurement circuit 100.

In step M12, the control unit 130 is activated (reactivated), and concurrently, in step K12, the measurement circuit 100 is activated (reactivated), too. In step M13, the control unit 130 requests providing of the information (VBAT information) of the output voltage of the power supply BT from the measurement circuit 100 via the VC interface. In step K13, the measurement circuit 100 provides the information (VBAT information) of the output voltage of the power supply BT to the control unit 130 via the VC interface. In step M14, the control unit 130 receives the information (VBAT information) of the output voltage of the power supply BT from the measurement circuit 100 via the $I^2C$ interface.

In step M15, the control unit 130 changes the ADCB+_EN signal to the active level. In step M16, the control unit 130 acquires the potential of the positive electrode of the power supply BT (the output voltage of the power supply BT) based on the potential (also called an ADCB+ signal) supplied to the PC2 terminal.

In step M17, the control unit 130 judges whether the potential of the positive electrode of the power supply BT (the output voltage of the power supply BT) acquired in step M16 is equal to or smaller than a first predetermined threshold (for example, 0.1 V), or the information (V BAT information) of the output voltage of the power supply BT acquired from the measurement circuit 100 in step M14 is equal to or smaller than a second predetermined threshold (for example, 1.5 V).

If the potential of the positive electrode of the power supply BT (the output voltage of the power supply BT) acquired in step M16 is equal to or smaller than the first predetermined threshold, or the information (VBAT information) of the output voltage of the power supply BT acquired from the measurement circuit 100 in step M14 is equal to or smaller than the second predetermined threshold, in step M21, an instruction is sent to the charge circuit 20 via the VC interface to charge the power supply BT with a first current value smaller than a predetermined current value (the timing S5 in FIG. 28 and FIG. 29D). On the other hand, if the potential of the positive electrode of the power supply BT (the output voltage of the power supply BT) acquired in step M16 is not equal to or smaller than the first predetermined threshold, and the information (VBAT information) of the output voltage of the power supply BT acquired from the measurement circuit 100 in step M14 is not equal to or smaller than the second predetermined threshold, in step M18, an instruction is sent to the charge circuit 20 via the VC interface to charge the power supply BT with a second current value (normal charge sequence) larger than a predetermined current value.

The normal charge sequence is general CCCV charge, and the description thereof will be omitted. Note that if the potential of the positive electrode of the power supply BT (the output voltage of the power supply BT) so lowers that the protection circuit 90 turns off the first transistor (switch) SD, the potential of the second conductive path PT2 (that is, the ground potential) is input to the PC2 terminal via the resistor R12. That is, the potential of the positive electrode of the power supply BT (the output voltage of the power supply BT) acquired in step M16 should be 0.1 V or less. In other words, if the potential of the positive electrode of the power supply BT (the output voltage of the power supply BT) acquired in step M16 exceeds 0.1 V, it can be considered that due to noise or a very low temperature environment, it is erroneously judged that the power supply BT is in the overdischarge state or the deep discharge state.

As another example, in step M17, the control unit 130 judges whether the potential of the positive electrode of the power supply BT (the output voltage of the power supply BT) acquired in step M16 is equal to or smaller than a predetermined threshold (for example, 0.1 V). If the potential of the positive electrode of the power supply BT (the output voltage of the power supply BT) acquired in step M16 is equal to or smaller than the predetermined threshold (for example, 0.1 V), in step M21, the control unit 130 sends an instruction to the charge circuit 20 via the VC interface to charge the power supply BT with the first current value smaller than a predetermined current value (the timing S5 in FIG. 28 and FIG. 29D). On the other hand, if the potential of the positive electrode of the power supply BT (the output voltage of the power supply BT) acquired in step M16 is not equal to or smaller than the predetermined threshold (for example, 0.1 V), in step M18, an instruction is sent to the charge circuit 20 via the FC interface to charge the power supply BT with the second current value (normal charge sequence) larger than the predetermined current value.

As still another example, in step M17, the control unit 130 judges whether the information ($V_{BAT}$ information) of the output voltage of the power supply BT acquired from the measurement circuit 100 in step M14 is equal to or smaller than a predetermined threshold (for example, 1.5 V). If the information ($V_{BAT}$ information) of the output voltage of the power supply BT acquired from the measurement circuit 100 in step M14 is equal to or smaller than the predetermined threshold (for example, 1.5 V), in step M21, the control unit 130 sends an instruction to the charge circuit 20 via the $I^2C$ interface to charge the power supply BT with the first current value smaller than a predetermined current value (the timing S5 in FIG. 28 and FIG. 29D). On the other hand, if the potential of the positive electrode of the power supply BT (the output voltage of the power supply BT) acquired in step M14 is not equal to or smaller than the predetermined threshold (for example, 1.5 V), in step M18, an instruction is sent to the charge circuit 20 via the $I^2C$ interface to charge the power supply BT with the second current value (normal charge sequence) larger than the predetermined current value.

In step M22, the control unit 130 waits for a predetermined time. During the predetermined time, charge of the power supply BT progresses in step C12 to be described later. In step M23, the control unit 130 changes the ADCB+_EN signal to the active level. In step M24, the control unit 130 acquires the potential of the positive electrode of the power supply BT (the output voltage of the power supply BT) based on the potential (ADCB+signal) supplied to the PC2 terminal. In step M25, the control unit 130 judges whether the potential of the positive electrode of the power supply BT (the output voltage of the power supply BT) acquired in step M24 is equal to or larger than the second level (for example, 3.35 V). If the potential of the positive electrode of the power supply BT (the output voltage of the power supply BT) acquired in step M24 is equal to or larger than the second level (for example, 3.35 V), in step M26, the control unit 130 sends an instruction to the charge circuit 20 via the $I^2C$ interface to charge the power supply BT with the second current value (normal charge sequence) larger than the predetermined current value.

On the other hand, if the potential of the positive electrode of the power supply BT (the output voltage of the power supply BT) acquired in step M24 is not equal to or larger than the second level (for example, 3.35 V), in step M27, the control unit 130 judges whether the potential of the positive electrode of the power supply BT (the output voltage of the power supply BT) acquired in step M24 is lower than the potential of the positive electrode of the power supply BT (the output voltage of the power supply BT) acquired in preceding step M24 by an amount corresponding to the forward voltage V F of the above-described body diode SDD, that is, whether the first transistor (switch) SD is turned on. This judgment can be executed by determining whether a value obtained by subtracting the potential of the positive electrode of the power supply BT (the output voltage of the power supply BT) acquired in current step M24 from the potential of the positive electrode of the power supply BT (the output voltage of the power supply BT) acquired in preceding step M24 is equal to or larger than the forward voltage VF of the body diode SDD. Upon judging that the first transistor (switch) SD is turned on, the control unit 130 advances the process to step M28. On the other hand, upon judging that the first transistor (switch) SD is not turned on, the control unit 130 returns the process to step M23. In the time series exemplified in FIG. 31, in step P21, the protection circuit 90 closes the first transistor SD (the timing S7 in FIG. 28 and FIG. 29F).

In step M28, the control unit 130 requests providing of the information ($V_{BAT}$ information) of the output voltage of the power supply BT from the measurement circuit 100 via the $I^2C$ interface. In step K21, the measurement circuit 100 provides the information ($V_{BAT}$ information) of the output voltage of the power supply BT to the control unit 130 via the $I^2C$ interface. In step M29, the control unit 130 receives the information (V BAT information) of the output voltage of the power supply BT from the measurement circuit 100 via the $I^2C$ interface.

In step M30, the control unit 130 judges whether the potential of the positive electrode of the power supply BT (the output voltage of the power supply BT) acquired in step M29 is equal to or larger than the fourth level (for example, 2.35 V). If the potential of the positive electrode of the power supply BT (the output voltage of the power supply BT) acquired in step M29 is equal to or larger than the fourth level, in step M31, the control unit 130 sends an instruction to the charge circuit 20 via the $I^2C$ interface to charge the power supply BT with the second current value (normal charge sequence) larger than the predetermined current value (the timing S8 in FIG. 28). On the other hand, if the potential of the positive electrode of the power supply BT (the output voltage of the power supply BT) acquired in step M29 is not equal to or larger than the fourth level, the control unit 130 returns the process to step S28. The fourth level is a reference used in a state in which the first transistor (switch) SD is on and can therefore be a value smaller than the second level. Also, the fourth level is a value larger than the first level.

The charge circuit 20 starts charging the power supply BT in step C12 and then waits for completion of the charge of the power supply BT in step C13. If the charge is completed, in step C14, the charge circuit 20 can send an interrupt request to the control unit 130. On the other hand, upon receiving the interrupt request from the charge circuit 20, the control unit 130 can execute processing shown in FIG. 32 separately from the processing shown in FIGS. 30 and 31.

In step M41, the control unit 130 acquires a total charge time required for the charge of the power supply BT from the charge circuit 20 via the $I^2C$ interface. In step M42, the control unit 130 judges whether the state immediately before the interrupt request is received from the charge circuit 20 is a state in which the power supply BT is being charged with the first current value. If the state immediately before the interrupt request is received is not the state in which the power supply BT is being charged with the first current value, the processing shown in FIG. 32 is ended. On the other hand, if the state immediately before the interrupt request is received is the state in which the power supply BT is being charged with the first current value, the control unit 130 executes error processing. The error processing can include two types of processes as will be described below. In other words, the control unit 130 judges whether the state immediately before the interrupt request is received is a state before the charge current is changed from the first current value to the second current value. If the state immediately before the interrupt request is received is the state before the charge current is changed from the first current value to the second current value, permanent failure processing is executed. On the other hand, if the state immediately before the interrupt request is received is a state after the charge current is changed from the first current value to the second current value, the control unit 130 executes charge error processing.

More specifically, in step M43, the control unit 130 determines whether the total charge time acquired from the charge circuit 20 in step M41 is shorter than a reference time. If the total charge time is shorter than the reference time, the control unit 130 executes permanent failure processing as one error processing in step SM44. For example, the control unit 130 can execute, as the permanent failure processing, processing of changing the aerosol generation device AGD or the power supply unit PSU to an unusable state. This can be synonymous with the above-described shifting the aerosol generation device AGD or the power supply unit PSU to the permanent failure mode. The control unit 130 can stop the output of the voltage from the SYS terminal and the SW terminal of the charge circuit 20 by, for example, sending a command for inhibiting operations in all power-pass modes to the charge circuit 20 via the $I^2C$ interface. This cuts off the supply of power to the control unit 130, and the control unit 130 is in an inoperable state. This operation contributes to inhibition of charge and discharge of the power supply BT judged to be in the deep discharge state and improvement of safety.

On the other hand, in step M41, if the total charge time acquired from the charge circuit 20 is not shorter than the reference time, in step M45, the control unit 130 executes charge error processing as the other error processing. The charge error processing can include processing of inhibiting charge of the power supply BT and supply of power to the heater HT. The charge error processing can include processing of urging the user to do an operation for reset or reactivation using the notification unit NU. If the control unit 130 is reset or reactivated, the control unit 130 can change to the sleep mode. In this case, the user can charge the power supply BT again by connecting the USB cable to the USB connector USBC again. If the power supply BT is in the normal state, supply of power to the heater HT is possible.

As described above, the control unit 130 can be configured to execute error processing if the charge circuit 20 (voltage supply circuit) ends the charge before the potential of the positive electrode of the power supply BT detected based on the potential supplied to the PC2 terminal exceeds the second threshold. If the time required by the charge circuit 20 to charge the power supply BT is shorter than the reference time, the control unit 130 can inhibit charge of the power supply BT and supply of power to the heater HT as error processing. In this case, the state in which charge of the power supply BT and supply of power to the heater HT are inhibited cannot be canceled. If the time required by the charge circuit 20 to charge the power supply BT is not shorter than the reference time, the control unit 130 can inhibit charge of the power supply BT and supply of power to the heater HT as error processing. In this case, the state in which charge of the power supply BT and supply of power to the heater HT are inhibited can be canceled by reactivating or resetting the control unit 130.

The embodiment described with reference to FIGS. 28, 29, 29A to 29F, and 30 to 32 has the following aspects.

The control unit 130 includes the PC2 terminal as the first terminal configured to receive information having correlation with the state of the power supply BT, and can acquire a first index according to information supplied to the PC2 terminal. The first information is an index representing the state of the power supply BT.

The measurement circuit 100 includes the $V_{BAT}$ terminal as the second terminal configured to receive information having correlation with the state of the power supply BT, and can generate a second index according to information supplied to the $V_{BAT}$ terminal and provide it to the control unit 130. Providing of the second index to the control unit 130 can be performed using the $I^2C$ interface.

The control unit 130 can control the charge operation of the power supply BT in accordance with the first index and the second index. For example, steps M23, M24, M25, and M26 in FIG. 31 show an example of a sequence for controlling the charge operation of the power supply BT based on the first index according to the information supplied to the PC2 terminal of the control unit 130. Also, M28, M29, M30, and M31 in FIG. 31 show an example of a sequence for controlling the charge operation of the power supply BT based on the second index generated by the measurement circuit 100 and provided to the control unit 130. It is very difficult to judge the state of the power supply BT that is not in the normal state based on only one index. According to this configuration, since the control unit 130 acquires the state of the power supply BT from the first index and the second index, appropriate charge can be performed even for the power supply BT that is not in the normal state.

The charge circuit 20 may be understood as a charge circuit capable of operating in a first mode in which the power supply BT is charged with the first current value smaller than a predetermined current value and in a second mode in which the power supply BT is charged with the second current value larger than the predetermined current value.

If at least one of the first index and the second index indicates that the power supply BT in the overdischarge state, the control unit 130 can control the charge operation of the power supply BT by the charge circuit 20 such that the power supply BT is charged in the first mode (step C12). It is not easy to accurately discriminate whether the power supply BT is in the overdischarge state. According to this configuration, even if one of the first index and the second index cannot detect the overdischarge state of the power supply BT, if the other can detect the overdischarge state, the power supply BT is charged in the first charge mode. That is, since charge at a high rate is not performed for the power supply BT that may be in the overdischarge state, the power supply BT in the overdischarge state does not fail due to charge at a high rate.

Alternatively, if at least one of the first index and the second index indicates that the overdischarge state of the power supply BT is eliminated, the control unit 130 can control the charge operation of the power supply BT by the charge circuit 20 such that the power supply BT is charged in the second mode (steps M26 and M31). During charge of the power supply BT, the potential of the positive electrode of the power supply BT detected by the control unit 130 or the information of the output voltage of the power supply BT ($V_{BAT}$ information) that the measurement circuit 100 provides to the control unit 130 may include the influence of the forward voltage V F of the body diode BDD. Since the forward voltage V F varies due to the temperature or the charge current value, it is not easy to judge, based on only one index, whether the overdischarge state of the power supply BT is eliminated. According to this configuration, even if one of the first index and the second index cannot detect elimination of the overdischarge state of the power supply BT, if the other can detect the elimination, the power supply BT is charged in the second charge mode. That is, since elimination of the overdischarge state of the power supply BT is hardly overlooked, the residual capacity of the power supply BT in the normal state can be recovered early.

Alternatively, if at least one of the first index and the second index indicates that the power supply BT in the overdischarge state, the control unit 130 can control the charge operation of the power supply BT by the charge circuit 20 such that the power supply BT is charged in the first mode (step C21), and if at least one of the first index and the second index indicates that the overdischarge state of the power supply BT is eliminated, the control unit 130 can control the charge operation of the power supply BT by the charge circuit 20 such that the power supply BT is charged in the second mode (steps M26 and M31).

In the above-described example, the first index and the second index are the potential of the positive electrode of the power supply BT or the output voltage of the power supply BT, and these are indices comparable on the same scale. Also, as described above, in the above-described example, the potential of the positive electrode of the power supply BT substantially equals the output voltage of the power supply BT.

As exemplified in M23 to M31 of FIG. 31, the control unit 130 can be configured to control the charge operation based on the first index in a state in which the first transistor (switch) SD is open, and control the charge operation based on the second index in a state in which the first transistor (switch) SD is closed. Here, the $V_{BAT}$ terminal of the measurement circuit 100 can directly be connected to the first conductive path PT1 (the positive electrode of the power supply BT). On the other hand, the PC2 terminal of the control unit 130 can be connected to the first conductive path PT1 (the positive electrode of the power supply BT) via a voltage division circuit formed by a transistor such as the PMOS transistor SBVC and/or the resistors R11 and R12. Alternatively, in another viewpoint, the PC2 terminal of the control unit 130 can be connected to the first conductive path PT1 (the positive electrode of the power supply BT) via an analog circuit. Hence, the accuracy of detecting or measuring the potential of the positive electrode of the power supply BT or the output voltage of the power supply BT is higher in the measurement circuit 100 than in the control unit 130. Hence, in a state in which the first transistor (switch) SD is closed and the influence of the forward voltage VF of the body diode BDD is eliminated (a state in which an error factor by the forward voltage VF is eliminated), it is advantageous that the control unit 130 controls the charge operation based on the second index provided from the measurement circuit 100.

The notification unit NU can notify information about the residual quantity of the power supply BT, and the control unit 130 can be configured to acquire a third index representing the residual quantity (for example, the residual capacity and the SOC) of the power supply BT as the state of the power supply BT from the measurement circuit and cause the notification unit NU to notify information according to the third index.

The invention is not limited to the foregoing embodiments, and various variations/changes are possible within the spirit of the invention.

What is claimed is:

1. An apparatus for an aerosol generation device, comprising:

a controller configured to control supply of power to a heater configured to heat an aerosol source using the power supplied from a power supply and a charge of the power supply; and circuitry configured to measure a state of the power supply;

detect that the state of the power supply is an abnormal state; and output an abnormality notification to the controller in response to the detection, wherein the circuitry includes an interface configured to provide state information about the state of the power supply to the controller, and the controller is configured to acquire the state information from the circuitry via the interface in response to the output of the abnormality notification.

2. The apparatus of claim 1, wherein the interface is configured to provide the state information in response to a request from the controller.

3. The apparatus of claim 2, wherein the controller is configured to execute a protection operation of protecting the power supply in accordance with the abnormality notification and the state information.

4. The apparatus of claim 3, wherein the protection operation includes inhibiting charge of the power supply and inhibiting discharge from the power supply to the heater.

5. The apparatus of claim 3, further comprising:

a user interface configured to output a notification that the power supply is abnormal.

6. The apparatus of claim 5, wherein the controller is configured to receive a reset command to reset the controller, and the protection operation is canceled by resetting the controller in response to receiving the reset command.

7. The apparatus of claim 2, wherein the circuitry is configured to output the abnormality notification in accordance with at least one of a charge current of the power supply exceeding a first reference value and a discharge current from the power supply exceeding a second reference value.

8. The apparatus of claim 2, wherein the state information includes at least one of information used to judge whether the power supply has permanently failed and information representing that the power supply has permanently failed.

9. The apparatus of claim 8, wherein the abnormal state includes a state in which a temperature of the power supply exceeds a reference temperature.

10. The apparatus of claim 2, further comprising:

a protection circuit configured to protect the power supply irrespective of control by the controller in response to the abnormality notification.

11. The apparatus of claim 10, wherein after the protection circuitry protects the power supply in response to the abnormality notification, if the state information acquired via the interface indicates that the power supply is not in the abnormal state, the controller enables the supply of the power to the heater.

12. The apparatus of claim 10, wherein protection of the power supply by the protection circuit can be canceled.

13. The apparatus of claim 2, wherein the controller is configured to acquire first information concerning the state of the power supply from the interface by periodical polling;

acquire second information concerning the state of the power supply from the interface in response to the abnormality notification; and execute an operation of protecting the power supply if the first information indicates that the power supply is in a first state; and the circuitry is configured to output the abnormality notification if the power supply is set in a second state worse than the first state.

14. The apparatus of claim 13, wherein the first information and the second information represent a temperature of the power supply.

15. The apparatus of claim 2, wherein the controller is configured to acquire first information concerning the state of the power supply via the interface by periodical polling;

acquire second information concerning the state of the power supply via the interface in response to the abnormality notification;

execute an operation of protecting the power supply if the first information indicates that at the time of the charge of the power supply, the state of the power supply satisfies one of conditions included in a first condition group; and execute the operation of protecting the power supply if the first information indicates that at the time of discharge of the power supply, the state of the power supply satisfies one of conditions included in a second condition group, and the number of conditions included in the first condition group is larger than the number of conditions included in the second condition group.

16. The apparatus of claim 2, wherein the circuitry is configured to acquire first information concerning the state of the power supply via the interface by periodical polling;

acquire second information concerning the state of the power supply via the interface in response to the abnormality notification;

execute an operation of protecting the power supply if the second information indicates that at the time of the charge of the power supply, the state of the power supply satisfies one of conditions included in a first condition group; and execute the operation of protecting the power supply if the second information indicates that at the time of discharge of the power supply, the state of the power supply satisfies one of conditions included in a second condition group, and the number of conditions included in the first condition group is smaller than the number of conditions included in the second condition group.

17. The apparatus of claim 2, wherein the abnormality notification includes a notification by a first abnormality signal and a notification by a second abnormality signal, the first abnormality signal is provided to the controller, and the second abnormality signal is provided to the controller, and the first abnormality signal is output from the circuitry if the state of the power supply is a first abnormal state, and the second abnormality signal is output from the circuitry if the state of the power supply is a second abnormal state different from the first abnormal state.

18. The apparatus of claim 17, wherein the first abnormality signal is provided to the controller via circuitry configured to hold the first abnormality signal.

19. An apparatus for an aerosol generation device, the apparatus comprising:

processing circuitry configured to control supplying power to a heater for heating an aerosol source using power supplied from a power supply;

a resistor arranged in a path through which current output from the power supply flows;

a thermistor configured to measure a temperature of the power supply;

a plurality of thermistor connectors to which the thermistor is connected; and circuitry configured to detect a state of the power supply using the resistor and measure the temperature of the power supply using the thermistor; and a substrate on which the resistor, the plurality of thermistor connectors, and the circuitry are arranged, wherein a shortest distance between the plurality of thermistor connectors and the circuitry is smaller than a shortest distance between the resistor and the circuitry.

20. An apparatus for an aerosol generation device, the apparatus comprising:

a power supply;

a first conductive path connected to a positive electrode of the power supply;

a second conductive path connected to a negative electrode of the power supply;

processing circuitry configured to control heat generation of a heater configured to heat an aerosol source using power supplied from the power supply;

circuitry configured to:

measure a state of the power supply using a resistor disposed in the second conductive path;

detect that the state of the power supply is an abnormal state; and output an abnormality notification to the processing circuitry in response to the detection, wherein the circuitry includes an interface configured to provide state information about the state of the power supply to the processing circuitry, and the processing circuitry is configured to acquire the state information from the circuitry via the interface in response to the output of the abnormality notification;

a switch arranged between the resistor and the negative electrode in the second conductive path so as to be able to cut off current flowing through the second conductive path; and a protection circuit configured to control the switch to protect the power supply according to the current flowing through the second conductive path.

* * * * *